US006011567A

United States Patent [19]

Nakamura et al.

[11] Patent Number: 6,011,567

[45] Date of Patent: Jan. 4, 2000

[54] IMAGE FORMING APPARATUS

[75] Inventors: Naoto Nakamura; Ichiro Nomura; Hidetoshi Suzuki, all of Atsugi; Tetsuya Kaneko, Yokohama; Haruhito Ono, Minami Ashigara; Toshihiko Takeda; Shinya Mishina, both of Tokyo, all of Japan

[73] Assignee: Canon Kabushiki Kaisha, Tokyo, Japan

[21] Appl. No.: 08/388,896

[22] Filed: Feb. 14, 1995

Related U.S. Application Data

[63] Continuation of application No. 07/813,911, Dec. 27, 1991, abandoned.

[30] Foreign Application Priority Data

| | | | |
|---|---|---|---|
| Dec. 28, 1990 | [JP] | Japan | 2-408941 |
| Apr. 25, 1991 | [JP] | Japan | 3-095346 |
| Jun. 18, 1991 | [JP] | Japan | 3-171917 |
| Jun. 18, 1991 | [JP] | Japan | 3-171918 |
| Jun. 18, 1991 | [JP] | Japan | 3-171920 |
| Jun. 19, 1991 | [JP] | Japan | 3-173428 |
| Jul. 19, 1991 | [JP] | Japan | 3-203521 |

[51] Int. Cl.[7] ..... B41J 2/00

[52] U.S. Cl. ..... 347/115; 347/120; 347/232; 347/233; 313/494; 313/495; 313/306; 315/169.3

[58] Field of Search ..... 347/115, 120, 347/121, 122, 232, 233, 238; 313/494, 495, 496, 497, 306, 307; 315/169.1, 169.3; 345/74, 75

[56] References Cited

U.S. PATENT DOCUMENTS

| | | | |
|---|---|---|---|
| 4,908,539 | 3/1990 | Meyer | 315/169.3 |
| 4,956,574 | 9/1990 | Kane | 313/306 |
| 4,958,104 | 9/1990 | Suzuki et al. | 313/495 |
| 5,155,416 | 10/1992 | Suzuki et al. | 315/169.3 X |

FOREIGN PATENT DOCUMENTS

| | | |
|---|---|---|
| 0388984 | 9/1990 | European Pat. Off. . |
| 0443865 | 8/1991 | European Pat. Off. . |
| 2647580 | 11/1990 | France . |
| 2662301 | 11/1991 | France . |
| 2183084 | 5/1987 | United Kingdom . |

OTHER PUBLICATIONS

M.I. Elinson, et al., "The Emission of Hot Electrons and the Field Emission of Electrons from Tin Oxide", Radio Engineering and Electronic Physics, pp. 1290–1296 (Jul. 1965).

M. Hartwell, et al., "Strong Electron Emission from Patterned Tin–Indium Oxide Thin Films", Department of Electrical Engineering and Computer Science, MIT, International Electron Devices Meeting, pp. 519–521 (1975).

Araki, et al., "Electroforming and Electron Emission of Carbon Thin Films", Journal of the Vacuum Society of Japan, vol. 26, No. 1, pp. 22–29 (1981).

G. Dittmer, "Electrical Conduction and Electron Emission of Discontinous Thin Films", Thin Solid Films, 9, pp. 317–328 (1972).

*Primary Examiner*—N. Le
*Assistant Examiner*—Shih-Wen Hsieh
*Attorney, Agent, or Firm*—Fitzpatrick, Cella, Harper & Scinto

[57] ABSTRACT

An image forming apparatus having a plurality of electron emitting devices and luminescent members are arranged into a matrix formed on one surface of a substrate. As rows of electron emitting devices are successively driven, each luminescent member emits light according to a voltage applied to it or other members in accordance with an image information signal when irradiated with a light beam from one of the electron emitting devices mated with it.

83 Claims, 40 Drawing Sheets

FIG. 49A
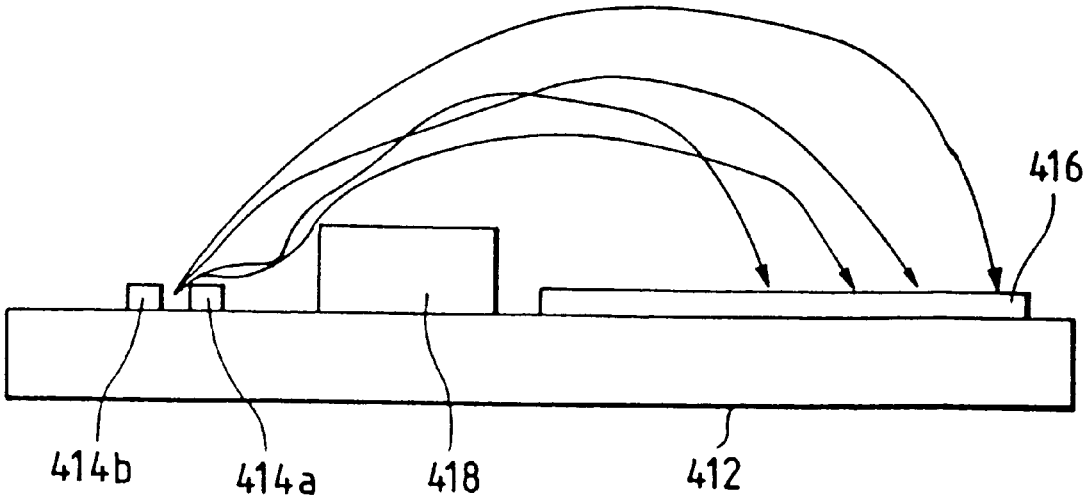
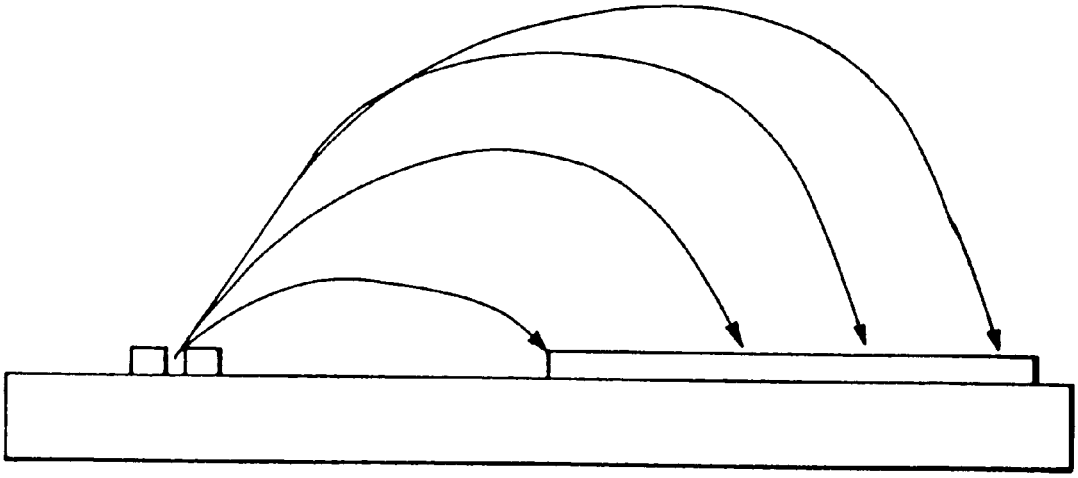
FIG. 49B

FIG. 52A
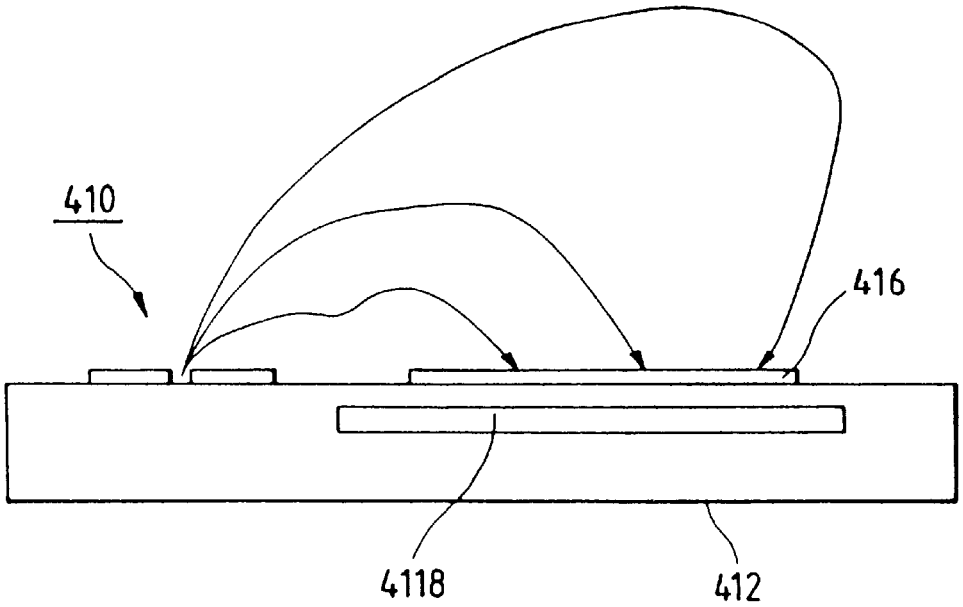
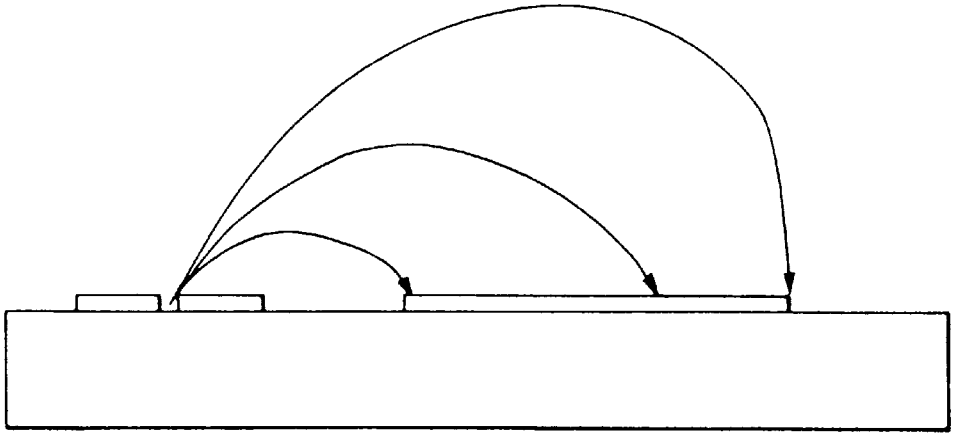
FIG. 52B

IMAGE FORMING APPARATUS

This application is a continuation of application Ser. No. 07/813,911, filed Dec. 27, 1991, now abandoned.

BACKGROUND OF THE INVENTION

1. Field of the Invention

This invention relates to an image forming apparatus using an electron emitting device.

2. Relating Background Art

A thin type image forming apparatus is known which has a plurality of electron emitting devices disposed along a plane, and image forming members (which emit light, or are charged or changed in color or quality by collision of electrons, e.g., members formed of a luminescent material or a resist material) which respectively face the electron emitting devices, and on which an image is formed by irradiation with electrons beams emitted from the electron emitting devices.

FIG. 71 schematically shows an example of such an image forming apparatus, that is, a conventional electron beam display apparatus.

The electron beam display apparatus shown in FIG. 71 has a construction in which modulation electrodes are disposed between electron emitting devices and image forming members oppose each other. More specifically, this image forming apparatus has a rear plate 91, support members 92, wiring electrodes 93, electron emission sections 94, electron passage holes 95, modulation electrodes 96, a glass plate 97, a transparent electrode 98, and luminescent members 99 (image forming members 99). The glass plate 97, the transparent electrode 98 and the luminescent members 99 constitute a face plate 100. The luminescent members have luminous points 101. The electron emitting sections 94 of the electron emitting devices (constituted of components 92, 93, and 94) are formed by a thin film formation technique as a hollow structure such that the wiring electrodes do not contact the rear plate 91. The modulation electrodes 96 are disposed in a space defined above the electron emitting sections 94 (in the electron emitting direction) and therefore have the holes 95 for passage of emitted electrode beams.

In this electron beam display apparatus, a voltage is applied to each wiring electrode 93 to heat the hollow-structure electron emitting sections 94 to emit thermions from the same, voltages are applied to the modulation electrodes 96 to modulate the flow of the emitted electrons in accordance with an information signal, and the electrons are extracted through the passage holes 95 and are accelerated to collide against the luminescent members 99. The wiring electrodes 93 and the modulation electrodes 96 form an X-Y matrix to effect image display on the luminescent members 99, i.e., image forming members.

In the above-described conventional image forming apparatus, however, the image forming members (luminescent members) are disposed in the space above the electron emitting devices (in the electron emitting direction) so as to face the electron emitting devices, and the following problems are therefore encountered.

① When each image forming member or a gas in the device (residual gas) is irradiated with an electron beam, ions (positive ions) are generated. These ions are accelerated in the direction opposite to the direction of acceleration of electrons by the high voltage for accelerating electrons. Consequently, these positive ions collide against and damage the electron emitting devices. The extent of damage thereby caused is seriously large if the device is driven under a condition that the degree of vacuum inside the device is not higher than a level at $10^{-5}$ torr. Even if high vacuum is maintained in the device, the same damage is caused during a long-time continuous operation of the device. Such damage to the electron emitting device results in a reduction in the electron emission rate (electron emission efficiency) and, in the worst case, breakdown of the device. With respect to the performance of the image forming apparatus, a reduction in the contrast of the image formed on the image forming members (luminance unevenness or luminance fluctuation of the luminescent members) is caused.

② It is difficult to strictly align the positions of the image forming members (luminescent members) and the electron emitting sections of the electron emitting devices in a horizontal direction, and a small deviation of the position results in a considerable reduction in the contrast of the formed image (luminance unevenness or a luminance fluctuation of the luminescent image).

③ It is difficult to maintain a certain distance between the image forming members (luminescent members) and the electron emitting sections of the electron emitting devices, and a change in this distance (due to an impact or a thermal deformation during driving) results in an unintended reduction in the contrast of the formed image (luminance unevenness or a luminance fluctuation of the luminescent image).

④ Further, by the phenomena of the problems ② and ③, color unevenness is caused in the case of an image forming apparatus having image forming members formed of multicolor luminescent materials having colors red, green and blue, resulting in a deterioration in color reproducibility according to an information signal.

SUMMARY OF THE INVENTION

The present invention has been achieved in consideration of the above-described problems, and an object of the present invention is to provide an image forming apparatus capable of obtaining a high-contrast clear image and having a long life.

Another object of the present invention is to provide an image forming apparatus capable of forming a full-color image with reduced color unevenness and improved color reproducibility.

Still another object of the present invention is to provide an image forming apparatus which does not require strict positioning of the image forming members and the electron emitting sections of the electron emitting devices, and which can easily be manufactured.

To achieve these objects, according to one aspect of the present invention, there is provided an image forming apparatus comprising at least one electron emitting device, and at least one image forming member which forms an image when irradiated with an electron beam emitted from the electron emitting device, wherein the electron emitting device and the image forming member are juxtaposed on a surface of a substrate.

According to another aspect of the present invention, there is provided an image forming apparatus comprising at least one electron emitting device, at least one image forming member which forms an image when irradiated with an electron beam emitted from the electron emitting device, the electron emitting device and the image forming member being juxtaposed on a surface of a substrate, and voltage prescription means for prescribing a potential on the substrate.

According to still another object of the present invention, there is provided an image forming apparatus comprising at least one electron emitting device for emitting electrons, at least one group of luminescent members each capable of emitting light when irradiated with an electron beam from the electron emitting device, and voltage application means for applying a predetermined voltage to each of the luminescent members, wherein each luminescent member emits light according to the voltage applied by the voltage application means when irradiated with the light beam to form an image light emission pattern in accordance with the applied voltage; the electron emitting device and the luminescent members are arranged on a surface of a substrate; and the voltages are applied to the luminescent members in the group separately and independently by the voltage application means.

BRIEF DESCRIPTION OF THE DRAWINGS

FIGS. 49 and 52 are diagrams showing changes in electron beam flight loci with respect to existence and non-existence of a correction electrode in the image forming apparatus of the present invention;

DESCRIPTION OF THE PREFERRED EMBODIMENTS

Figure 1:
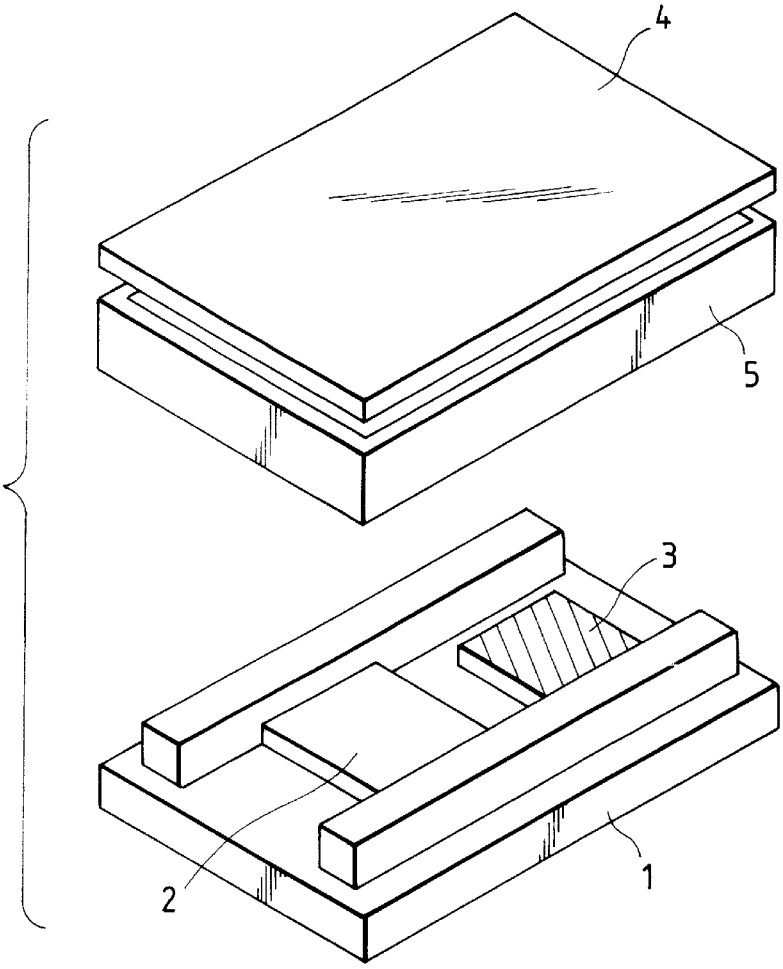
FIGS. 1, 14, 25 to 29, 32, 33, 35, 40, 44 to 46, 48, 50, 51, 53, 55 to 63, and 66 to 68 are schematic diagrams of the construction of an image forming apparatus in accordance with the present invention.

An image forming apparatus in accordance with the present invention will be described below. The image forming apparatus in accordance with the present invention is mainly characterized in that electron emitting elements and image forming members are juxtaposed on one substrate surface. More specifically, electron emitting elements and image forming members are arranged on the same substrate surface, as shown in FIG. 1. FIG. 1 shows a substrate 1 (rear plate), an electron emitting element 2, an image forming member 3, a face plate 4, and a support frame 5.

In the image forming apparatus having such a construction, an electron emitting element constituting an electron emitting device may comprises a hot cathode or cold cathode used as an electron source for conventional image forming apparatuses. In the case of a hot cathode, however, the electron emission efficiency and the response speed are reduced by thermal diffusion to the substrate. Also, there is a possibility of a change in the quality of image forming members and, therefore, hot cathodes and image forming members cannot be arranged at a high density. For these reasons, it is preferred that a cold cathode, such as an element of a later-described surface conduction type emission device or a semiconductor electron emission device, is used for the electron emitting element in accordance with the present invention. Among cold cathode type electron emitting elements, that of a surface conduction type emission device is particularly preferred because of the following and other advantages. If it is applied to the image forming apparatus of the present invention, 1) a high electron emission efficiency can be obtained,
2) the device structure in accordance with the present invention can be achieved and the electron emitting device can easily be manufactured, since this type of electron emitting device has a simple structure,
3) a multiplicity of electron emitting devices can be arranged and formed on one substrate,
4) a high response speed can be achieved, and
5) the luminance contrast can be further improved.

A surface conduction type device is, for example, a cold cathode device made public by M. I. Elison et al (Padio) Eng. Electron. Phys., Volume 10, pp 1290 to 1296, 1965) in which a voltage is applied between electrodes (device electrodes) which are provided on a substrate surface and between which a small-area thin film (electron emission section) is formed, and a current thereby flows parallel to the thin film surface to emit electrons. $SnO_2$ (Sb) thin film is used for this cold cathode device developed by Elison et al. Other cold cathode devices of this type having different thin films are known. For example, one using Au thin film (G. Dittmer: "Thin Solid Films", Volume 9, p 317, 1972), one using ITO thin film (M. Hartwell and C. G. Fonstad: "IEEE Trans. ED Conf.", p 519, 1975) and one using carbon thin film (Hisa Araki et al.: "Vacuum", Volume 26, No. 1, p 22, 1983) have been reported. The surface conduction type device used in accordance with the present invention comprises, as well as those mentioned above, one in which electron emission sections are formed by dispersing fine metallic particles as described later. Preferably, with respect to the form of the surface conduction type emission device, the sheet resistance of the thin film (electron emission section) is $10^3$ to $10^9$ $\Omega/\square$ and the distance between the electrodes is 0.01 to 100 $\mu$m.

Figure 2:
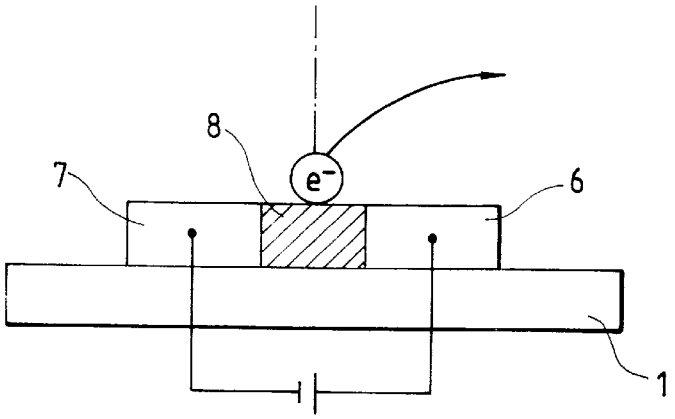
FIG. 2 is a diagram relating electron emission characteristics of a surface conduction type emitting device.

It is advantageous to use such a surface conduction type emission device as the electron emitting device in accordance with the present invention in another respect. That is, in a surface conduction type emission device, electrons emitted from the electron emission section formed between the electrodes fly by obtaining a component of velocity to the positive side during the application of the voltage and the electron beam path is largely deflected toward the positive electrode. As is apparent from FIG. 2, use of an electron emitting device having a large degree of deflection of the electron beam path in a horizontal direction is particularly preferred for the present invention, which is characterized in that electron emitting devices and image forming members are juxtaposed on a substrate surface. FIG. 2 shows an insulating substrate 1, a positive-side device electrode, a negative-side device electrode 7 and an electron emission section. (An electron emitting device referred to with respect to the present invention is constituted of components 6, 7 and 8 as shown in FIG. 2.) The arrow in FIG. 2 indicates an electron beam path.

Any member can be used as the image forming member in the above-described arrangement, so long as it is formed of a material which emits light or is charged, changed in color or quality, or deformed by being irradiated with electron beams emitted from the electron emitting element. For example, it may be formed of a luminescent material or a resist material. If a luminescent material is used for the image forming member, an image formed thereon is a light emitting (luminescent) image, and the image forming members may be formed of materials which emit three primary colors, red, green and blue to form a full-color luminescent image.

The shape and the constituent material of the substrate in accordance with the present invention, on which the electron emitting element and the image forming member described above are formed, are not particularly limited, so long as it can support the electron emitting element and the image forming member. However, preferably, the substrate has a uniform thickness and is flat. As described later, if wiring electrodes of electron emitting devices and image forming members are directly laminated on the substrate surface, the substrate is formed of an insulating material to maintain electrical insulation between wiring electrodes.

Essential component members of the image forming apparatus of the present invention are the electron emitting element, the image forming member and the substrate described above. However, the face plate 4, the support frame 5 and other members are provided as desired, as shown in FIG. 1. Also, it is preferable to set the vacuum in the panel container formed by the substrate (rear plate) 1, the face plate 4 and the support frame 5 as shown in FIG. 1 to $10^{-5}$ to $10^{-7}$ torr by considering electron emitting characteristics of the electron emitting device.

An example of a basic form of the image forming apparatus in accordance with the present invention will now be described below in detail. It is preferable for the image forming apparatus of the present invention to have an auxiliary means for reinforcing the effect of irradiation of the image forming member with electron beams. This auxiliary means is used to deflect, toward the image forming member, the locus of a beam of electrons emitted from the electron emitting element so that the electron beam can efficiently reach the image forming member.

Figure 3:
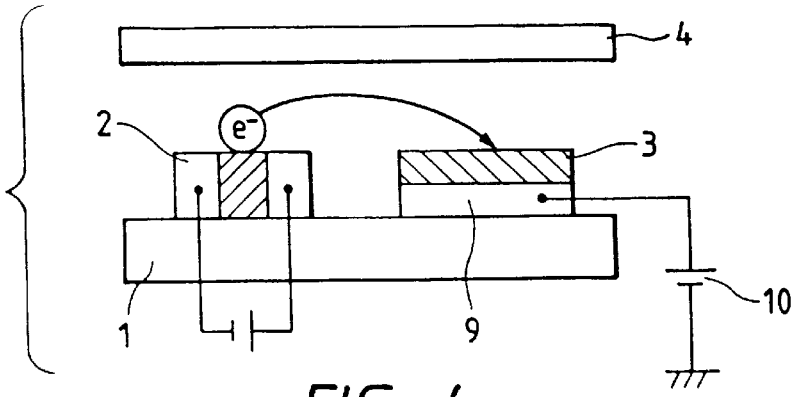
FIGS. 3 to 5, 17 to 20, 47, and 54 are diagrams of a method of driving the image forming apparatus of the present invention.

Such an auxiliary means for use in the present invention comprises a means for applying a voltage to the image forming member. For example, this voltage application means is constituted of, as shown in FIG. 3, an auxiliary electrode 9 disposed below the image forming member 3, and an auxiliary power source 10 connected to the auxiliary electrode 9; it is a means for setting a potential of the image forming member. The voltage applied to the image forming member by this voltage application means is a constant voltage such that the potential of the image forming member is set to a level higher than the ground potential (0 V), i.e., a positive level.

In a case where the above-described surface conduction type emission device is used as the electron emitting device in accordance with the present invention, the above auxiliary means can sufficiently reinforce the effect of irradiation of the image forming member with emitted electrons even if the voltage applied to the image forming member is low, since the surface conduction type emission device makes electrons fly to the image forming member. Because the applied voltage can be reduced, the interval of the disposition of the electron emitting device and the image forming member (the distance therebetween) can be reduced. Therefore the density at which a plurality of electron emitting elements and a plurality of image forming members are arranged into a matrix form as described later can be increased.

Figure 4:
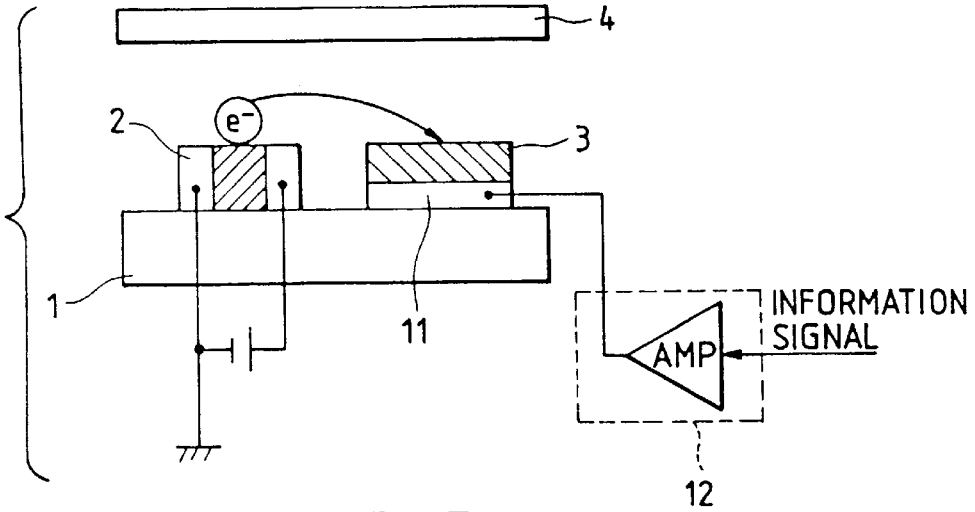
Figure 5:
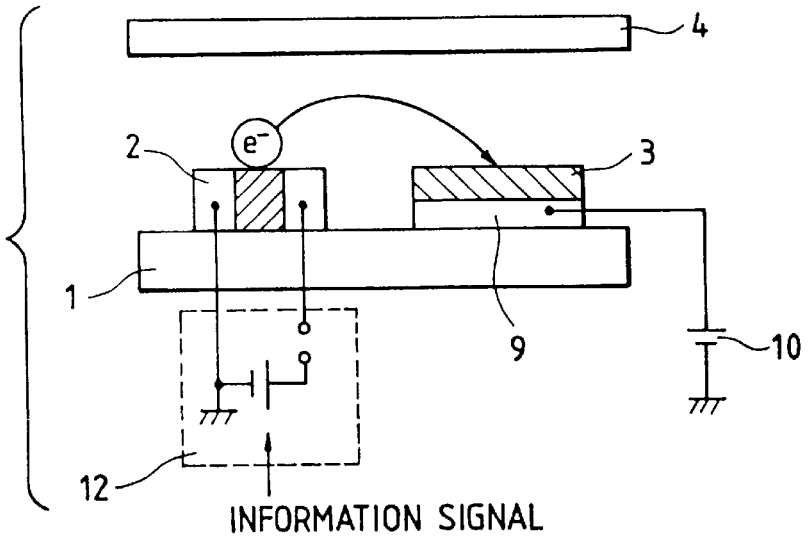

In a case where a beam of electrons emitted from the electron emitting device of the image forming apparatus of the present invention is modulated in accordance with an information signal (the electron emission is changed in an on-off manner), a modulation means other than the indispensable components including the electron emitting element and the image forming member is additionally provided. In the image forming apparatus of the present invention, such a modulation means is provided in such a manner that (1) the image formation means has a modulation means (FIG. 4) or (2) the electron emitting device has a modulation means (FIG. 5).

In the case (1), the modulation means has a voltage application means for applying a voltage to the image forming member in accordance with an information signal. For example, this voltage application means includes, as shown in FIG. 4, an electrode (modulating electrode) 11 disposed below the image forming member 3, and a modulation circuit 12 for changing the voltage applied to the electrode 11 in accordance with the information signal. For example, an electron beam is modulated in accordance with the information signal by the modulation means in such a manner that the irradiation of the image forming member with the electron beam is effected by applying a voltage higher than the ground potential (0 V), i.e., a positive voltage to the modulation electrode, and is stopped by applying a negative voltage to the modulation electrode.

In the case (2), the modulation means includes a voltage application means for applying a voltage to the electron emitting element in accordance with an information signal. For example, this voltage application means includes, as shown in FIG. 5, a modulation circuit 12 for changing the voltage applied to the electron emitting element 2 in accordance with the information signal. For example, an electron beam may be modulated in accordance with the information signal by the modulation means in such a manner that the power source for applying the voltage to the electron emitting element 2 is turned on/off.

In the image forming apparatus having the modulation means (1) in accordance with the present invention, the components 11 and 12 shown in FIG. 4 correspond to auxiliary means 9 and 10 shown in FIG. 3. That is, the modulation means or the auxiliary means is selected according to whether or not it is supplied with an image information signal. According to the present invention, it is preferable to provide such an auxiliary means or modulation means.

The above-described image forming apparatus of the present invention specifically has a construction in which an electron emitting element and an image forming member are juxtaposed on one substrate surface, and all the problems ① to ③ of the conventional image forming apparatuses can thereby be solved. The reason why the image forming apparatus of the present invention has an effect of solving the problem ① (the problem of damage to the electron emitting element) in particular among the above-described problems is still not clear. However, it may be clarified to some extent as described below.

Figure 6:
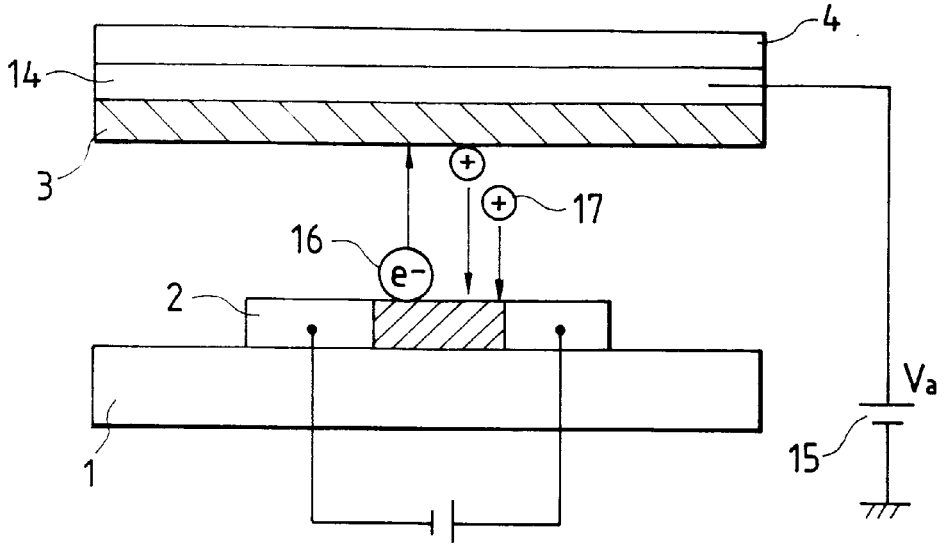
FIG. 6 is a diagram showing ion damage in a conventional image forming apparatus.
Figure 7:
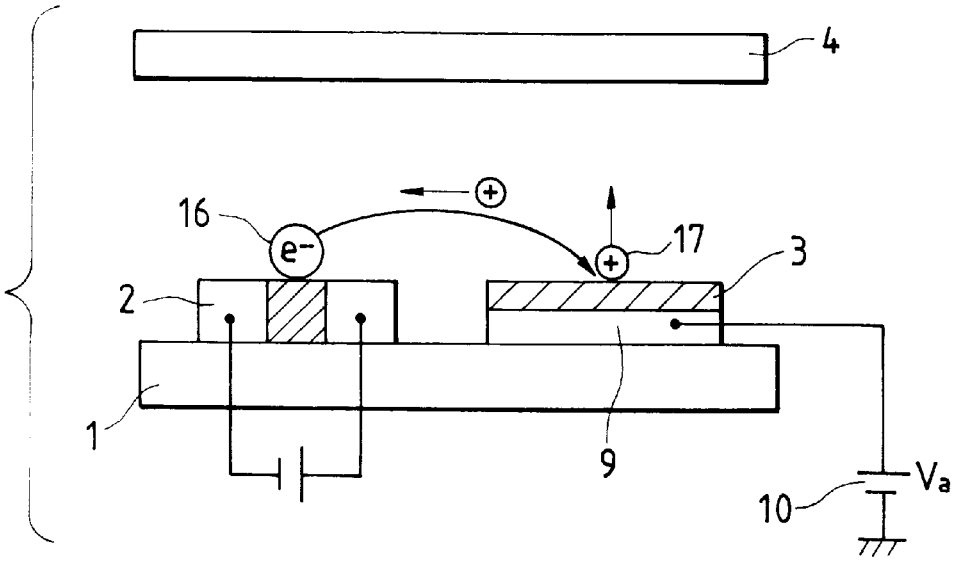
FIGS. 7 and 21 are diagrams showing ion damage in the image forming apparatus of the present invention.

FIG. 6 shows a schematic cross-sectional view of the construction of a conventional image forming apparatus (electron beam display), and FIG. 7 is a schematic cross-sectional view of the construction of the image forming apparatus of the present invention.

In the conventional image forming apparatus (FIG. 6), an electron 16 emitted from the electron emitting element 2 is accelerated by an acceleration voltage Va applied to the transparent electrode 14 (from a power source 15), and collides against a portion of the image forming member (luminescent member) 3 located generally perpendicularly above the position on the electron emitting element 2 from which the electron has been emitted to excite the luminescent member 3 to emit light to form an image. At this time, positive ions 17 generated by the collision of the electron beam against a gas existing between the electron emitting element 2 and the luminescent member 3 or the collision against the luminescent member 3 are accelerated by the acceleration voltage Va in the direction opposite to that of the acceleration of the electron 16 to collide against the electron emitting element 2. The extent of ionization of the residual gas is particularly large if the degree of vacuum in the device is not higher than a level at $10^{-5}$ torr, or if the amount of residual gas is increased during long-time use of the device. Ions thereby caused collide against the electron emitting element 2 and damage the same so that the electron emission rate (electron emission efficiency) is seriously reduced, resulting in a reduction in the life of the device.

In contrast, in accordance with the present invention, as shown in FIG. 7, the electron emitting element 2 and the image forming member 3 to which the acceleration voltage va is applied are juxtaposed, and electron 16 emitted form the electron emitting element 2 is accelerated by the acceleration voltage Va while the direction of its flying is thereby deflected, and collides against the image forming member 3. During this flying process, the electron beam also generates ions (positive ions) 17 from the residual gas and the image forming member. However, the mass of the ions is much greater than that of the electron and, therefore, the locus of the ions is not substantially deflected by the same force of the electric field as that applied to the electron. There is therefore substantially no possibility of collision of the ions against the electron emitting element 2 disposed by the side of and on the same plane as the image forming member 3 and, hence, substantially no possibility of damage to the electron emitting device.

In accordance with the present invention, the electron emitting device is preferably a linear electron emitting device having a plurality of electron emission sections arranged in a row, and a plurality of such electron emitting devices and a plurality of image forming members form an X-Y matrix, although this arrangement may be changed according to use of the device.

Figure 8:
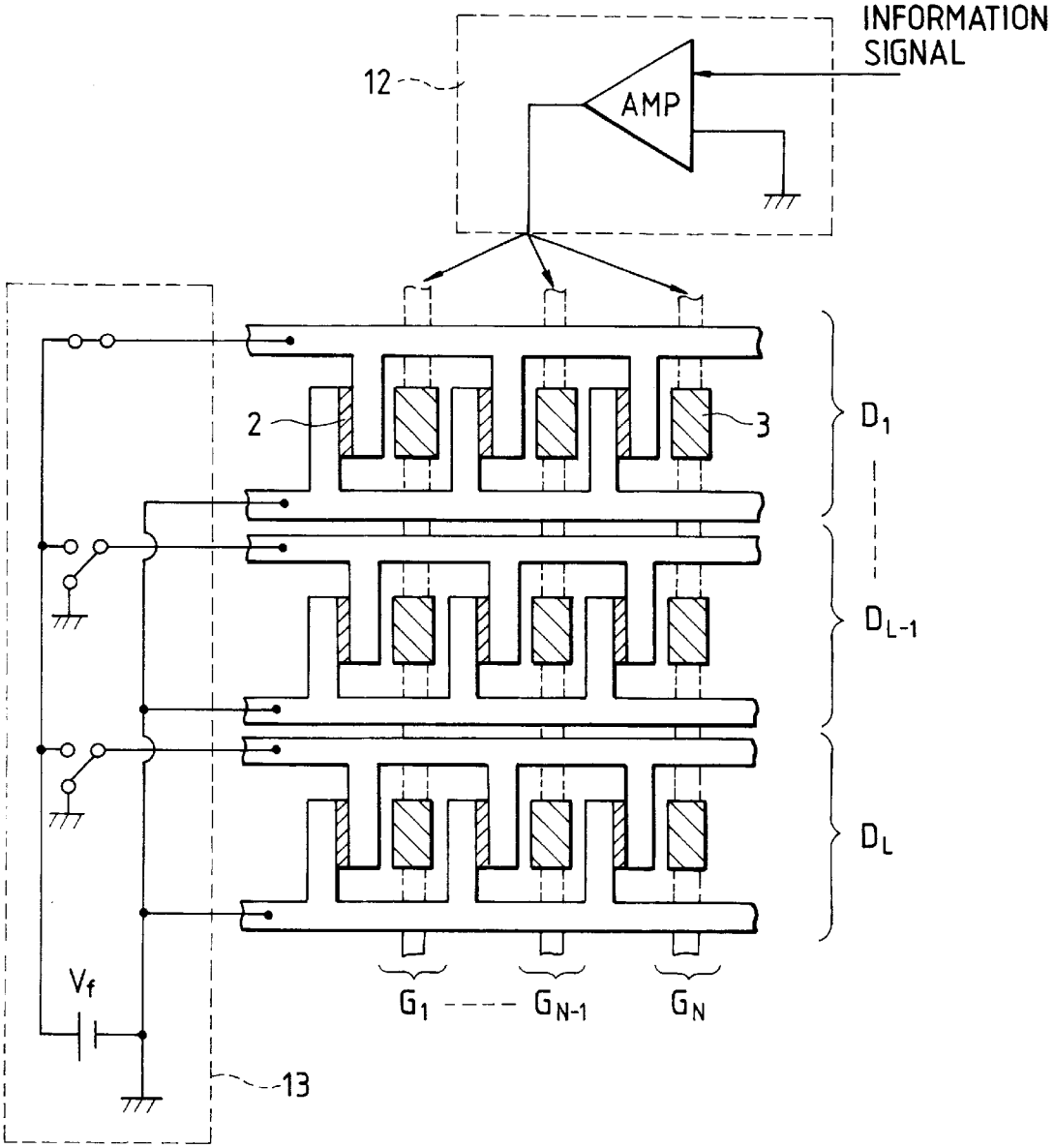
FIGS. 8, 9, 22, 30, and 69 are diagrams of a method of driving the image forming apparatus having X-Y matrix structure of the present invention.

For example, in a preferred form of the image forming apparatus having an X-Y matrix in accordance with the present invention, as shown in FIG. 8, a row of electron emitting devices ($D_1, \ldots, D_{L-1, DL}$) (linear electron emitting devices) and N rows ($G_1, \ldots, G_{N-1}, G_N$) of image forming members 3 (luminescent members) each provided with a modulation means are arranged so as to form an X-Y matrix. The electron emitting devices are successively driven one by one (scanned) by a driving circuit 13, and, in synchronization with this driving, a modulation signal for each image line is simultaneously applied to the modulation means (modulation circuit 12) for the rows of image forming members in accordance with an information signal. The irradiation of each image forming member (luminescent member) 3 with an electron beam is thereby controlled to display an image line by line.

Figure 9:
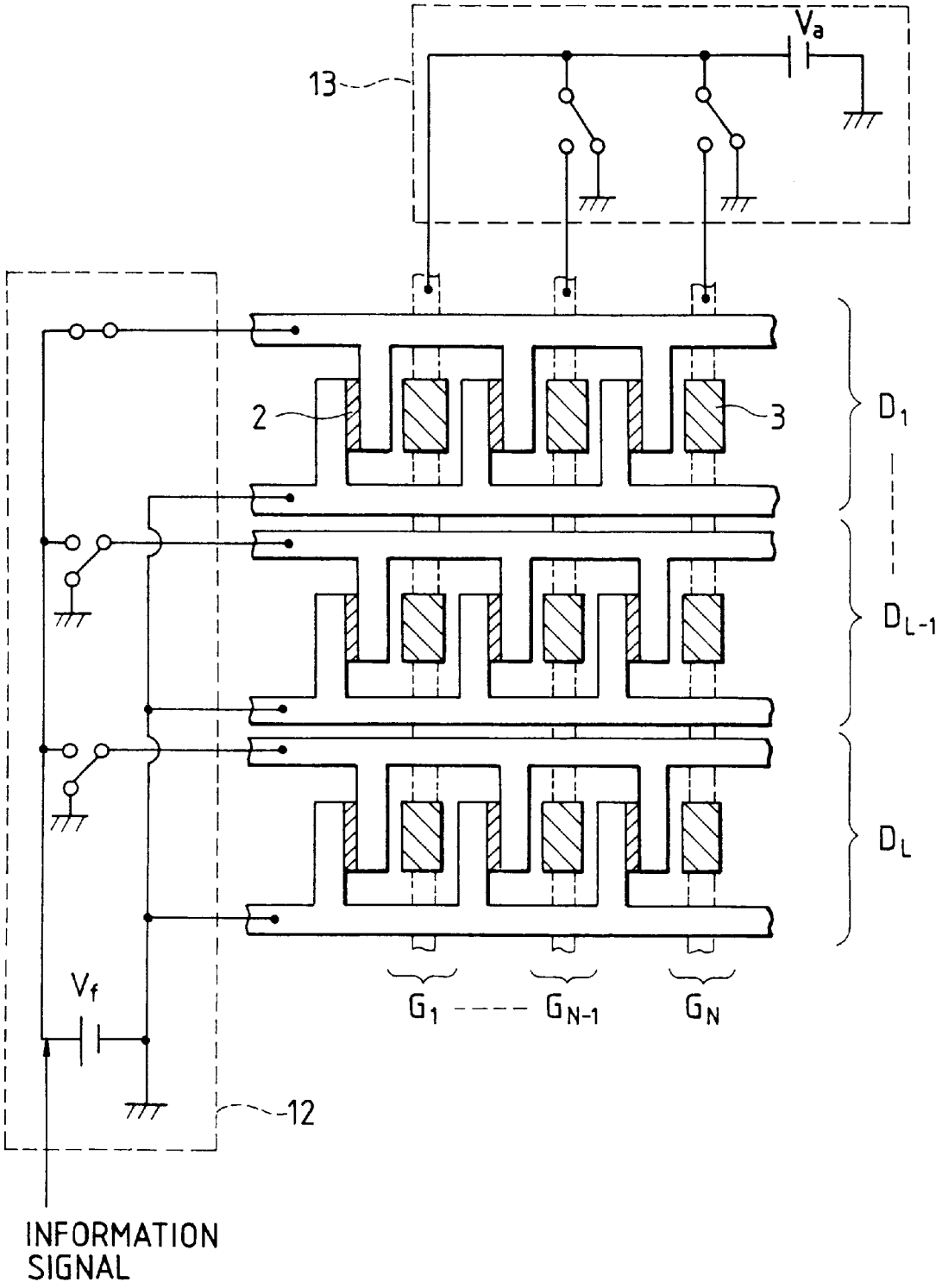

Alternatively, as shown in FIG. 9, a row of electron emitting devices ($D_1, \ldots, D_{L-1}, D_L$) (linear electron emitting devices) having modulation means and N rows ($G_1, \ldots, G_{N-1}, G_N$) of image forming members 3 (luminescent members) also having auxiliary means are arranged so as to form an X-Y matrix. The rows of image forming members are successively driven one by one (scanned) by a driving circuit 13, and, in synchronization with this driving, a modulation signal for each image line in accordance with an information signal is applied to the row of electron emitting devices successively by the modulation means (modulation circuit 12) for the row of electron emitting devices. The irradiation of each image forming member (luminescent member) 3 with an electron beam is thereby controlled to display an image line by line.

The image forming apparatus of the present invention also comprises an optical printer described below.

Figure 10:
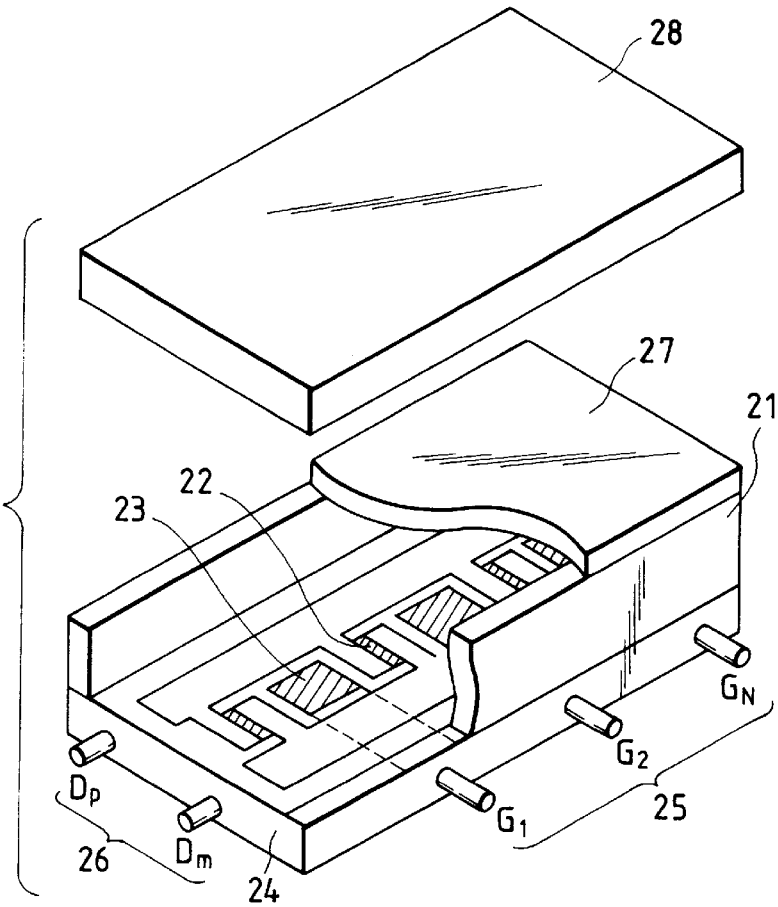
FIGS. 10 to 13, 23, 24, 31, 34, 41 to 43, and 70 are schematic diagrams of the construction of an image forming apparatus (specifically, an optical printer) in accordance with the present invention.

FIG. 10 is a schematic diagram of an optical printer. An outer casing of this printer will first be described. The outer casing is a container, the interior of which is evacuated, and which is formed of an insulating substrate 24, a support frame 21 and a face plate 27. The insulating substrate 24 is a substrate on which electron emitting elements 22 and image forming members 23 are juxtaposed as described above. The support frame 21 serves to support the insulating substrate 24 and the face plate 27 while maintaining a desired spacing therebetween.

The face plate 27 may be a member which ensures that

① a desired vacuum is maintained in the vacuum container, and

② an optical signal generated in the vacuum container is not prevented from traveling to the outside of the vacuum container.

In view of these points, a visible light transmitting glass is ordinarily preferably used.

The arrangement inside the vacuum container is as described below. An array of a plurality of electron emitting elements 22 is provided on the insulating substrate 24 in the container. Needless to say, the electron emitting elements 22 are electrically connected to an exterior circuit provided outside the vacuum container by electron emitting device wiring terminals 26 (Dp, Dm). The image forming members 23 are provided with wirings independent of those for the electron emitting elements 22 and are electrically connected to an exterior circuit outside the vacuum container by image forming member wiring terminals 25 ($G_1, G_2, \ldots, G_N$), as in the case of the electron emitting elements.

In synchronization with driving of the array of electron emitting devices, a modulation signal for each image line is simultaneously applied to the image forming members in accordance with an information signal to control the irradiation of each image forming member with an electron beam to form a light emission pattern for one image line. A recording member is thereby irradiated with light from the luminescent members in accordance with this light emission pattern. A photo-sensing pattern is thereby formed on the recording member surface if the recording member is a photosensitive member, or a thermo-sensing pattern is formed if the recording member is a thermosensitive member. This operation is repeated with respect to all image lines by scanning the recording member or a light emission source 31 with respect to each line as shown in FIGS. 11 and 12, thereby effecting image recording on the recording member surface.

Figure 11:
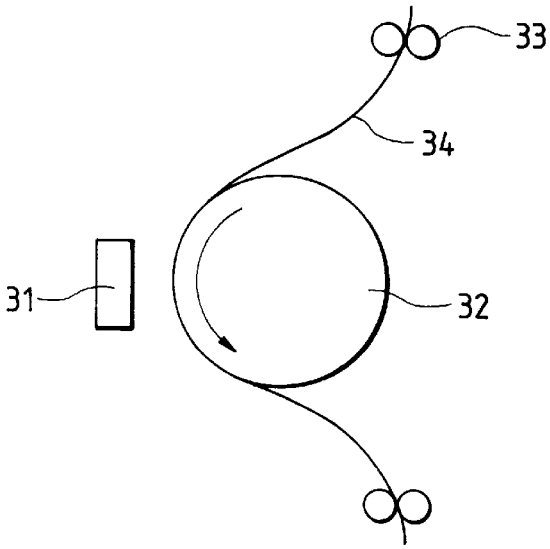
Figure 12:
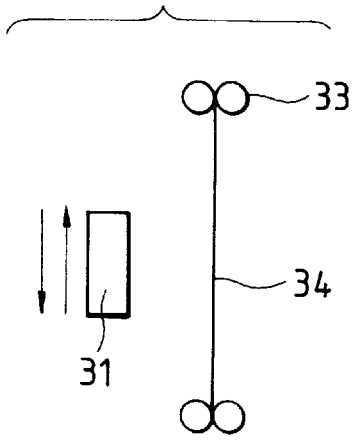

As shown in FIGS. 11 and 12, the recording member may be a photosensitive (thermosensitive) sheet 34 and, in this case, the recording apparatus has support members for supporting this sheet (e.g., a drum 32 and a transport rollers 33). Alternatively, the recording member may be a sensitized drum 44 such as that shown in FIG. 13.

Figure 13:
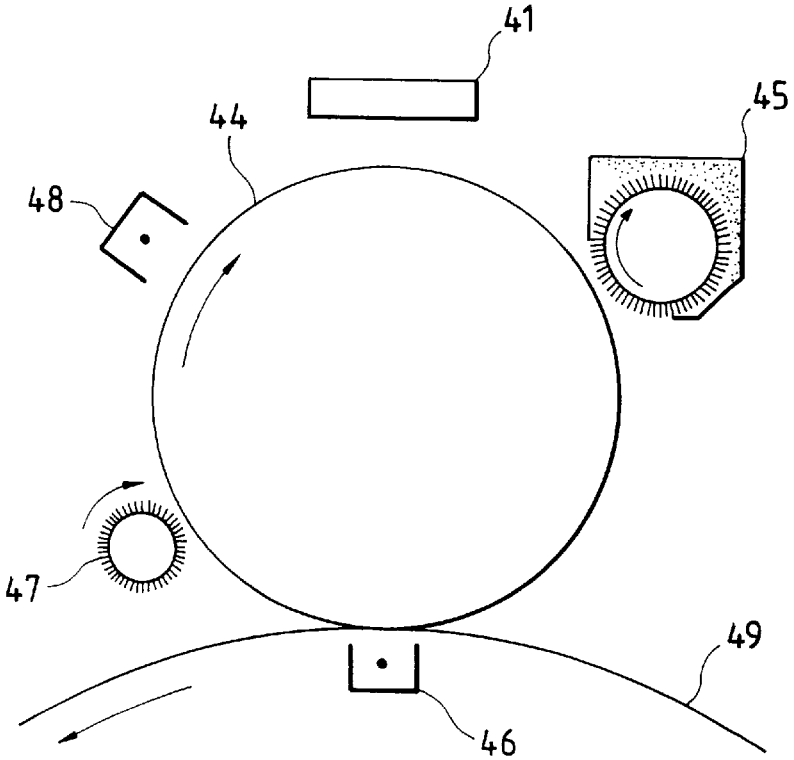

The apparatus shown in FIG. 13 is arranged as described below. A development unit 45, a charge removing device 46, a cleaner 47 and a charging device 48 are arranged around the drum-like recording member 44 along the direction of rotation along with the light emission source 41.

First, an image is provided by an emission from the light emission source 41, and the recording member 44 is irradiated and exposed with this image light. Charge on the exposed portion of the recording member 44 is removed, and the non-exposed portion attracts and collects a toner supplied from the development unit 45. The portion which has attracted and collected the toner is moved to the charge removing device 46 as the recording member 44 is rotated. When the charge thereon is removed by the charge removing device 46, the attracted toner falls. At this time, a paper sheet 49 on which the image is be formed is positioned between the recording member 44 and the charge removing device 46, and the toner falls onto the paper sheet 49. The paper sheet 49 which has received the toner is moved to a fixation unit (not shown) to be fixed on the paper sheet 49, so that the image provided by the light emission source 41 is formed on the paper sheet 49.

On the other hand, the drum-like recording member 44 is further rotated to move to the cleaner 47 where residual toner is scraped off. The recording member is thereafter charged by the charging device 48.

Figure 14:
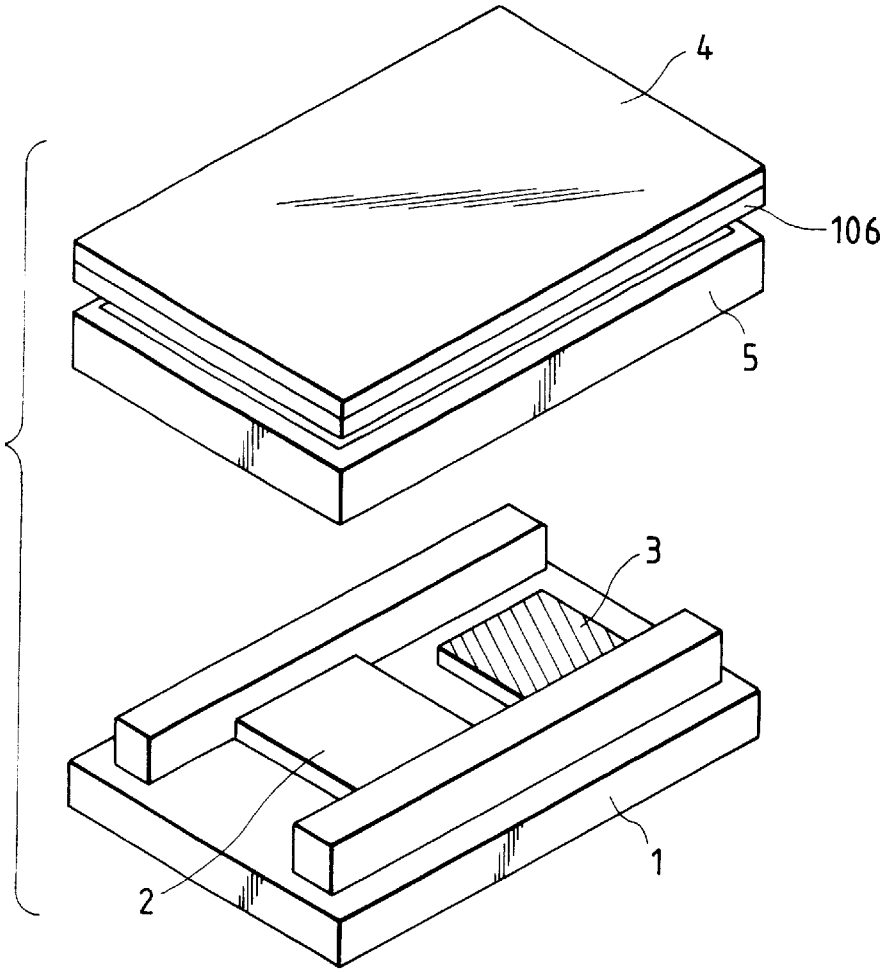

Next, another example of the basic form of the present invention will be described below. This basic form is mainly characterized by further including a potential prescription means. More specifically, as shown in FIG. 14, an electron emitting element and an image forming member are arranged on one surface of a substrate, and a potential prescription means is disposed so as to face this substrate surface. FIG. 14 shows a substrate (rear plate) 1, an electron emitting element 2, an image forming member 3, a face plate 4, a support frame 5 and potential prescription means 106.

Except for the potential prescription means 106, the arrangement may be the same as that described above with reference to FIG. 1.

In the basic form shown in FIG. 14, the potential prescription means for setting the potential on the substrate is used to set the potential in the space located above the substrate (in the electron releasing direction) to a predetermined potential. More specifically, it comprises an electroconductive member (106 in FIG. 14) disposed so as to face the substrate surface on which the electron emitting element and the image forming member are arranged side by side. If the image forming apparatus having this basic form uses a panel container formed of substrate 1, face plate 4 and support frame 5 as shown in FIG. 14, the electroconductive member 106 may be provided as a layer of a material laminated or applied to the inner surface of the face plate 4 facing the interior of the container. The electroconductive member may alternatively be a metallic plate or a member formed of a mixture of an insulating material and a electroconductive material. It is easy and preferable to form the electroconductive member on the inner face plate surface by a vapor deposition technique. Therefore, the material of it is, preferably, an electroconductive material which can be formed by vapor deposition, and Al, Cu or Ni and the like is ordinarily selected. In particular, if it is undesirable that the electroconductive member has a light shutting property, a transparent electrcconductive material, such as ITO (indium tin oxide), is used. Also, the potential prescription means may be disposed on the inner surface or the whole surface of the face plate and may cover each or one of them partially or entirely.

Figure 15:
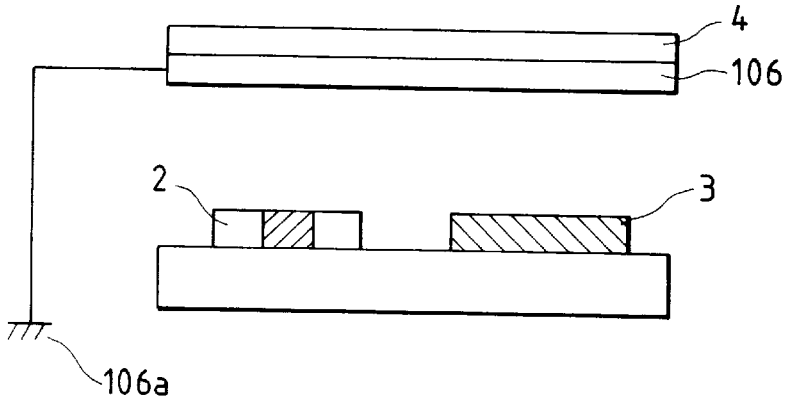
FIGS. 15 and 16 are diagrams of a potential limitation means of the image forming apparatus of the present invention.
Figure 16:
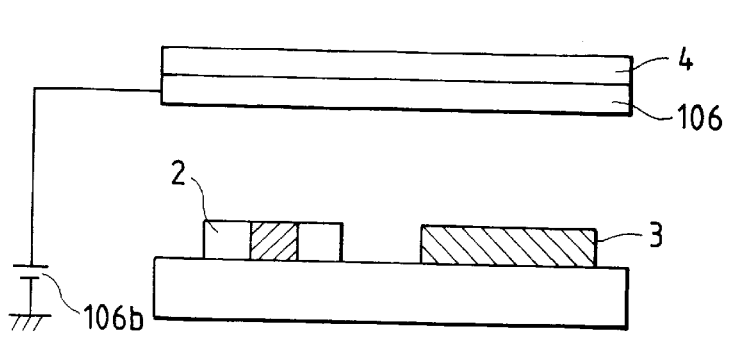

Further, in the potential prescription means in accordance with this basic form, the electroconductive member 106 is preferably grounded (106*a*), as shown in FIG. 15, or is connected to a voltage application means 106*b* for applying a predetermined voltage to the member 106, as shown in FIG. 16, because it is thereby possible to further improve the effect of the present invention.

Figure 17:
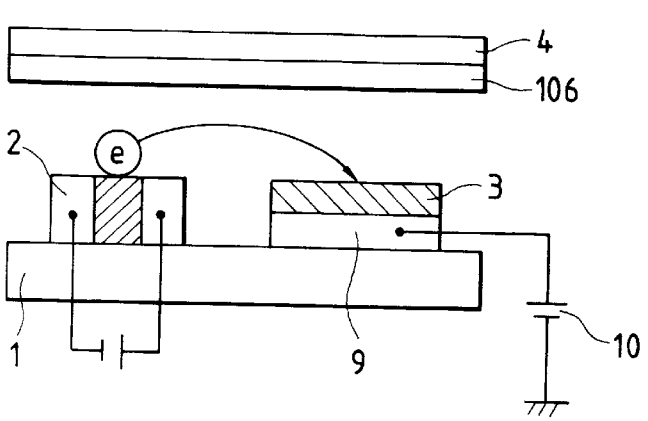

In the case of this basic form as well, it is preferable to provide an auxiliary means for reinforcing the effect of irradiation of the image forming member with an electron beam for the same reason, FIG. 17 shows an example of the auxiliary means in accordance with this basic form. Members 9 and 10 shown in FIG. 17 are an auxiliary electrode and an auxiliary power source, respectively. In the case of this basic form as well, the voltage applied to the image forming member by the auxiliary means is constant and the potential of the image forming member is set to a potential higher than the ground potential (0 V), i.e., a positive potential.

Figure 18:
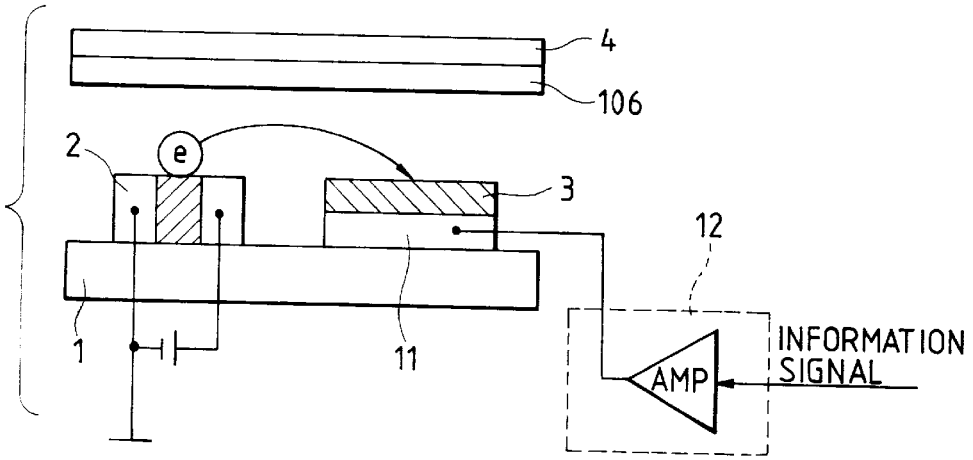

In the image forming apparatus having this basic form, a modulation means is also provided separately as well as the electron emitting element and the image forming member, if an electron beam emitted from the electron emitting element is modulated in accordance with an information signal (the electron emission is changed in an on-off manner). In the image forming apparatus having this basic form, such a modulation means, is provided as described below. That is, (1) the image forming member has a modulation means (FIG. 18), (2) the electron emitting device has a modulation means (FIG. 19), or (3) the potential prescription means includes a modulation means (FIG. 20).

With respect to the cases (1) and (2), the same arrangements as those shown in FIGS. 4 and 5 may be adopted. With respect to the case (3), the modulation means comprises a voltage application means for applying a voltage in accordance with an information signal to the potential prescription means. For example, this voltage application means has, as shown in FIG. 20, a modulation circuit 12 for changing the voltage applied to the above-described potential prescription means (electroconductive member 106).

For example, modulation of an electron beam in accordance with an information signal using such a modulation means is performed based on controlling an electric field in the vicinity of the electron emission section with the voltage applied to the electroconductive member 106. More specifically, to realize an off state, a negative voltage is applied to the electroconductive member (modulation electrode) 106 so that a region in the vicinity of the emission section is closed with an electric field thereby formed, thereby forming an electric field barrier in the vicinity of the electron emission section through which electrons cannot penetrate. To realize an on state, a positive voltage is applied to the electroconductive member (modulation electrode 106) to facilitate reaching of emitted electrons to the acceleration field formed by the image forming member. Needless to say, any voltage, inclusive of 0 V, may be selected according to circumstances as the voltage applied to the electroconductive member (modulation electrode) 106 for this purpose.

Figure 19:
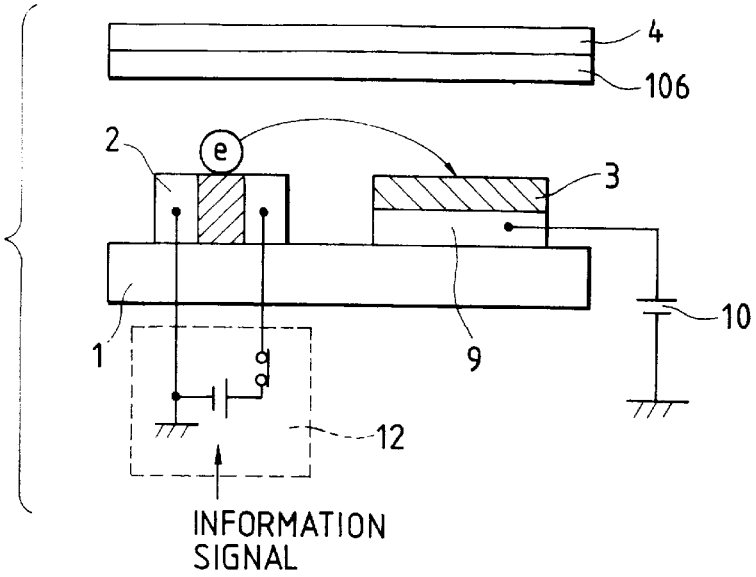
Figure 20:
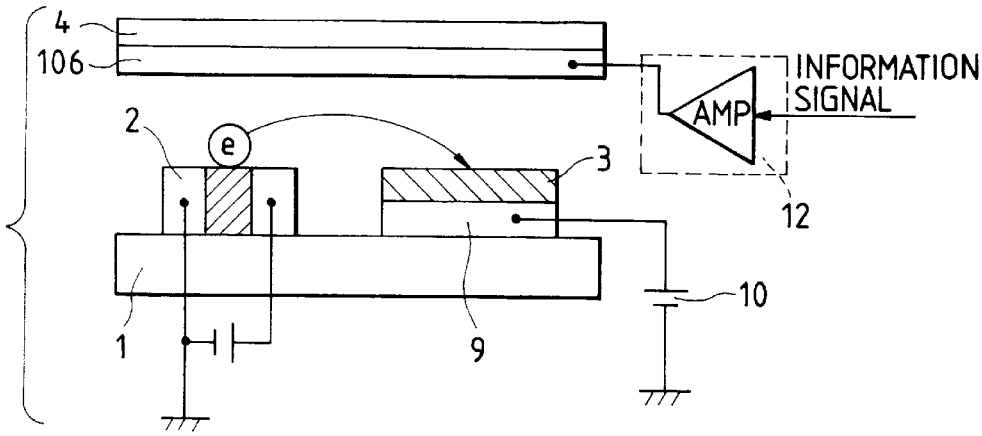

The components 9 and 10 of the image forming apparatuses (2) and (3) having modulation means as shown in FIGS. 19 and 20 correspond to the above-described auxiliary means. It is preferable to provide this auxiliary means in the image forming apparatus having this basic form if the modulation efficiency is considered.

In a case where the image forming apparatus of the present invention has the above-described modulation means, and particularly in the case (3), the modulation efficiency is further increased because of the existence of the modulation means in the vicinity of the electron emission section, so that the anode voltage can be increased. It is therefore possible to further improve the contrast of the image formed on the image forming member (or the luminance thereof if the image forming member is formed of a luminescent material or the like). Therefore the arrangement (3) is particularly preferred.

The image forming apparatus having this basic form specifically has a construction in which an electron emitting element and an image forming member are juxtaposed on one substrate surface, and all the above-described problems ① to ④ of the conventional image forming apparatuses can thereby be solved. The reason why the image forming apparatus of the present invention has an effect of solving the problem ① (the problem of damage to the electron emitting element) in particular among the above-described problems is the same as that described above. However, since the image forming apparatus having this basic form further has a potential prescription means for setting the potential on the substrate as described above, the extent of the above-described damage to the electron emitting element due to positive ions can be further reduced and the electron beam modulation efficiency and the efficiency at which the image forming member is irradiated with an electron beam can be further improved.

Figure 21:
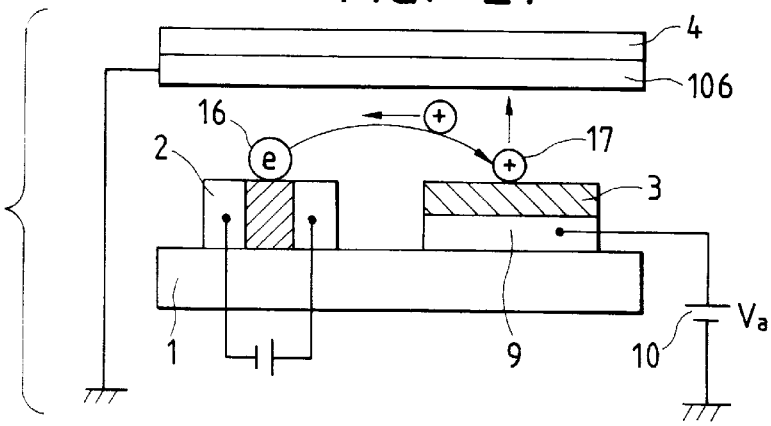

That is, in the image forming apparatus apparatus having this basic form, generated ions (positive ions) 17 shown in FIG. 21 are captured by the potential prescription means. Therefore the extent of damage to the electron emitting element can be further reduced. In a case where the apparatus is constructed so that the electron emitting element and the image forming member are juxtaposed on one substrate surface, some of emitted electrons collide against the inner surface of the casing, specifically the face plate 4 inner surface to charge up the this surface, even when the image forming member is irradiated with an electron beam. Also, in a case where the means in accordance with the arrangement (1) is used as the electron beam modulation means, the electron beam is emitted to the face plate 4 inner surface when the electron beam path to the image forming member is shut off, so that the face plate 4 inner surface is charged up. By such face plate 4 surface charging, a negative potential surface is arbitrarily formed in the space above the substrate (in the electron emitting direction). Such a negative potential surface may cause a reduction in the efficiency at which the image forming member is irradiated with the electron beam or the electron beam modulation efficiency. In the image forming apparatus having this basic form, such arbitrary formation of a potential surface can be prevented by the potential prescription means, so that the electron beam irradiation o efficiency and the modulation efficiency can be further improved. Since charging of the inner surface of the face plate 4 can be prevented, the distance between the substrate and the face plate can be reduced. It is therefore possible to further reduce the overall thickness of the panel body of the image forming apparatus as well as to reduce the interval of the disposition of the electron emitting element and the image forming member.

In the image forming apparatus having this basic form as well, a plurality of electron emission sections of electron emitting devices and a plurality of image forming members are arranged into an X-Y matrix in the same manner as the arrangements described above in detail with reference to FIGS. 8 and 9, although this arrangement may be changed according to use of the device.

Figure 22:
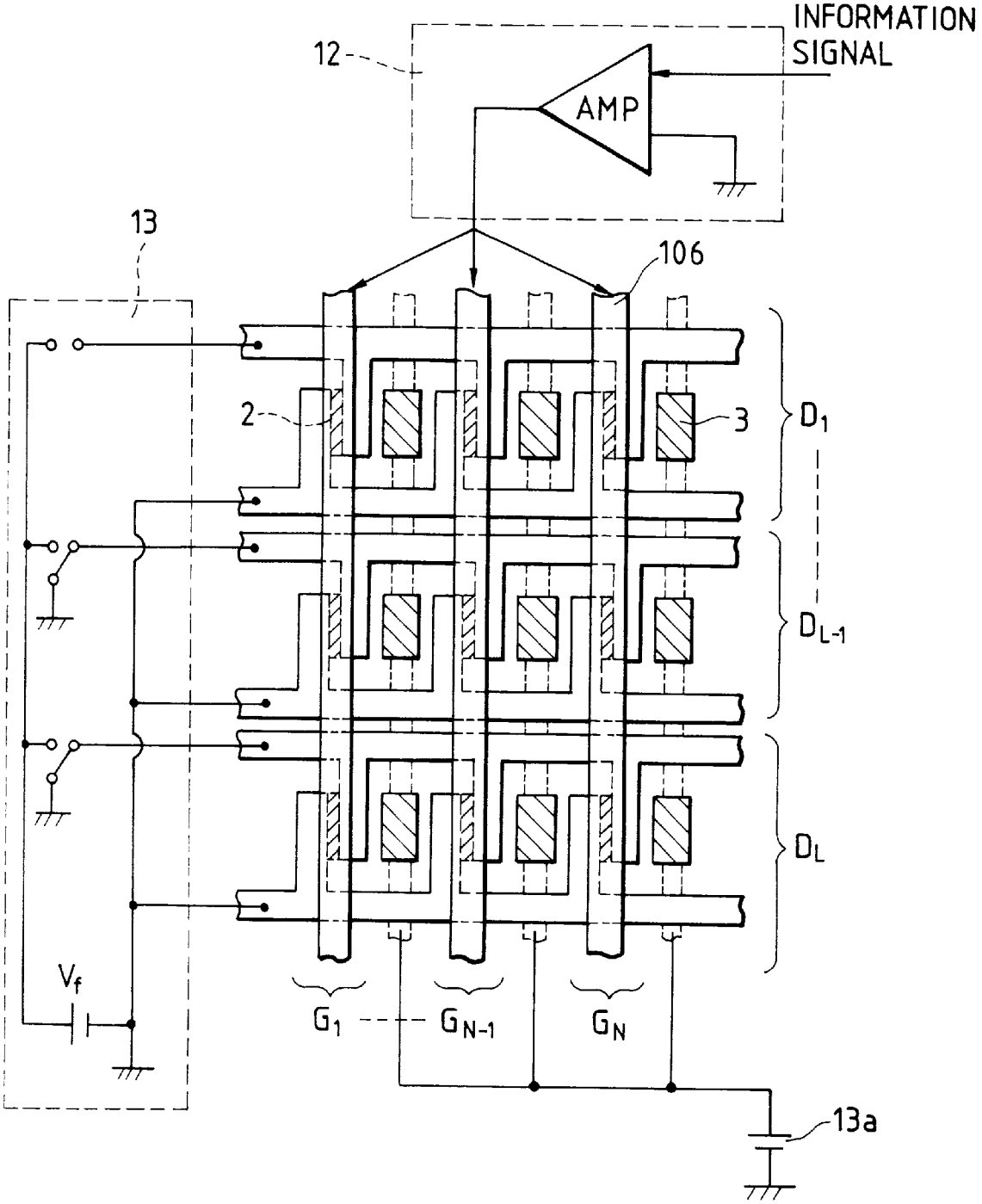

In accordance with this basic form, the arrangement may be such that as shown in FIG. 22 a plurality of electron emission sections 2 and a plurality of image forming members (luminescent members) 3 having the above-described auxiliary means are arranged into a matrix form, and a row of electron emitting devices ($D_1, \ldots, D_{L-1}, D_L$) (linear electron emitting devices) and N units of potential prescription means ($G_1, \ldots, G_{N-1}, G_N$) arranged in the space above the electron emission sections 2 of the rows of electron emitting devices form an X-Y matrix. A constant voltage 13*a* is applied to the auxiliary means, the electron emitting devices are successively driven one by one (scanned) by a driving circuit 13, and, in synchronization with this driving, a modulation signal for each image line is simultaneously applied to the modulation means (modulation circuit 12) for the potential prescription means in accordance with an information signal. The irradiation of each image forming member (luminescent member) 3 with an electron beam is thereby controlled to display an image line by line.

Figure 24:
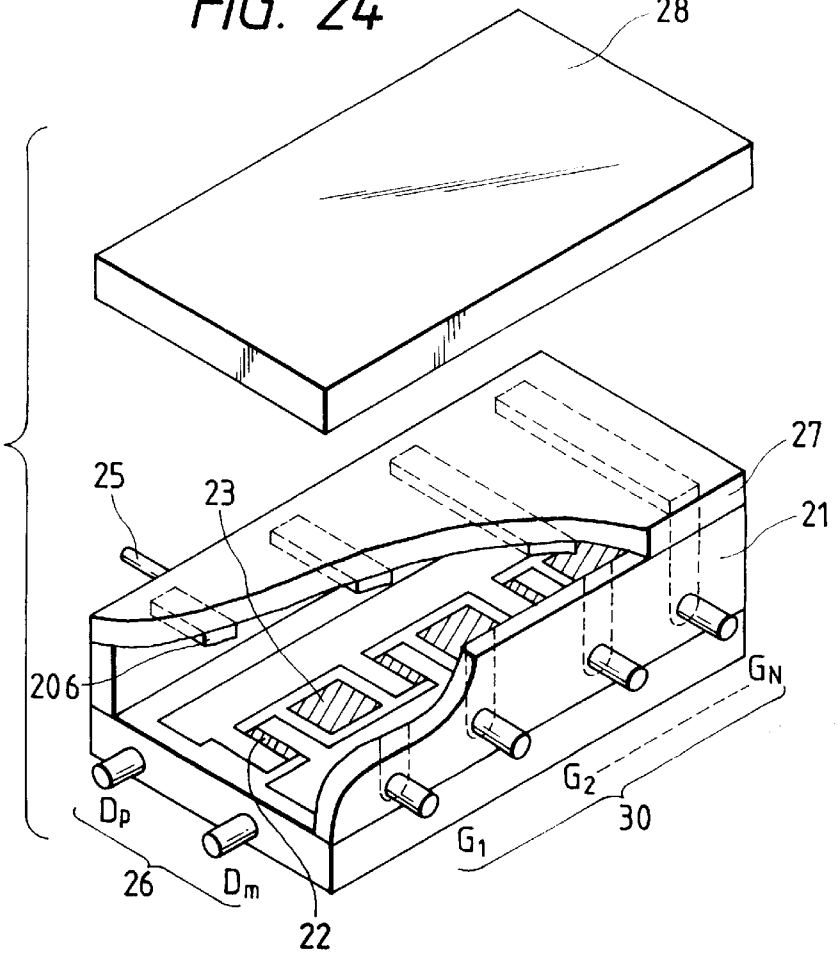
Figure 23:
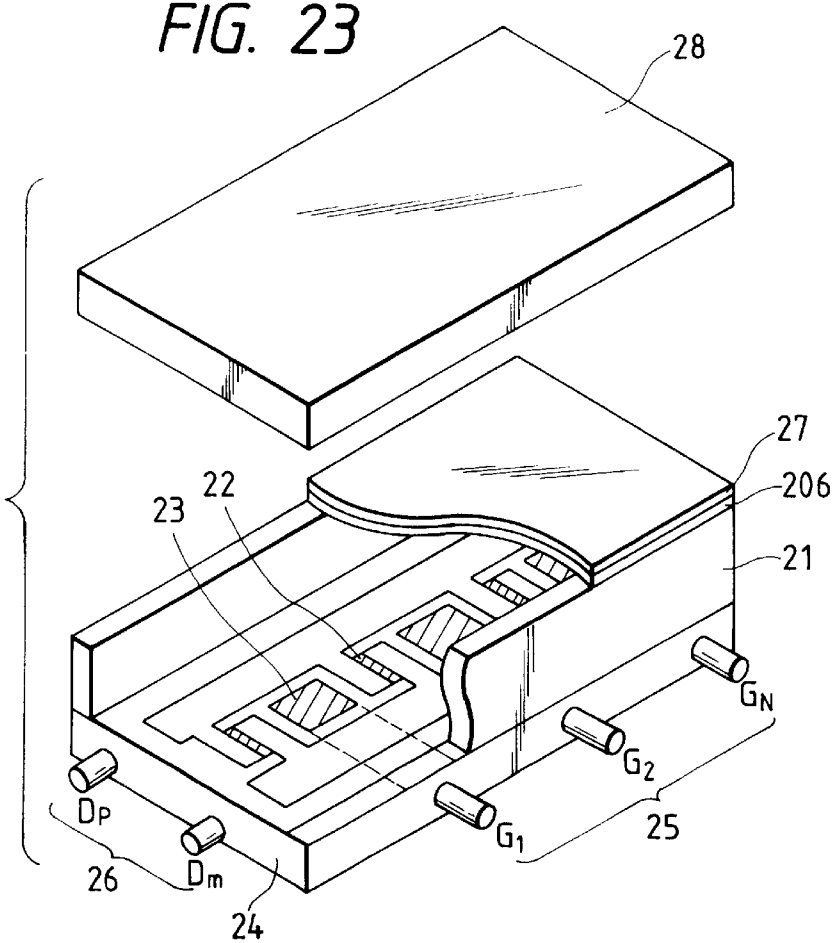

The image forming apparatus having this basic form also comprises an optical printer similar to the one described above. FIGS. 23 and 24 are schematic diagrams of arrangements of optical printers having this basic form. The arrangement shown in FIG. 23 is the same as the one shown in FIG. 10 except that a potential prescription means 206 comprising a transparent member formed of ITO is provided on an inner surface of a face plate 27, and can be applied in the same manner to the apparatuses, details of which are illustrated in FIGS. 11, 12, and 13.

In the arrangement shown in FIG. 24, a row of a plurality of electron emitting elements 22 is disposed on an insulating substrate 24 in a container. Needless to say, the electron emitting elements 22 are electrically connected to an exterior circuit provided outside the vacuum container by electron emitting device wiring terminals 26 (Dp, Dm). The image forming members 23 are provided with wirings independent of those for the electron emitting elements 22 and are electrically connected to an exterior circuit outside the vacuum container by an image forming member wiring terminal 25, as in the case of the electron emitting elements. A plurality of members of potential prescription means 206 formed of ITO are provided on an inner surface of a face plate 27 perpendicularly to the row of the electron emitting devices and are electrically connected to an exterior circuit outside the vacuum container by wiring terminals 30 ($G_1, G_2, \ldots, G_N$).

First, a constant voltage is applied to the image forming members through the wiring terminal 25. Then, in synchronization with driving of the array of electron emitting devices, a modulation signal for each image line is simultaneously applied to the potential prescription means in accordance with an information signal to control the irradiation of each image forming member (luminescent member) with an electron beam to form a light emission pattern for one image line. A recording member 28 is thereby irradiated with light from the luminescent members in accordance with this light emission pattern. A photo-sensing pattern is thereby formed on the recording member 28 surface if the recording member 28 is a photosensitive member, or a thermo-sensing pattern is formed if the recording member 28 is a thermosensitive member. This operation is repeated with respect to all image lines by scanning the recording member or the above-mentioned light emission source 31 with respect to each line as shown in FIGS. 11 and 12, thereby effecting image recording on the recording member surface.

The arrangement shown in FIG. 24 can also be applied in the same manner to the apparatus described above in detail with reference to FIG. 13.

The above-described image forming apparatuses of the present invention are advantageous mainly in that (1) the extent of damage to the electron emitting element caused by ions generated in the apparatus is very small, (2) there is no need to strictly position the electron emitting elements and image forming members and it is easy to arrange these components, and (3) there is no possibility of a change in the distance between the electron emitting element and the image forming member. Consequently, it is possible to form an image having a long life, improved in contrast and free from color unevenness and luminance unevenness. Further, the image forming apparatus of the present invention can easily be manufactured and can be designed so as to greatly reduce the overall thickness. Other components may be added to the above-described image forming apparatus as described below in detail to further improve the effects (1) to (3) of the present invention or to have other advantages as well as those of the effects (1) to (3).

Figure 35:
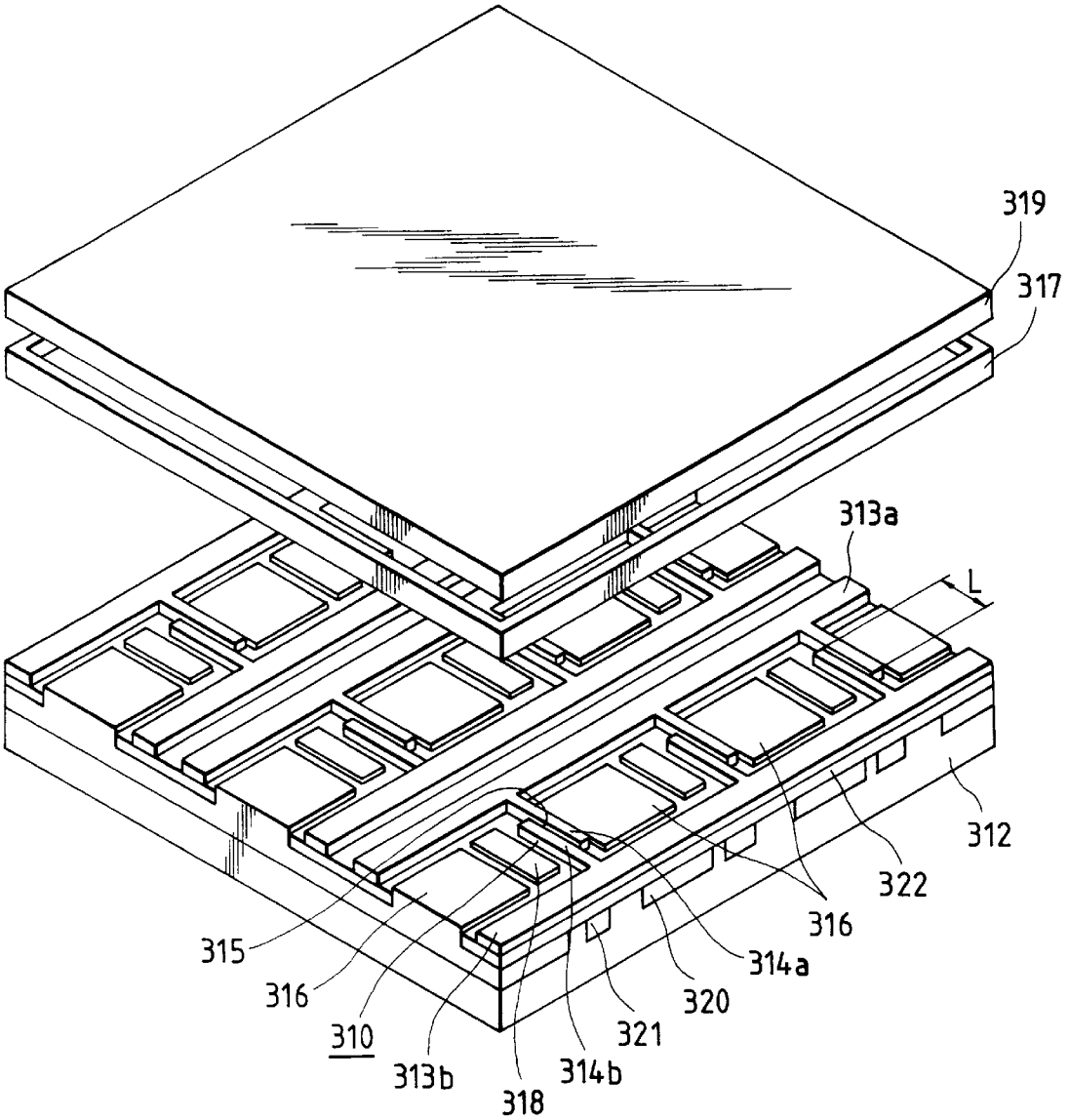

An image forming apparatus in accordance with the present invention, such as that shown in FIG. 35, has shielding electrodes 318 provided between adjacent image forming members 316 to reduce the mutual influence thereof mainly to enable formation of an image free from crosstalk.

Each shielding electrode may be formed of any material so long as it is electrically conductive, and a material consisting of an insulating material and an electroconductive material dispersed in the insulting material may be used as well as metallic materials. The size of the shielding electrode is not specifically limited but the width thereof is preferably 10 to 300 $\mu$m, more preferably 50 to 100 $\mu$m. The thickness of this electrode may be selected as desired but it is ordinarily preferred that the shielding electrode is thicker than the image forming member. It is very practical to set the length (in a direction perpendicular to the width) to a value equal to the longer one of the lengths of the electron emission section and the image forming member, because a sufficiently large shielded zone into which the electric field cannot easily penetrate is thereby achieved.

The voltage applied to each shielding electrode may be selected as desired in relation to the voltage applied to the electron emitting elements and the image forming members, the distance between the electron emitting elements and the shielding electrodes and the distance between the shielding electrodes and the adjacent image forming members. Ordinarily, it may be a negative voltage of, preferably, about −10 to −50 V, which is, of course, not exclusive.

It is preferable to set both the distances between the shielding electrodes, the electron emitting elements and the shielding electrodes to 10 to 200 $\mu$m. Needless to say, the distances therebetween are not limited to these values and may be selected in relation to other members.

The effect of the provision of such a shielding plate in the image forming apparatus of the present invention is as described below. An electric field distribution occurs around the shielding electrode by the influence of the voltage applied thereto, and emitted electrons are thereby shielded from the influence of the electric field from the image forming member adjacent to the image forming member to be excited by the electrons. That is, a pixel formed of a pair of shielding electrodes, an electron emitting element and an image forming member is completely isolated from the influence of the potential of the image forming member of an adjacent pixel. Therefore there is no possibility of emitted electrons being attracted by the potential of the image forming member of the adjacent pixel positioned opposite to the image forming member of the pixel to which the electrons are to be made to reach, or flying over the image forming member of this pixel to the image forming member of another adjacent pixel. The image formation can be effected without causing crosstalk. Also, the voltage applied to the image forming members can therefore be increased without any difficulty to enable image display at a higher luminance. Further, the pitch at which elements are arranged can be reduced. The pixel arrangement pitch is thereby reduced, that is, the resolution of the image can be improved.

Figure 44:
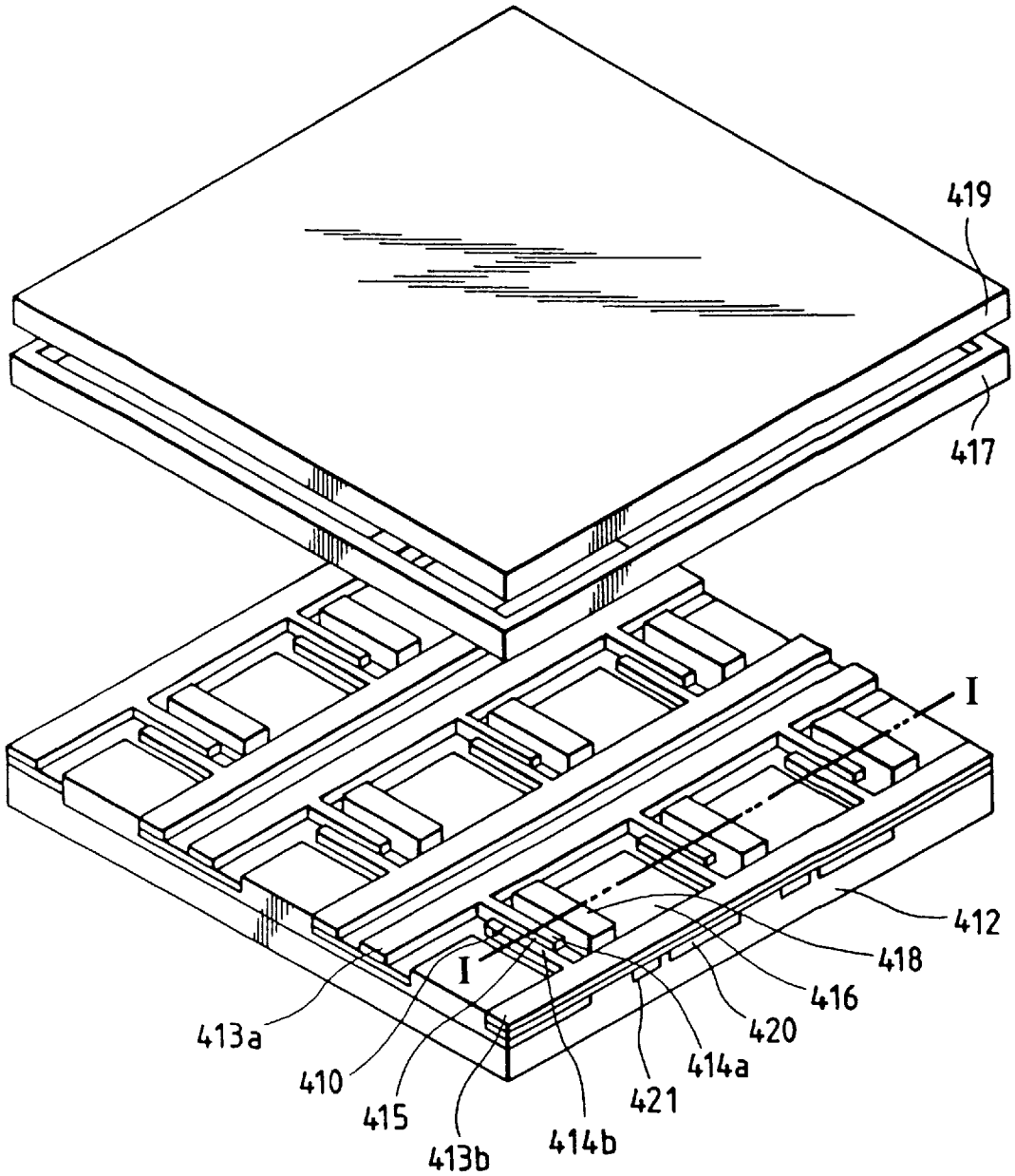
Figure 45:
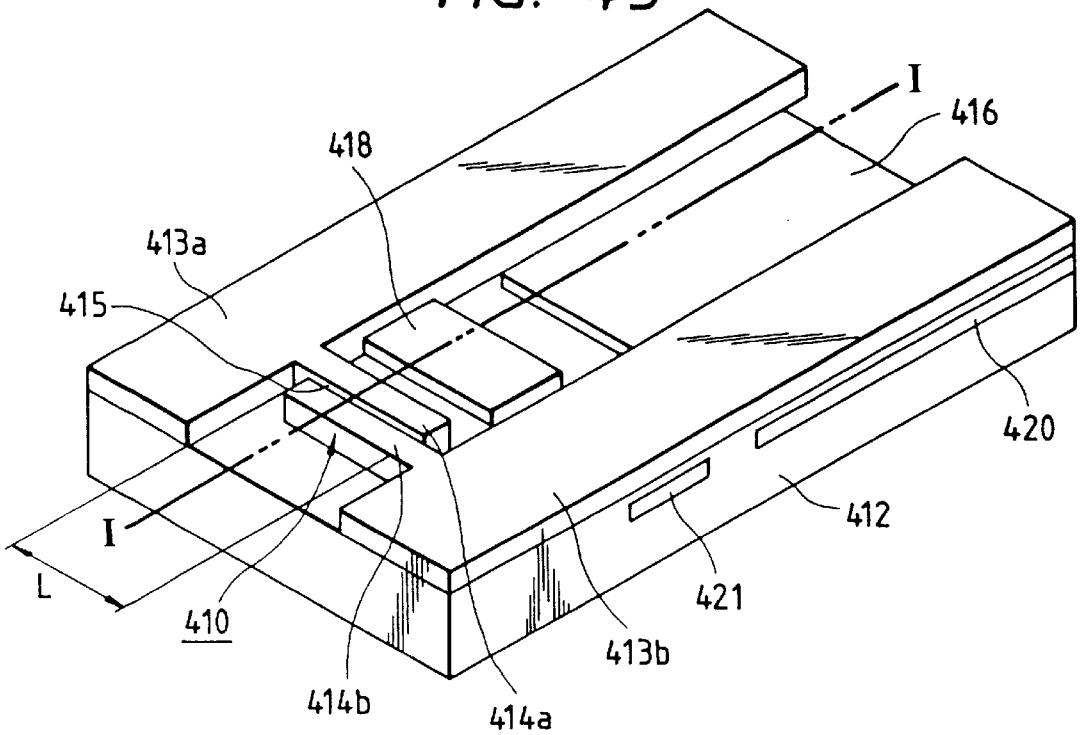
Figure 50:
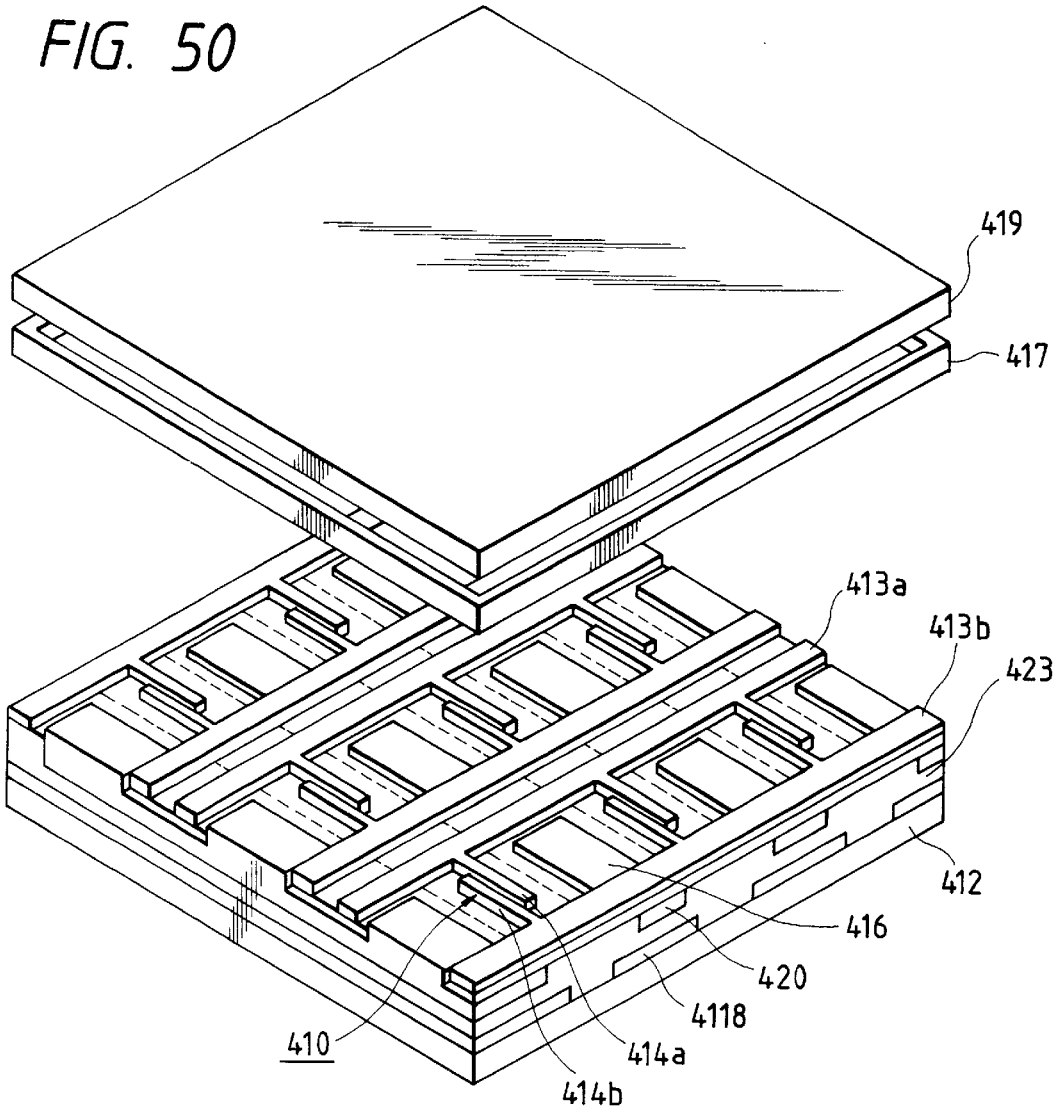
Figure 51:
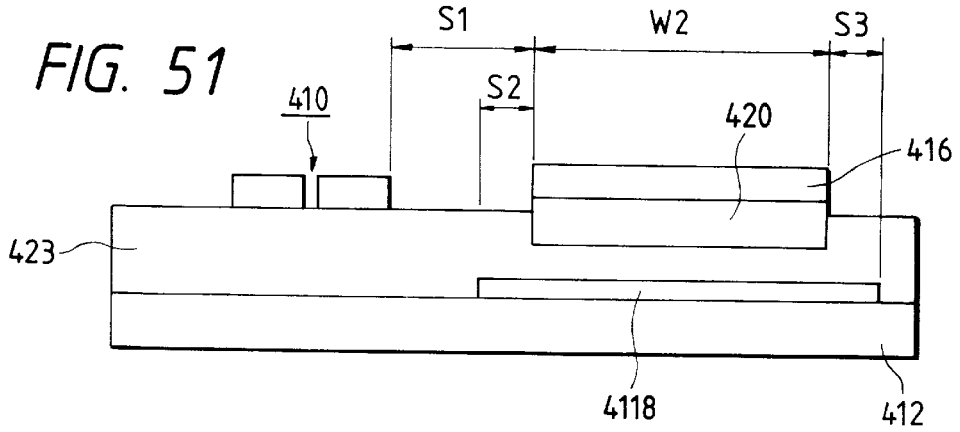

The image forming apparatus of the present invention can also be improved mainly in electron beam convergence/uniformity by using an arrangement, such as that shown in FIG. 44, or FIGS. 50 and 51, which has correction electrodes 418 (4118) for controlling the direction of flying of electron beams emitted from electron emitting elements 410. Each correction electrode 418 (4118) is disposed between an image forming member 416 and an electron emitting element 410, as shown in FIGS. 44 and 45, or it (electrode 4118 in FIGS. 50 and 51) is disposed below an image forming member 416 with an insulating layer 423 interposed therebetween, as shown in FIGS. 50 and 51.

In the image forming apparatus having such a correction electrode, an electron beam is not directly accelerated by the image forming member but is suffers the convergence effect by the correction electrode adjacent to the image forming member before it is accelerated, or the locus of electrons reaching the image forming member, specifically the locus of electrons reaching opposite end portions of the image forming member (the end closest to the electron emitting element and the end furthest from this element) is bent more inwardly. The convergence of the electron beam and the uniformity of the irradiation of the image forming member with the electron beam are thereby improved. Consequently, there is no possibility of an electron beam being locally concentrated, for example, in the vicinity of the above-mentioned closest end so that the excitation of the luminescence material of the image forming member is saturated. It is thereby possible to increase the voltage applied to the image forming member without any difficulty to improve the luminance.

Further, the potential above the electron emitting element is set to a suitable level to strengthen these effects.

Figure 56:
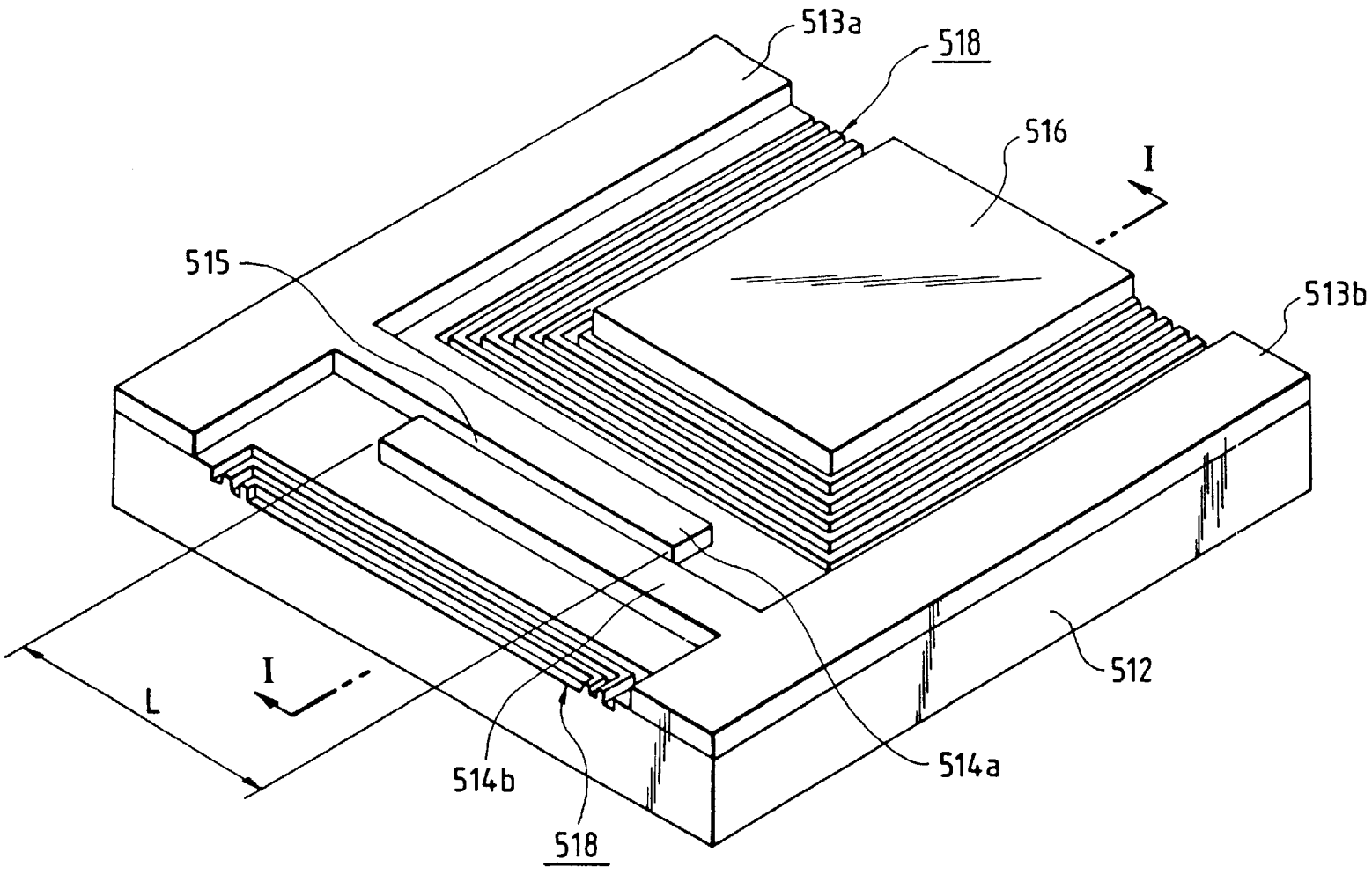
Figure 58:
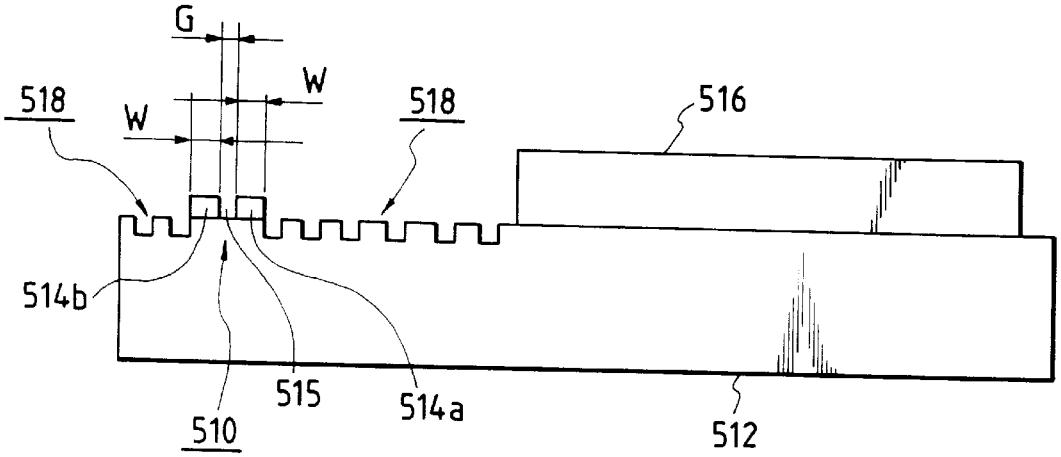

The image forming apparatus of the present invention may be arranged in such a manner that as shown in FIGS. 56 and 58 the creeping distance from an image forming member 516 to an electron emitting element 510 located on a substrate surface closest to this image forming member 516, or to another image forming member 516 is at least twice as long as the distance in a straight line therebetween. The creeping withstand voltage between the image forming member and the electron emitting element or between adjacent image forming members is thereby increased. It is thereby possible to apply a higher voltage to the image forming member without any difficulty to effect image formation at a higher luminance. Local sparking between the image forming member and other elements or members on the substrate surface is thereby prevented and the image formation can be effected with improved stability.

Since the creep withstand voltage per unit distance in a straight line between the image forming members and other elements or members is increased, it is possible to arrange the image forming members and other elements or members by reducing the distance therebetween and to reduce the pixel arrangement pitch.

The distance in a straight line between the image forming members and other elements or members may be measured with an ordinary optical microscope or the like and a cross-sectional configuration of the substrate may be monitored with a contact type thickness meter, thereby confirming whether the creeping distance between the image forming members and other elements or members on the substrate surface is at least twice as large as the distance in a straight line therebetween. If the surface along which the creeping distance is measured is curved, a string or the like is placed on the measurement line and is then extended to measure its length, thereby measuring the creeping distance.

An extension of the creeping distance can be achieved by, for example, forming a multiplicity of grooves in the substrate surface around each image forming member so that a toothed profile is formed in a longitudinal cross section of the substrate. Such grooves may be formed by any of well-known methods. However, a longer creeping distance is preferred. The toothed profile is not necessarily formed regularly. If projections or recesses thereof are cyclically arranged, the pitch thereof is preferably ⅕ of the above-mentioned straight-line distance or smaller.

The image forming apparatus of the present invention is preferably constructed in such a manner that, for example, in the apparatus shown in FIG. 1, the surface of the image forming member is lower than the electron emitting surface of the electron emitting element at least in the vicinity of the electron emitting element.

Such a disposition of the electron emitting element and the image forming member is enabled by, for example, providing a difference in level in the substrate surface between the electron emitting element and the image forming member. For example, such a difference in level can be provided by working the substrate formed of an insulating material into the corresponding shape, or by additionally forming an insulating layer on the substrate surface. Preferably, in this case, the difference in level provides an effect of insulation between the electron emitting element and the image forming member, while the surface of the image forming member is made lower than the electron emission surface. To enable this effect, the difference in level is set to a value greater than the thickness of the image forming member. The distance therebetween is preferably 2 to 10 $\mu$m.

Since in this construction the surface of the image forming member is lower than the electron emission surface of the electron emitting element at least in the vicinity of the electron emitting element, the density of an electron beam emitted to the image forming member in the vicinity of one side thereof closer to the electron emitting element is not extremely high in comparison with the density of an electron beam emitted to other portions, even if the voltage applied to the image forming member is increased, thus enabling high-luminance uniform image formation.

In the image forming apparatus of the present invention, particularly in the case of an image forming apparatus using image forming members as luminescent members and capable of displaying a full-color luminescent image, the luminescent members may be disposed in such a manner that, for example, ① one type of luminescent member is disposed for one electron emitting element or ② a plurality of types of luminescent members (e.g., having colors R, G, and B) are disposed for one electron emitting element.

Figure 66:
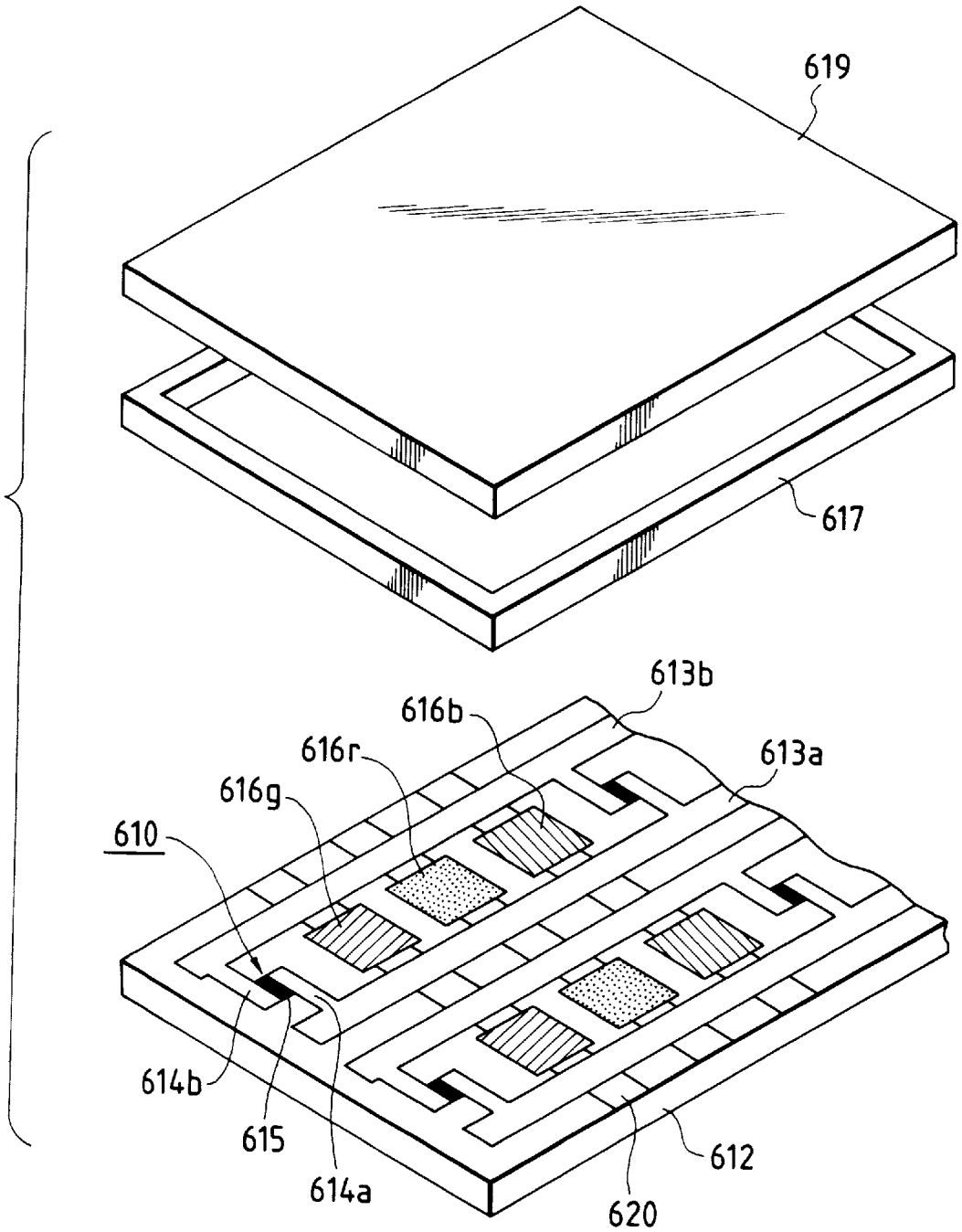

In the image forming apparatus of the present invention, however, the arrangement ② is particularly preferred. That is, as shown in FIG. 66, electron beams emitted from one electron emitting element are emitted to a group of a plurality of luminescent members 616*g*, 616*r*, and 616*b*. There is therefore no need to form electron emitting elements between the luminescent members, and the pixel density can be further increased. In the case of a color display, the arrangement ② is particularly advantageous since pixels are formed of luminescent members having three primary colors R, G, and B, and since an increase in pixel density is therefore required.

In the case of the arrangement ②, a luminescent member, among a group of luminescent members, more remote from the electron emitting element provided for this group cannot sufficiently be irradiated with emitted electrons, because the electrons are captured by other electrodes or an insulating layer. In such a case, it is advantageous to arrange the apparatus so that a higher voltage is applied to a luminescent member if the distance between the electron emitting element and the luminescent member is greater. In a case where one group of luminescent members is constituted of three-primary-color luminescent members, it is advantageous to set a suitable voltage applied to each member according to the emission efficiency thereof, because the emission efficiency may vary with respect to colors.

Generally, among luminescent materials having three primary colors, the green luminescent material has a lower emission efficiency while the blue luminescent material has a higher emission efficiency. It is therefore preferable to dispose the green luminescent member in a position closest to the electron emitting element and the blue luminescent member in a remotest position. Particularly preferably, the arrangement is such that the green luminescent member is made to emit light at a comparatively low applied voltage while the blue luminescent member is made to emit light at a comparatively high applied voltage, thereby compensating for the difference between the emission efficiencies of the luminescent members by the difference between the applied voltages so that the luminances are balanced. That is, to form a color image in particular, the difference between the emission efficiencies of the luminescent members is utilized by applying different voltages to the luminescent members. Color balancing (setting a suitable R-G-B emission ratio for obtaining reference white) can easily be effected in this manner.

Herein, the voltage applied to each of green, red and blue luminescent materials depends on distance between the electron emitting device and the luminescent material and the kind of luminescent material. It is however preferable to set up a condition of the materials so as to satisfy the condition of $V_G<V_R<V_B$, wherein $V_G$: voltage applied to the green luminescent material, $V_R$: voltage applied to the red luminescent material, $V_B$: voltage applied to the blue luminescent material.

It is more preferably to set up the condition so as to satisfy the above inequality within the range of 10 to 500 V of $V_G$, 100 to 1 kV of $V_R$, and 300 to 2 kV of $V_B$; particularly preferably within the range of 100 to 300 V of $V_G$, 300 to 500 V of $V_R$, and 500 to 1500 V of $V_B$.

Embodiment 1

Figure 25:
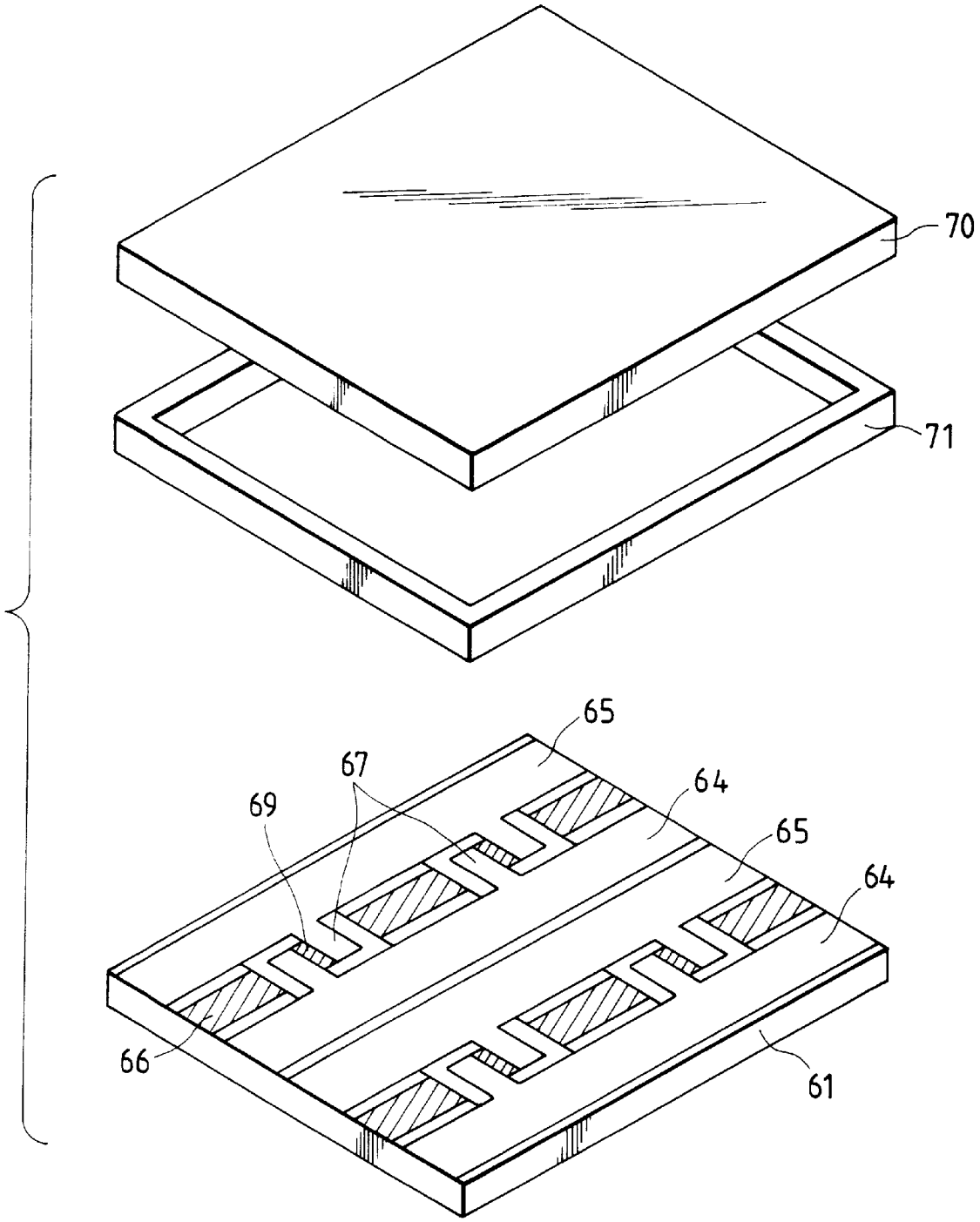

FIG. 25 shows an image forming apparatus in accordance with a first embodiment of the present invention. This image forming apparatus has an insulating substrate 61, device wiring electrodes 64 and 65, device electrodes 67, electron emitting section 69, image forming members 66, a support frame 71, and a face plate 70. In this embodiment, each image forming member is formed of a luminescent material.

Figure 26:
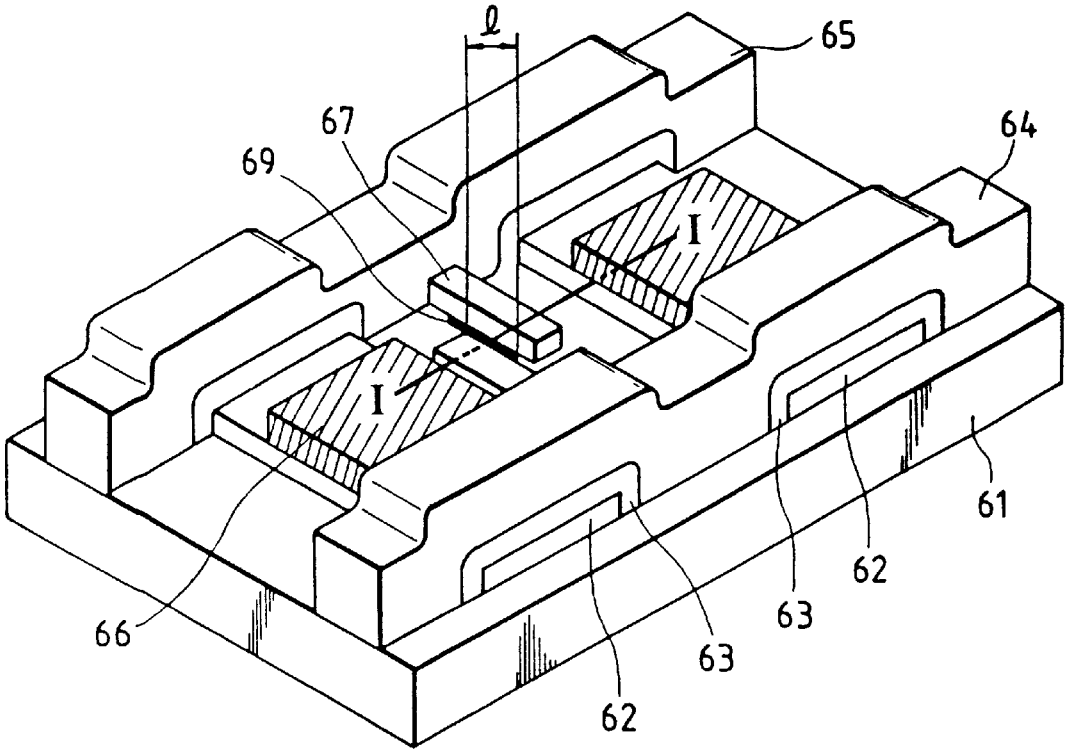
Figure 27:
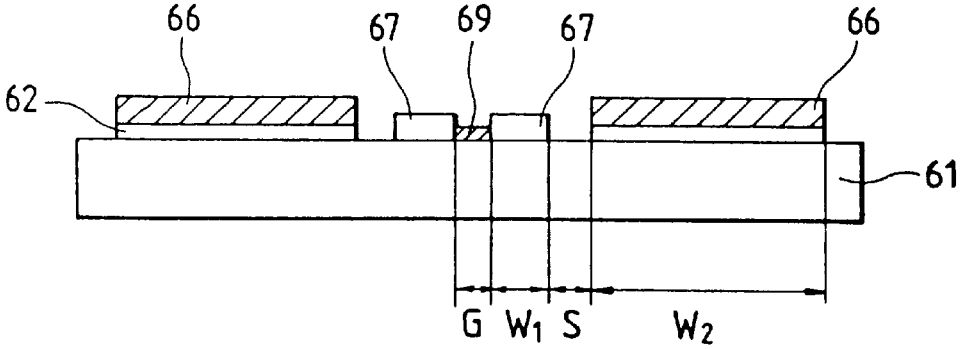

FIG. 26 is an enlarged perspective view of a portion of the image forming apparatus in the vicinity of one electron emitting device, and FIG. 27 is a cross-sectional view taken along the line A–A' of FIG. 26. Components 62 and 63 shown therein are image forming member wiring electrodes and insulating layers, respectively.

A method of manufacturing the image forming apparatus in accordance with this embodiment will be described below.

① First, insulating substrate 61 was sufficiently washed, and device electrodes 67 and image forming member wiring electrodes 62 were formed thereon of a material having Ni as a main constituent by a vapor deposition technique and a photolithography technique ordinarily used. The image forming member wiring electrodes 62 may be formed of any material so long as its resulting electrical resistance is adequately small.

② Next, insulating layers 63 were formed of $SiO_2$ by a vapor deposition technique. The thickness of these layers was set to 3 $\mu$m in this embodiment.

As the material of insulating layers 63, a material is preferably selected from $SiO_2$, glass, and other ceramic materials.

③ Then, device wiring electrodes 64 and 65 were formed from a material having Ni as a main constituent by a vapor deposition technique and an etching technique. Device electrodes 67 were formed to be connected to device wiring electrodes 64 and 65 and to have opposed portions between which electron emitting sections 69 were interposed. The electrode gap (G) therebetween, which is preferably 0.1 to 10 $\mu$m, was set to 2 $\mu$m in this embodiment. The length (l) corresponding to each electron emitting section 69 was set to 300 $\mu$m. It is preferable to reduce the width ($W_1$) of the device electrode 67. In practice, however, this width is preferably 1 to 100 $\mu$m, more preferably 1 to 10 $\mu$m. Each electron emitting section 69 was formed at or in the vicinity of the center of adjacent image forming member wiring electrodes 62. Device wiring electrodes 64 and 65 were formed with a 2 mm pitch, and electron emitting sections 69 were formed with a 2 mm pitch.

④ Ultrafine particle films were formed between the opposed electrodes by a gas deposition method to provide electron emitting sections 69. Pd was used as the material of the ultrafine particles. The particle material may be selected from any other materials. Among possible materials, metallic materials, such as Ag and Au, and oxide materials, such as $SnO_2$ and $In_2O_3$, are preferred. In this embodiment, the diameter of Pd particles was set to about 100 Å, but this is not exclusive. Ultrafine particle films can also be formed between the electrodes by methods other than the gas deposition method, e.g., a method of applying an organic metal and thereafter heat-treating this metal, which also ensures the desired device characteristics.

⑤ Image forming members 66 made of a luminescent material were formed by a printing method to have a thickness of about 10 $\mu$m. Image forming members 66 made of a luminescent material may be formed by a different method, e.g., a slurry method or precipitation method.

⑥ Support frame 71 having a thickness of 5 mm was placed between face plate 70 and the insulating substrate 61 of the image forming apparatus formed by the above-described process, and a frit glass was applied between face plate 70 and support frame 71 and between insulating substrate 61 and support frame 71 and was fired at 430° C. for a period of time of 10 minutes or longer to bond these components.

⑦ The interior of the glass container thus completed was evacuated with a vacuum pump. After a sufficient degree of vacuum had been reached, a treatment for causing an irreversible deformation in the ultrafine particle films (forming treatment) was effected, and the glass container was finally sealed. The degree of vacuum sufficient for enabling this image forming apparatus to operate with improved stability was $10^{-6}$ to $10^{-7}$ torr.

Next, a driving method in accordance with this embodiment will be described below. Referring to FIGS. 25 to 27, a pulse voltage of 14 V is applied between one of the pairs of device wiring electrodes 64 and 65 to emit electrons from a plurality of electron emitting elements arranged in a row. Beams of emitted electrons are changed in an on-off control manner by applying a negative (not higher than 0 V) or positive (10 to 1,000 V) voltage to the image forming members on the positive device wiring electrode side in accordance with an information signal. This voltage is determined according to the kind of luminescent material used and the necessary luminance and is not specifically limited to the above values. Emitted electrons are accelerated to collide against the image forming members. One-line display on the image forming members is effected in accordance with the information signal.

A pulse voltage of 14 V is then applied to the adjacent pair of device wiring electrodes 64 and 65 to effect the above-described one-line display. This operation is repeated to form a one-frame image. That is, the groups of device wiring electrodes are used as scanning electrodes, and these scanning electrodes and the image forming members form an X-Y matrix to display the image.

The surface conduction type electron emitting device in accordance with this embodiment is capable of being driven in response to a voltage pulse of 100 picoseconds or shorter, and therefore enables formation of 10,000 or more scanning lines in 1/30 second.

As described above, the image forming apparatus in accordance with this embodiment was obtained in this manner, which was capable of efficiently converging electron beams to image forming members by a voltage applied thereto, preventing damage to the electron emitting elements caused by ion bomdardment, and preventing occurrence of luminance unevenness, had a long life, and made it possible to display an image greatly improved in uniformity and free from luminance unevenness.

Also, a large-screen high-definition display was obtained at a low cost because the electron emitting devices and the image forming members could be aligned easily and because they were formed by the thin film manufacture techniques. Further, the distance between the electron emitting sections 69 and the image forming members 66 could be determined with high accuracy.

If the device electrodes are formed together with the image forming members by a printing method, the device alignment can be effected more easily. In the case of a surface conduction type electron emitting device, electrons having an initial velocity of several volts are emitted into a vacuum. It was confirmed that the present invention was remarkably effective with respect to a modulation of such a device.

Embodiment 2

Figure 28:
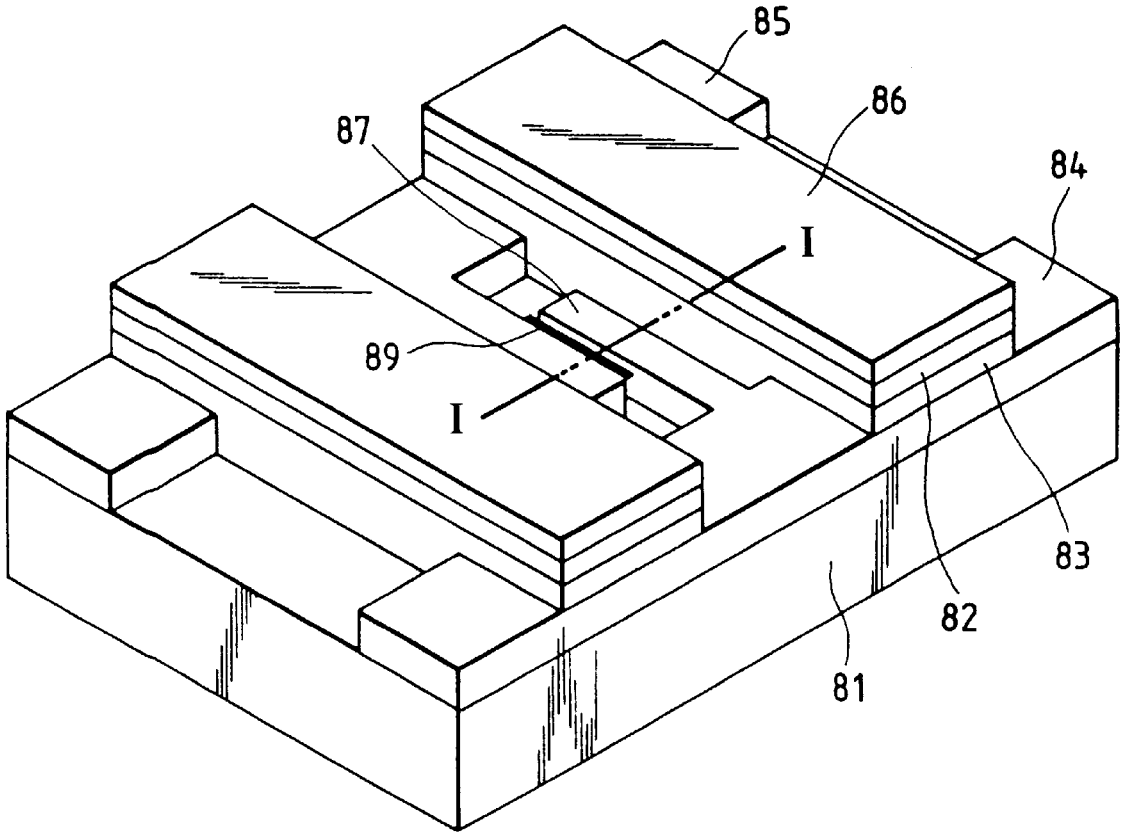
Figure 29:
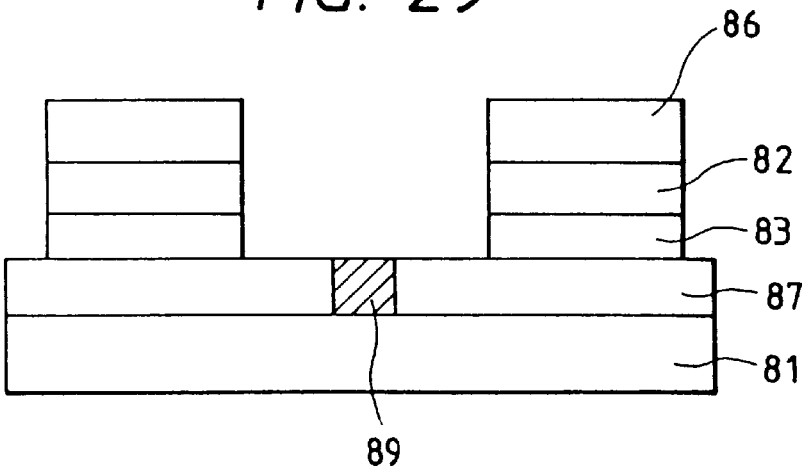

FIGS. 28 and 29 show a second embodiment of the present invention. FIG. 28 is an enlarged perspective view of a portion of the image forming apparatus in the vicinity of an electron emitting device, FIG. 29 is a cross-sectional view taken along the line A–A' of FIG. 28. The general construction of the apparatus is the same as that shown in FIG. 25 and the description for it will not be repeated.

The manufacture process in accordance with this embodiment is generally the same as that of Embodiment 1. In this embodiment, however, device electrodes 87 and device wiring electrodes 84 and 85 were formed of an Ni material at a time by a vapor deposition technique, a photolithography technique and an etching technique to have a thickness of 3,000 Å, after insulating substrate 81 had been washed.

Insulating layers 83 in the form of strips were then formed of $SiO_2$ by vapor deposition so as to extend perpendicularly to the row of the electron emitting devices and to have a thickness of 3 $\mu$m, and image forming member wiring electrodes 82 were formed thereon by vapor deposition of a Ni material to have a thickness of 1 $\mu$m.

Further, a luminescent material was applied thereon to have a thickness of about 10 $\mu$m, thereby forming strip-like image forming members 83. The same fine particle dispersion process as Embodiment 1 was used.

This embodiment achieves the same effect as Embodiment 1 and is advantageous in that image forming members 86 formed of a luminescent material are not formed as separate patterns with respect to the electron emitting devices but are continuously formed as strips of film, and device electrodes 87 and device wiring electrodes 84 and 85 are formed together by vapor deposition, so that the manufacture process can be simplified.

Also, since the image forming members 86 formed of a luminescent material are formed as strips of film and have a large area, the luminance of the resulting image is further increased in comparison with Embodiment 1.

Embodiment 3

Figure 30:
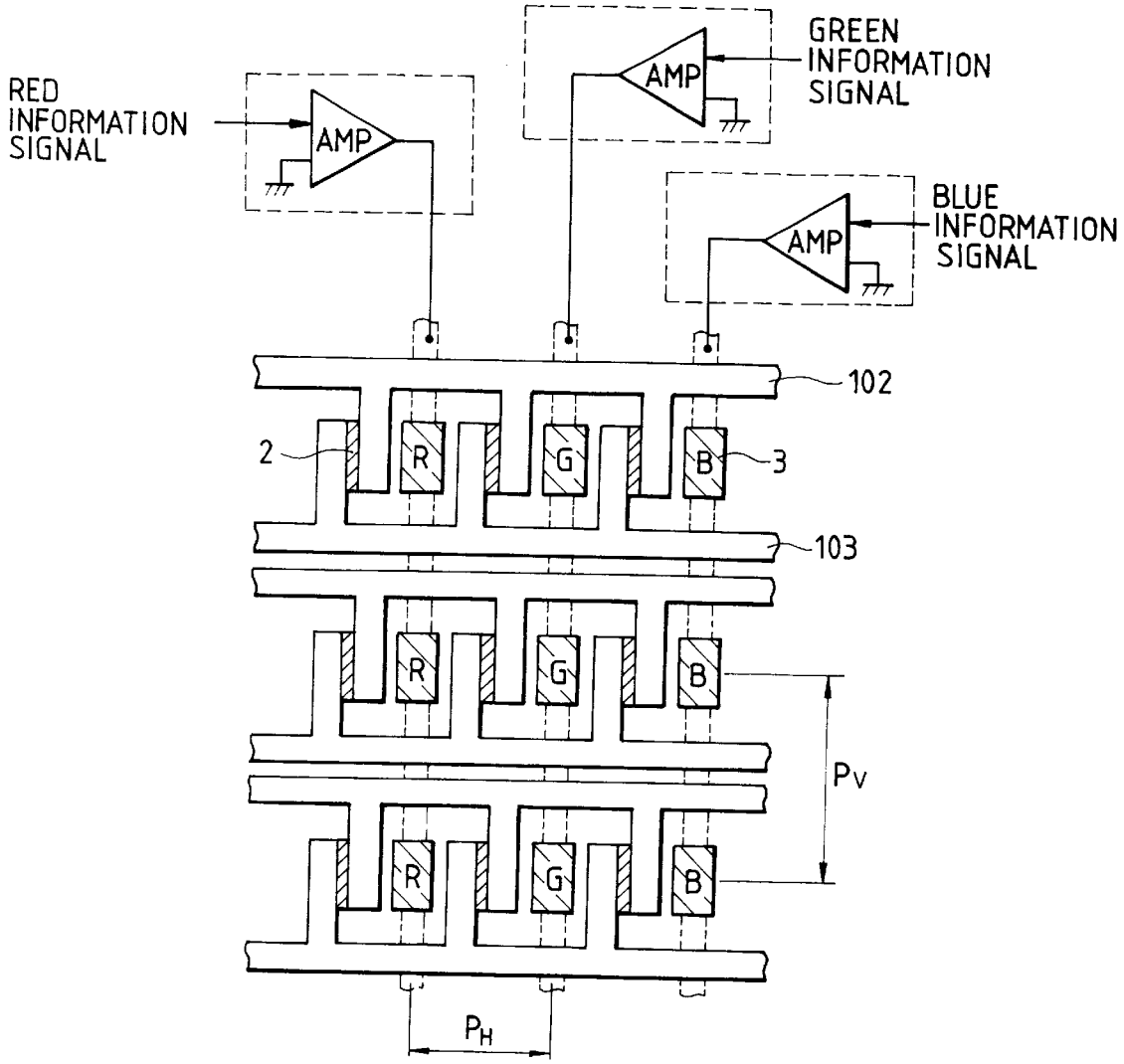

FIG. 30 shows a third embodiment of the present invention. In this embodiment, the method of forming electron emitting elements 2 and electrodes for wiring of these elements is the same as Embodiment 1. Therefore the description for it will not be repeated.

In this embodiment, luminescent members having three colors, red, green and blue were repeatedly arranged as image forming members 3 to enable a full-color display. Each luminescent member was formed by a printing method to have a thickness of about 10 $\mu$m. A horizontal direction color arrangement pitch ($p_H$ in FIG. 30) was set to 230 $\mu$m, a vertical direction pitch ($P_V$) was set to 720 $\mu$m, and the size of each luminescent member was 150×450 $\mu$m (H×V). The pixel pitches were 690×720 $\mu$m (H×V), since three color R, G, B elements (one trio) constitute one pixel for full-color display, as is well known.

A driving method in accordance with this embodiment will be described below briefly. A voltage pulse of 14 V is applied to a pair of electron emitting device wirings 102 and 103 to emit electrons from a plurality of electron emitting elements 2 arranged in a row, and the emission of electrons is changed in an on-off control manner with a voltage applied to the image forming members 3, as in the case of Embodiment 1. In this embodiment, however, the signal (modulation signal) for controlling the operation of turning on/off the emission of electron beams must be separated into R, G and B components which are independently applied to the R, G, B luminescent members 3, since each pixel is formed of one R-G-B trio. Wirings for the luminescent members having three colors are therefore provided independently, as shown in FIG. 30.

That is, one pixel is constituted of three luminescent members, while the groups of electron emitting device wiring electrodes (102, 103) are used as scanning electrodes and these scanning electrodes and the image forming members form an X-Y matrix, as in the case of Embodiment 1.

Based on this arrangement of this embodiment, an image forming apparatus was obtained in which the reduction in the luminance due to a reduction in the luminescent area caused by element misalignment or a phenomenon in which electrons emitted from an electron emitting element do not hit the whole surface of the predetermined luminescent member was limited in comparison with the conventional image forming apparatus in which the electron emitting elements and the image forming members are opposed with a spacing. The image forming apparatus of this embodiment is greatly improved in the effect of limiting the reduction in color purity due to miscoloring (e.g., hitting a green image forming member with electrons which are to be emitted to a red image forming member) when the electron emitting elements and the image forming members are misaligned to a large extent.

Thus, by the arrangement of this embodiment, an image improved in contrast with respect to three primary colors and free from any considerable luminance unevenness or fluctuation was obtained with stability and improved reproducibility.

Embodiment 4

The same image forming apparatus as Embodiment 1 except that only one row of electron emitting elements is arranged as shown in FIG. 10 was manufactured.

An optical printer such as that shown in FIG. 11 was manufactured by using this image forming apparatus was as a light emission source. A component 31 shown in FIG. 11 is a light emission source, a component 34 is a recording member, a component 32 is a member for supporting the recording member 34, and a component 33 is a transport roller for transporting the recording member 34. The light emission source 31 is disposed in a position such as to face the recording member 34 at a distance of 1 mm or smaller from the same.

The recording member 34 was manufactured by uniformly applying a sensitive compound having a composition shown below to a polyethylene terephthalate film to have a thickness of 2 $\mu$m. This sensitive compound was prepared by dissolving, in 70 parts by weight of methyl ethyl ketone used as a solvent, a mixture of (a) 10 parts by weight of a binder: polyethylene methacrylate (commercial name: DIANAL BR, made by Mitsubishi Rayon), (b) 10 parts by weight of a monomer: trimethylol propane triacrylate (commercial name: TMPTA, made by Shin Nakamura Kagaku) and (c) 2.2 parts by weight of a polymerization initiator: 2-methyl-2-morpholino (4-thiomethyl phonyl) propane-1-xy (commercial name: IRGACURE 907, made by CIBA-GEIGY). A silicate luminescent material $(Ba, Mg, Zn)_3Si_2O_7:Pb^{2+}$ was used as a luminescent material constituting the image forming members.

In this embodiment, a modulation signal for one image line in accordance with an information signal is simultaneously applied to the luminescent members in synchronization with the driving of the row of electron emitting elements to control the irradiation of luminescent members with electron beams so as to form an emission pattern for one image line. Light beams are emitted from the luminescent members to the recording member in accordance with this emission pattern, and the recording member irradiated with these light beams is photopolymerized and set. Then, the transport rollers 33 are operated and the image forming apparatus is driven again in the same manner. By repeating this driving, a photopolymerized pattern in accordance with the information signal is formed on the recording member. This photopolymerized pattern is developed by methyl ethyl ketone to form an optical recording pattern on the polyethylene terephthalate film.

By the optical printer in accordance with this embodiment, a uniform, high-contrast and clear optical recording pattern was formed at a high speed.

Embodiment 5

Figure 31:
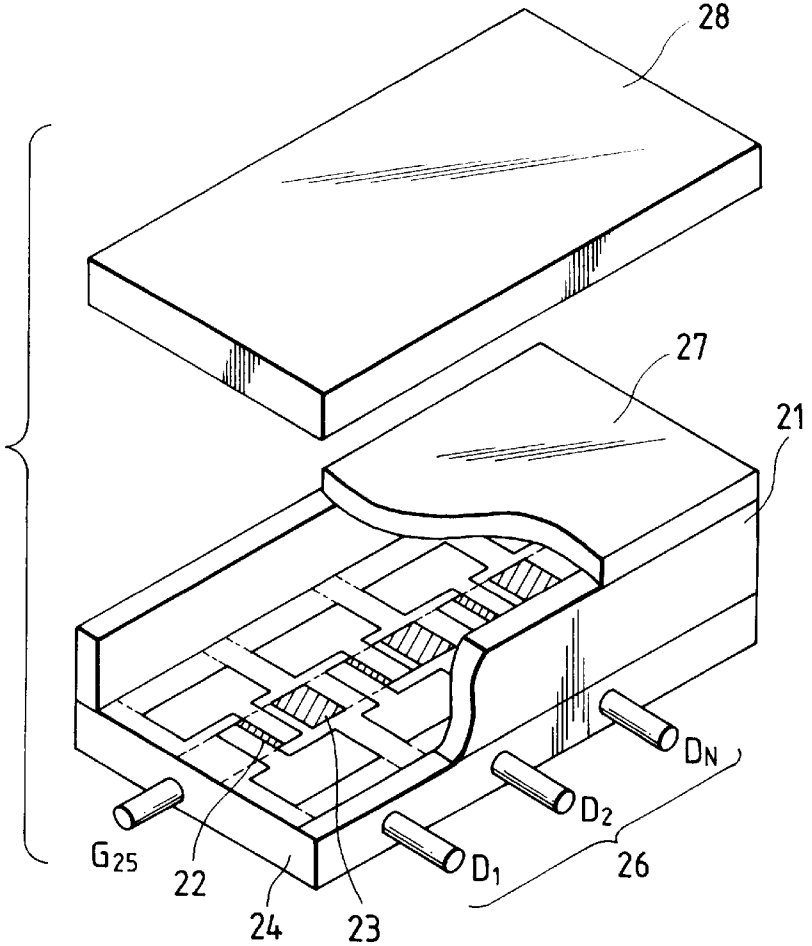

FIG. 31 is a schematic diagram of the construction of an optical printer in accordance with a fifth embodiment of the present invention. The general construction is the same as Embodiment 4, and the description for it will not be repeated. In this embodiment, a modulation signal for one image line is applied to electron emitting elements 22. Accordingly, electrodes 26 ($D_1$ to $D_N$) for applying voltages to the electron emitting elements 22 are formed independently, and modulation voltages in accordance with an information signal are respectively applied to the electrodes. A constant voltage is applied to image forming members 23 through an electrode 25 (G). The image forming members 23 are irradiated with electron beams emitted from some of the electron emitting elements to which ON signals through the corresponding ones of the electrodes $D_1$ to $D_N$ are applied. The general construction of the optical printer and the driving method are the same as Embodiment 4.

An optical recording pattern having the same quality as that obtained by Embodiment 4 was also obtained by the arrangement of this embodiment.

Embodiment 6

An optical printer such as that shown in FIG. 13 was obtained by using as a light emission source the image forming apparatus manufactured in accordance with Embodiment 4. This printer has a light emission source 41, an electrophotographic sensitive member 44, a charging device 48, a development device, a charge removing device 46, a cleaner 47, and a sheet of paper 49 to which an image is formed. In this embodiment, a yellowish green luminescent member formed of $Zn_2SiO_4$:Mn (P1 luminescent material) was used as the luminescent member of the image forming apparatus, and an amorphous silicon sensitive material was used as an electrophotographic sensitive material.

A method of driving the optical printer in accordance with this embodiment will be described below. First the recording member 44 is charged to a plus voltage by the charging device 48. The charging voltage is preferably 100 to 500 V but is not limited to this range. The recording member 44 is then irradiated with a pattern of light emitted from the light emission source 41 in accordance with an information signal so that charge is removed from the irradiated portion, thereby forming an electrostatic latent image. The development device 45 develops the latent image on the recording member 44 with toner particles.

With the movement of recording member 44 and the portion to which the toner has been attracted and attached, charge thereon is removed by the charge removing device 46, so that the attached toner falls. At this time, the paper sheet 49 on which the image is to be formed is positioned between the recording member 49 and the charge removing device 46, and the toner falls onto this paper sheet 49. The paper sheet 49 which has received the toner moves to a fixation unit (not shown), and the toner is fixed on the paper sheet 49 by the fixation unit, thereby reproducing on the paper sheet 49 the recorded image formed by the light emission source.

In this manner, a high-contrast clear image having a high resolution was formed at a high speed.

Embodiment 7

Figure 32:
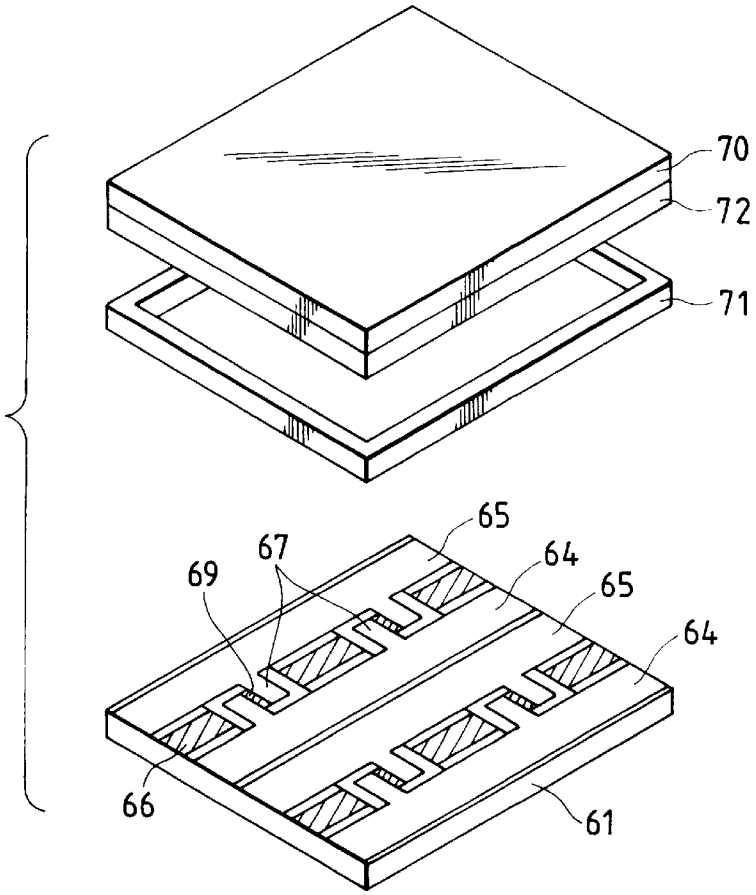

FIG. 32 shows an image forming apparatus in accordance with a seventh embodiment of the present invention.

As shown in FIG. 32, the image forming apparatus in accordance with this embodiment is the same as the image forming apparatus of Embodiment 1 except that a potential prescription means 72 is provided.

The image forming apparatus of this embodiment was manufactured by the same method as Embodiment 1 except that a glass plate was used as face plate 70, and a film of ITO having a thickness of 1,000 Å was formed over one surface of this glass plate to form transparent potential prescription means 72.

The interior of the glass container thus completed was evacuated with a vacuum pump. After a sufficient degree of vacuum had been reached, a voltage was applied between device wiring electrodes 64 and 65 to cause a current through the ultrafine particle films of the electron emitting sections 69, and the voltage was gradually increased to cause an irreversible reformation in the ultrafine particle films, (which treatment is hereinafter referred to as a forming treatment). The glass container was finally sealed. The degree of vacuum sufficient for enabling this image forming apparatus to operate with improved stability was $10^{-6}$ to $10^{-7}$ torr. The potential prescription means 72 was grounded.

Next, a driving method in accordance with this embodiment will be described below. Referring to FIG. 32, a pulse voltage of 14 V is applied between one of the pairs of device wiring electrodes 64 and 65 to emit electrons from a plurality of electron emitting elements arranged in a row. The operation of turning on/off the emission of electron beams to the image forming members is controlled by applying a negative (not higher than 0 V) or positive (10 to 1,000 V) voltage to the image forming members on the positive device wiring electrode side in accordance with an information signal. In this embodiment, a voltage of 100 V was applied to each image forming member for the on state, while a voltage of about −30 V was applied for the off state. Emitted electrons are accelerated to collide against the image forming members. One-line display on the image forming members is effected in accordance with the information signal.

A pulse voltage of 14 V is then applied to the adjacent pair of device wiring electrodes 64 and 65 to effect the above-described one-line display. This operation is repeated to form a one-frame image. That is, the groups of device wiring electrodes are used as scanning electrodes, and these scanning electrodes and the image forming members form an X-Y matrix to display the image.

The surface conduction type electron emitting device in accordance with this embodiment is capable of being driven in response to a voltage pulse of 100 picoseconds or shorter, and therefore enables formation of 10,000 or more scanning lines in 1/30 second.

As described above, the image forming apparatus in accordance with this embodiment was obtained in this manner, which was capable of efficiently converging electron beams to image forming members by applying a voltage thereto, and capable of preventing damage to the electron emitting elements caused by ion bomdardment, had a long life, and made it possible to display an image greatly improved in uniformity and free from luminance unevenness. Moreover, the reduction in the luminance during a long-time use was negligible.

Also, a large-screen high-definition display was obtained at a low cost because the electron emitting devices and the image forming members could be aligned easily because they were formed by the thin film manufacturing techniques. Further, the distance between the electron emitting sections 69 and the image forming members 66 could be determined with high accuracy.

If the device electrodes are formed together with the image forming member by a printing method, the device alignment can be effected more easily. In the case of a surface conduction type electron emitting device, electrons having an initial velocity of several bolts are emitted into a vacuum. It was confirmed that the present invention was remarkably effective with respect to a modulation of such a device.

Embodiment 8

The same image forming apparatus as Embodiment 7 except that the thickness of the support frame 71 is set to 3 mm was manufactured. This apparatus was driven in the same manner as Embodiment 7 except that a voltage of −10 V was applied to voltage prescription means 72 when each image forming member was irradiated with an electron beam (in the on state).

The image forming apparatus in accordance with this embodiment achieved the same effect as Embodiment 7. That is, it was confirmed that the apparatus of the present invention could be designed so as to greatly reduce the thickness of the display panel.

Embodiment 9

The same image forming apparatus as Embodiment 2 (FIGS. 28 and 29) except that a voltage prescription means 72 is provided as shown in FIG. 32 was manufactured and was driven by the same method as Embodiment 7.

This embodiment enables the same effect as Embodiment 7 and is further advantageous in that image forming members 86 formed of a luminescent material are not formed as separate patterns with respect to the electron emitting devices but are continuously formed as strips of film, and device electrodes 87 and device wiring electrodes 84 and 85 are formed together by vapor deposition, so that the manufacture process can be simplified (FIGS. 28 and 29).

Also, since the image forming members 86 (FIGS. 28 and 29) formed of a luminescent material are formed as strips of film and have a large area, the luminance of the resulting image is further increased in comparison with Embodiment 7.

Embodiment 10

Figure 33:
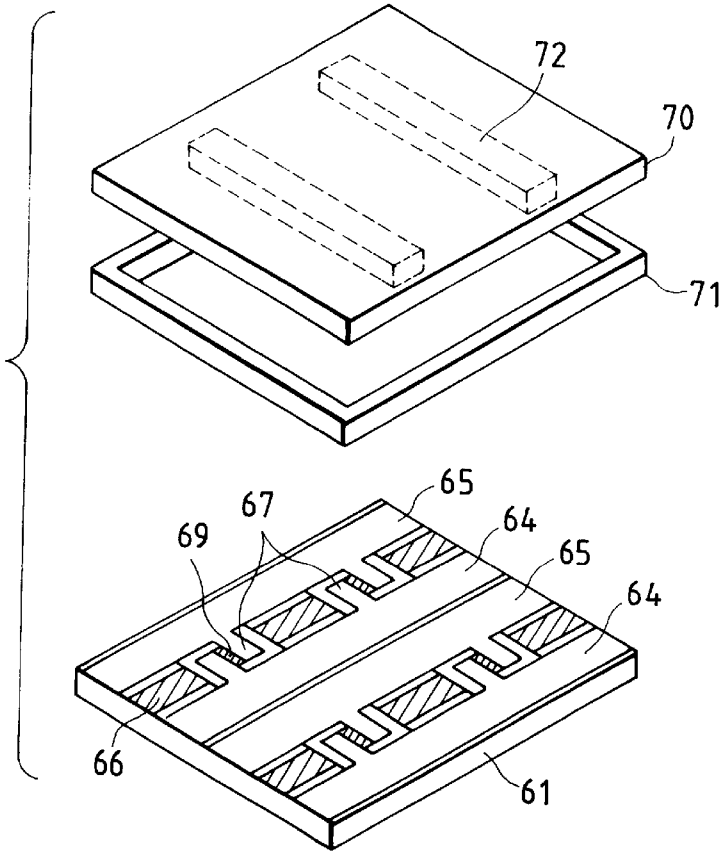

The same image forming apparatus as Embodiment 7 except that potential prescription means 72 in the form of strips are provided as shown in FIG. 33 was manufactured. The potential prescription means 72 is formed of an ITO material on an inner surface of face plate 70 by vapor deposition so as to have a thickness of 3,000 Å, a width of 500 μm, and a pitch of 2 mm, and is provided right above each electron emitting section 69.

The apparatus in accordance with this embodiment was driven as described below. First, the voltage applied to image forming members 66 is set to 8 to 1.5 kV. Referring to FIG. 33, a pulse voltage of 14 V is applied between one of the pairs of device wiring electrodes 64 and 65 to emit electrons from a plurality of electron emitting elements arranged in a row. The operation of turning on/off the emission of electron beams to the image forming members is controlled by applying a voltage to the potential prescription means 72 in accordance with an information signal. In this embodiment, a voltage of 10 V was applied to each image forming member for the on state, while a voltage of about −50 to −150 V was applied for the off state. Emitted electrons are accelerated to collide against the image forming members. One-line display on the image forming members is effected in accordance with the information signal. A pulse voltage of 14 V is then applied to the adjacent pair of device wiring electrodes 64 and 65 to effect the above-described one-line display. This operation is repeated to form a one-frame image. That is, the groups of device wiring electrodes are used as scanning electrodes, and these scanning electrodes and the image forming members form an X-Y matrix to display the image. The same effect as Embodiment 7 was obtained in this embodiment.

Embodiment 11

The same image forming apparatus as Embodiment 10 except that the width of the potential prescription means 72 is set to 1 lmm, i.e., doubled from the width in the case of Embodiment 10 was manufactured. It was driven by the same method as Embodiment 10 to obtain the same effect. In this embodiment, however, the width of the potential prescription means is specifically large so that the distribution of an equal-potential surface formed between the potential prescription means and the electric field formed above each image forming member is made further uniform, thereby further improving the uniformity of the luminance at the image forming member surface.

This embodiment was effective in achieving the function of controlling the operation of turning on/off the emission of beams with the potential prescription means without relatively positioning the potential prescription means and the electron emission centers with a high degree of accuracy.

Embodiment 12

An image forming apparatus was manufactured which is the same as Embodiment 3 (FIG. 30) except that the method of forming electron emitting elements and wiring electrodes and the voltage prescription means provided on the inner surface of the face plate are the same as those of Embodiment 7.

In this embodiment, luminescent members having three colors, red, green and blue were repeatedly arranged as image forming members 3 to enable a full-color display. Each luminescent member was formed by a printing method to have a thickness of about 10 μm. A horizontal direction color arrangement pitch ($P_H$ in FIG. 30) was set to 230 μm, a vertical direction pitch ($P_V$) was set to 720 μm, and the size of each luminescent member was 150×450 μm (H×V). The pixel pitches were 690×720 μm (H×V), since three color R, G, B elements (one trio) constitute one pixel for full-color display, as is well known in CRT, etc.

A driving method in accordance with this embodiment will be described below briefly. A voltage pulse of 14 V is applied to a pair of electron emitting device wirings 102 and 103 to emit electrons from a plurality of electron emitting elements 2 arranged in a row, and the emission of electrons is changed in an on-off control manner with a voltage applied to the image forming members 3, as in the case of Embodiment 7. In this embodiment, however, the signal (modulation signal) for controlling the operation of turning on/off the emission of electron beams must be separated into R, G and B components which are independently applied to the R, G, B luminescent members 3, since each pixel is formed of one R-G-B trio. Wirings for the luminescent members having three colors are therefore provided independently, as shown in FIG. 30.

That is, one pixel is constituted of three luminescent members, while the groups of electron emitting device wiring electrodes (102, 103) are used as scanning electrodes and these scanning electrodes and the image forming members form an X-Y matrix, as in the case of Embodiment 7.

Based on the arrangement of this embodiment, an image forming apparatus was obtained in which the reduction in the luminance due to a reduction in the luminescent area caused by element misalignment or a phenomenon in which electrons emitted from an electron emitting element do not hit the whole surface of the predetermined luminescent member was limited in comparison with the conventional image forming apparatus in which the electron emitting elements and the image forming members are opposed with a spacing. The image forming apparatus of this embodiment is greatly improved in the effect of limiting the reduction in color purity due to miscoloring (e.g., hitting a green image forming member with electrons which are to be emitted to a red image forming member) when the electron emitting elements and the image forming members are misaligned to a large extent.

Thus, by the arrangement of this embodiment, an image improved in contrast with respect to three primary colors and free from any considerable luminance unevenness or fluctuation was obtained with stability and improved reproducibility.

Embodiment 13

The same image forming apparatus as Embodiment 7 except that only one row of electron emitting elements is arranged as shown in FIG. 23 was manufactured. A member 206 is a potential prescription means.

An optical printer such as that shown in FIG. 11 was manufactured by using this image forming apparatus as a light emission source, as in the case of Embodiment 4. In this embodiment, a modulation signal for one image line in accordance with an information signal is simultaneously applied to the luminescent members in synchronization with the driving of the row of electron emitting elements to control the irradiation of luminescent members with electron beams so as to form an emission pattern for one image line. Light beams are emitted from the luminescent members to the recording member in accordance with this emission pattern, and the recording member irradiated with these light beams is photopolymerized and set. Then, the transport rollers 33 are moved and the image forming apparatus is driven again in the same manner. By repeating this driving, a photopolymerized pattern formed in accordance with the information signal is formed on the recording member. This photopolymerized pattern is developed by methyl ethyl ketone to form an optical recording pattern on the polyethylene terephthalate film.

By the optical printer in accordance with this embodiment, a uniform, high-contrast and clear optical recording pattern was formed at a high speed.

Embodiment 14

Figure 34:
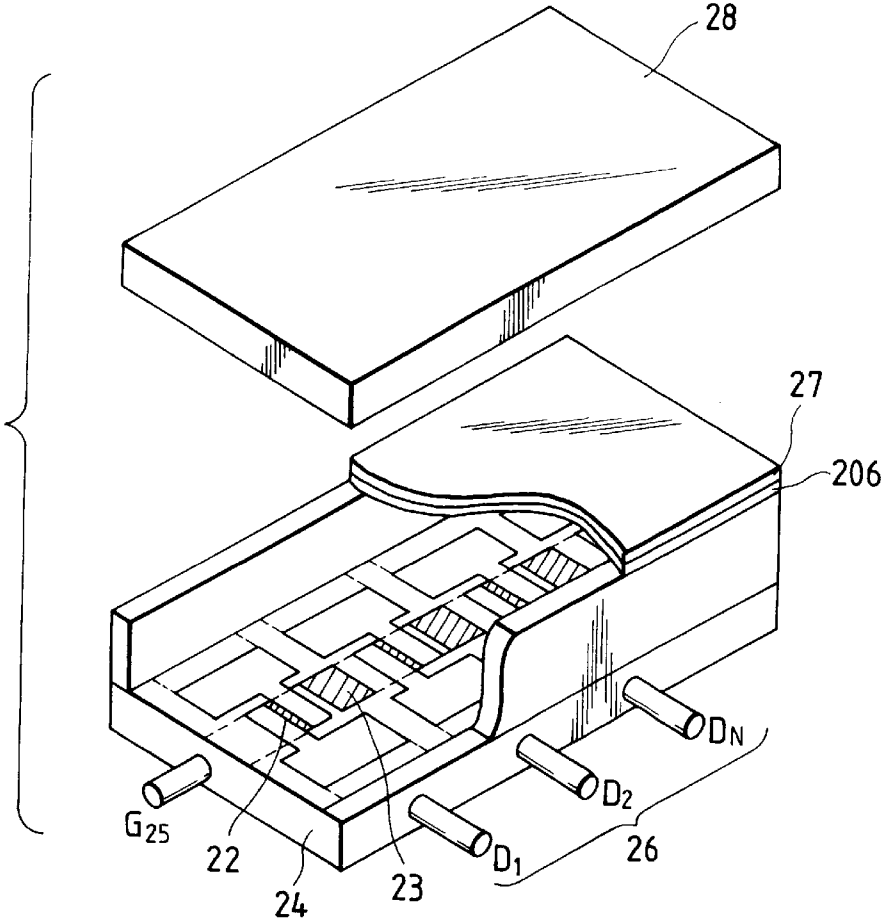

FIG. 34 is a schematic diagram of the construction of an optical printer in accordance with a fourteenth embodiment of the present invention. The general construction is the same as Embodiment 13, and the description for it will not be repeated. In this embodiment, a modulation signal for one image line is applied to electron emitting elements 22. Accordingly, electrodes 26 ($D_1$ to $D_N$) for applying voltages to the electron emitting elements 22 are formed independently, and modulation voltages in accordance with an information signal are respectively applied to the electrodes. A constant voltage is applied to image forming members 23 through an electrode 25 (G). The image forming members 23 are irradiated with electron beams emitted from some of the electron emitting elements to which ON signals through the corresponding ones of the electrodes $D_1$ to $D_N$ are applied. The general construction of the optical printer and the driving method are the same as Embodiment 13.

An optical recording pattern having the same quality as that obtained by Embodiment 13 was also obtained by the arrangement of this embodiment.

Embodiment 15

An optical printer such as that shown in FIG. 13 was obtained by using as a light emission source the image forming apparatus manufactured in accordance with Embodiment 6. In this embodiment, a yellowish green luminescent member formed of $Zn_2SiO_4$:Mn (P1 luminescent material) was used as the luminescent member of the image forming apparatus, and an amorphous silicon sensitive material was used as an electrophotographic sensitive material.

The optical printer in accordance with this embodiment was driven in the same manner as Embodiment 6 to perform image recording.

A high-contrast clear image having a high resolution was thereby formed at a high speed.

Embodiment 16

Figure 36:
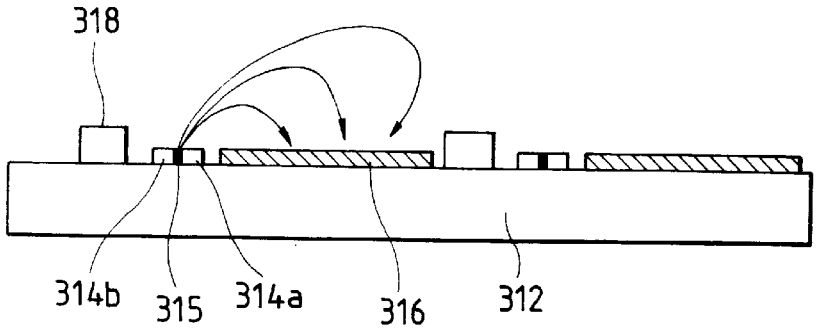
FIGS. 36 to 39 are diagrams showing changes in electron beam flight loci with respect to existence and non-existence of a shielding electrode in the image forming apparatus of the present invention.
Figure 40:
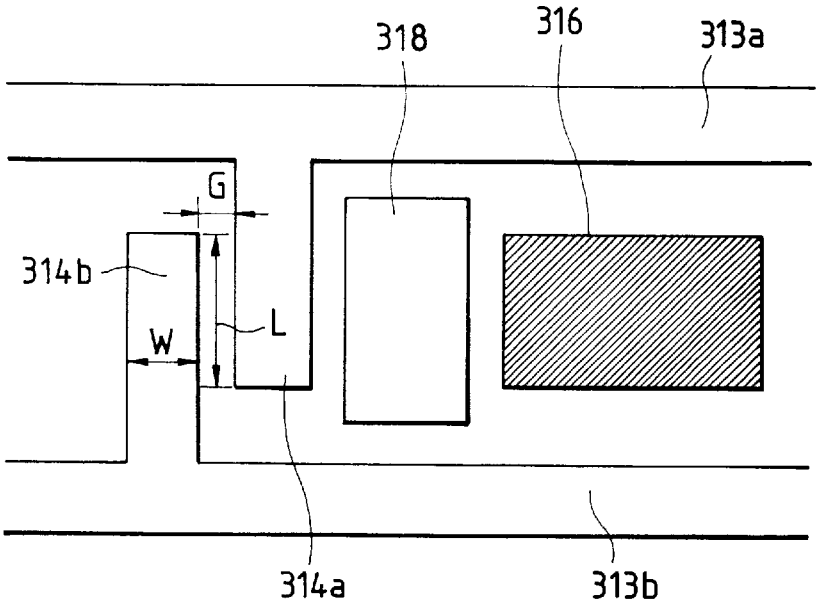

FIG. 35 is a perspective view of an image forming apparatus in accordance with a sixteenth embodiment of the present invention, FIG. 36 is an enlarged sectional view of a portion of the apparatus shown in FIG. 35, and FIG. 40 is an enlarged plan view of a portion of the apparatus shown in FIG. 35. As shown in these figures, this apparatus includes electron emitting devices 310 which have pairs of plus and minus electrodes 314*a* and 314*b* and each of which emits electrons when a voltage is applied between the corresponding pair of electrodes, image forming members 316 which are formed of a luminescent material and which form an image when irradiated with beams of electrons emitted from the electron emitting devices 310, and a shielding electrode 318 provided between each of adjacent pairs of image forming members to shield each image forming member from the potential of the other image forming member. The electron emitting devices 310, the image forming members 316 and the shielding electrodes 318 are arranged on an insulating substrate 312 in such a manner that one electron emitting device 310 is placed next to one shielding plate 310, and one image forming member 316 is placed next to this electron emitting device 310.

Electron emitting device 310 and image forming member 316 corresponding to it exist in plurality. The plus and minus electrodes 314*a* and 314*b* of each electron emitting device 310 are connected to device wiring electrodes 313*a* and 313*b*, respectively. A group of electron emitting elements 310 connected to one pair of device wiring electrodes 313*a* and 313*b* forms a row of electron emitting devices which are driven simultaneously. Each row of image forming members 316 perpendicular to this row of the electron emitting devices are connected by image forming member wiring electrodes 320. A plurality of device wiring electrodes 313*a* and 313*b* and a plurality of image forming member wiring electrodes 320 are respectively arranged in rows so as to intersect each other and to form a matrix-like pattern. A face plate 319 is supported by a support frame 317 on the insulating substrate 312.

Each electron emitting device 310 has an electron emitting section 315 between the electrodes 314*a* and 314*b*, and is constructed as a cold cathode type such that when a voltage is applied between these electrodes, electrons are emitted from the electron emitting section 315.

An example of a method of manufacturing this image forming apparatus will be described below. First, insulating substrate 312 is sufficiently washed, and device electrodes 314*a* and 314*b*, image forming member wiring electrodes 320 and shielding electrode wirings 321 are formed of a Ni material by a vapor deposition technique and a photolithography technique ordinarily used. The image forming member wiring electrodes 320 may be formed by any material other than Ni so long as its resulting electrical resistance is adequately small.

Next, insulating layers 322 having a thickness of 3 μm are formed of $SiO_2$ by a vapor deposition technique. The insulating layers 322 may be formed of a material selected from glass and other ceramic materials.

Thereafter, device wiring electrodes 313*a* and 313*b* are formed of a Ni material by a vapor deposition technique and an etching technique. At this time, device electrodes 314*a* and 314*b* are connected to device wiring electrodes 313*a* and 313*b* and have electron emitting sections 315 interposed between device electrodes 314*a* and 314*b*. The electrode gap G between device electrodes 314*a* and 314*b*, which is preferably 0.1 to 10 μm, is set to 2 μm in this embodiment. The length L corresponding to each electron emitting section 315 is set to 300 μm. It is preferable to reduce the width W (FIG. 40) of the device electrodes 314*a* and 314*b*. In practice, however, this width is preferably 1 to 100 μm, more preferably 1 to 10 μm. Each electron emitting section 315 is formed at or in the vicinity of the center of adjacent image forming member wiring electrodes 320. The pairs of device wiring electrodes 313*a* and 313*b* are arranged with a 2 mm pitch, and electron emitting sections 315 are arranged with a 1 mm pitch.

Shielding electrodes having a thickness of 15 μm are formed of Al by a vapor deposition technique and an etching technique.

Next, ultrafine particle films are formed between the opposed electrodes by a gas deposition method to provide electron emitting sections 315. Pd is used as the material of the ultrafine particles. The particle material may be selected from any other materials. Among possible materials, metallic materials, such as Ag and Au, and oxide materials, such as $SnO_2$ and $In_2O_3$, are preferred. In this embodiment, the diameter of Pd particles is set to about 100 Å, but this is not exclusive. Ultrafine particle films can also be formed between the electrodes by methods other than the gas deposition method, e.g., a method of applying an organic metal and thereafter heat-treating this metal, which also ensures the desired device characteristics.

Next, image forming members 316 made of a luminescent material are formed by a printing method to have a thickness of about 10 μm. Image forming members 316 made of a luminescent material may be formed by a different method, e.g., a slurry method or precipitation method.

Face plate 319 is provided on insulating substrate 312 on which the electron emitting devices and other components are formed as described above, with support frame 317 interposed therebetween, so that face plate 319 is spaced apart from insulating substrate 312 by 5 mm, thereby completing the image forming apparatus.

Next, a method of driving this apparatus will be described below. A pulse voltage of 14 V is applied between one of the pairs of device wiring electrodes 313*a* and 313*b* to emit electrons from electron emitting sections 315 of the row of electron emitting devices connected to these electrodes. A beam of electrons emitted from each electron emitting section 315 flies in the direction of plus device electrode 314*a* and is then changed in an on-off control manner by a voltage of 10 to 1,000 V applied to the image forming member wiring electrode 320 in accordance with an information signal. That is, an electron beam on-controlled is accelerated to collide against image forming member 316 adjacent to the plus device electrode 314*a* to make this image forming member emit light, while an electron beam off-controlled does not make the image forming member 316 emit light. This applied voltage is determined according to the kind of luminescent material used and the necessary luminance and is not specifically limited to the above range. When one-line display on the corresponding row of image forming members 316 in accordance with the information signal is thereby completed, the next adjacent pair of device wiring electrodes 313*a* and 313*b* is selected, and a pulse voltage of 14 V is applied to this pair of device wiring electrodes to effect display of the next line in the same manner. This operation is repeated to form a one-frame image. That is, the device wiring electrodes 313*a* and 313*b* are used as scanning electrodes, and these scanning electrodes and the image forming member wiring electrodes 320 form an X-Y matrix to display the image.

Figure 37:
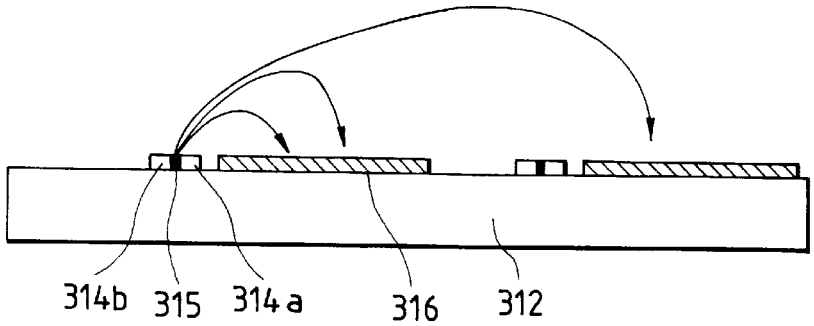

If this driving is performed while the shielding electrodes are grounded and while the voltage applied to the image forming members 316 is set to a voltage equal to or higher than 14 V, image formation can be effected without causing blur or the like in the image. Further, if the potential of the shielding electrodes 318 is set to −20 V, the sharpness of the image is improved. The reason for this effect is thought to be because the potential of the image forming member 316 adjacent to each shielding electrode is shielded so that crosstalk cannot occur easily. That is, as shown in FIG. 37, if no shielding plate 318 is provided, some emitted electrons fly over the image forming member 316 which is to be excited by these electrons, and reach the next image forming member 316 by the influence of the plus device electrode 314*a*. However, such a crosstalk can be prevented by providing the shielding plate 318, as shown in FIG. 36.

In accordance with this embodiment, each electron emitting device 315 is of a surface conduction type and is capable of being driven in response to a voltage pulse of 100 picoseconds or shorter, and therefore enables formation of 10,000 or more scanning lines, when an image of one pixel can be displayed in 1/30 second. Since electron emitting devices 315 and image forming members 316 are formed on the same substrate, an electron beam can be converged to each image forming member 316 by the voltage applied to the image forming member 316 without being concentrated to an end surface thereof. There is therefore no risk of the electron emitting devices 315 being damaged by ion bombardment so that luminance unevenness is caused. It is therefore possible for the image forming apparatus to display images with a highly uniform brightness during long-time use. That is, if a surface conduction type electron emitting device is used, electrons having an initial velocity of several volts are emitted therefrom into a vacuum. The present invention is effective in modulating such an electron beam.

Since crosstalks between adjacent pixels can be prevented by shielding plates 318, a higher voltage can be applied to image forming members 316 to effect high-luminance image display, or the pixel arrangement pitch may be reduced to enable high-definition image formation.

Also, a large-screen high-definition display can be obtained at a low cost because electron emitting devices 315 and image forming members 316 can be aligned easily and because they can be formed by the thin film manufacture techniques. Further, the distance between the electron emitting sections 315 and the image forming members 316 can be determined with high accuracy, so that an image display apparatus capable of displaying a very uniform image free from luminance unevenness can be obtained. If device electrodes 314 are formed together with image forming members 316 by a printing method, the device alignment can be effected more easily.

Embodiment 17

Figure 38:
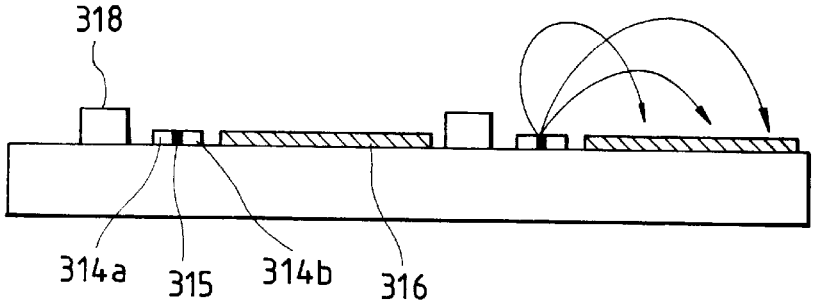

FIG. 38 is an enlarged cross-sectional view of a portion of an image forming apparatus in accordance with a seventeenth embodiment of the present invention. This apparatus has the same construction as Embodiment 16 and is manufactured in the same manner except that opposed plus and minus electrodes 314*a* and 314*b* are replaced with each other.

Figure 39:
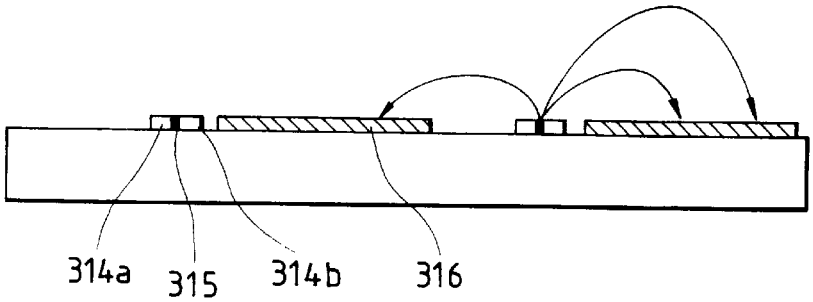

If in this case no shielding plate 318 is provided, some emitted electrons fly to form, by the influence of a plus device electrode 314*a*, a locus such as to be incident upon an image forming member 316 located opposite to the image forming member 316 which is to be excited by these electrons, as shown in FIG. 39. However, such a crosstalk can be prevented by forming shielding plate 318, as shown in FIG. 38.

This embodiment has the same effect as Embodiment 16. Further, because some electrons reach image forming member 316 by oppositely changing their course after starting flying, the image forming member 316 can be uniformly irradiated with electrons without concentration of electrons to a portion of the image forming member 316 closer to the electron emitting device 310, thereby improving the uniformity of the resulting image.

Embodiment 18

In this embodiment, image forming member wiring electrodes 320 are formed on device wiring electrodes 313*a* and 313*b* with insulating layers interposed therebetween, and image forming members 316 in the form of strips are formed on the wiring electrodes 320 so as to extend therealong and perpendicularly to the direction in which the device wiring electrodes extend. Except for these points, the apparatus has the same construction as Embodiment 16 and is constructed in the same manner.

This embodiment has the same effect as Embodiment 16, and is further advantageous in that image forming members formed of a luminescent material are not formed as separate patterns with respect to the electron emitting devices but are continuously formed in the form of strips, and device electrodes and device wiring electrodes can be formed together by vapor deposition, so that the manufacture process can be simplified. Moreover, since the image forming members have a strip-like shape and have a large area, the luminance of the resulting image is further increased in comparison with Embodiment 16.

Embodiment 19

This embodiment is constructed based on Embodiment 16 in such a manner that ITO electrodes in the form of strips are provided on a surface of a face plate 319 in positions such as to face image forming members 316 and image forming member wiring electrodes 320. While a constant voltage is applied to the image forming member wiring electrodes 320, voltages in accordance with an information signal are applied to the ITO electrodes to control the operation of turning on/off the emission of electron beams. A voltage of 2 kV is applied to the image forming members 316. In this case, a modulation through the ITO electrode is more preferable than a modulation with a voltage applied to the image forming member 316. This embodiment achieves a further improvement in the luminance of the displayed image.

Embodiment 20

Luminescent members having three colors, red, green and blue are used as image forming members 316, are repeatedly arranged and are connected by image forming member wiring electrodes 320 with respect to the colors to enable a full-color display in which three color elements constitute one pixel. Except for this, the apparatus has the same construction as Embodiment 16 and is manufactured in the same manner.

This embodiment has the same effect as Embodiment 16 and enables formation of a high-luminance high-definition image free from color unevenness and color misalignment.

Embodiment 21

Figure 41:
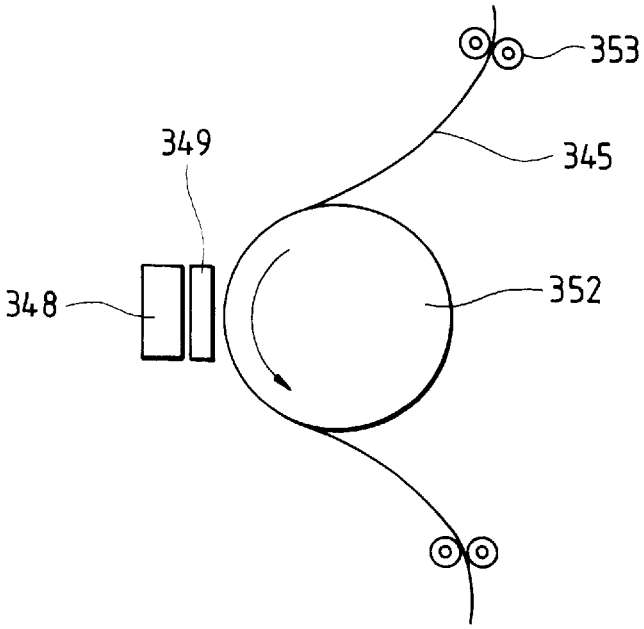

FIG. 41 is a schematic diagram of an optical printer in accordance with a twenty-first embodiment of the present invention. This apparatus includes a light emission source 348, a lens array 349, and a recording member 345. The lens array 349 is ordinarily constituted of a SELFOC lens and is disposed between the light emission source 348 and the recording member 345 to image a pattern of light emitted from the light emission source 348. The light emission source 348 is formed as an image forming apparatus in accordance with one of the above-described embodiments 16 to 20 and has only one pair of device wiring electrodes 313*a* and 313*b*. It therefore has the same construction as those having only one row of electron emitting devices.

The recording member 345 is manufactured by uniformly applying a sensitive compound having a composition shown below to a polyethylene terephthalate film to have a thickness of 2 $\mu$m. This sensitive compound is prepared by dissolving, in 70 parts by weight of methyl ethyl ketone used as a solvent, a mixture of (a) 10 parts by weight of a binder: polyethylene methacrylate (commercial name: DIANAL BR, made by Mitsubishi Rayon), (b) 10 lparts by weight of a monomer: trimethylol propane triacrylate (commercial name: TMPTA, made by Shin Nakamura Kagaku) and (c) 2.2 parts by weight of a polymerization initiator: 2-methyl-2-morpholino (4-thiomethyl phenyl) propane-1-xy (commercial name: IRGACURE 907, made by CIBA- GEYGY). A silicate luminescent material (Ba, Mg, Zn)$_3$Si$_2$O$_7$:Pb$^{2+}$ is used as a luminescent material constituting the image forming members.

In the optical printer thus constructed, the electron emitting devices arranged in a row are driven in a predetermined cycle and, in synchronization with this driving, a modulation signal for one image line in accordance with an information signal representing an image to be formed is successively applied to the image forming member wiring electrodes or ITO electrodes in the form of strips. Also, in synchronization with this operation, the light emission source 348 and the recording member 345 are moved relative to each other. During each driving, the irradiation of each image forming member with an electron beam is controlled with the corresponding image forming member wiring electrode or the strip-like ITO electrode to form an emission pattern for one image line on the image forming members. Light beams in accordance with this emission pattern are emitted to the recording member through the lens array 349, and the recording member 345 is thereby photopolymerized and set in accordance with the emission pattern, thereby forming a one-line image.

Figure 42:
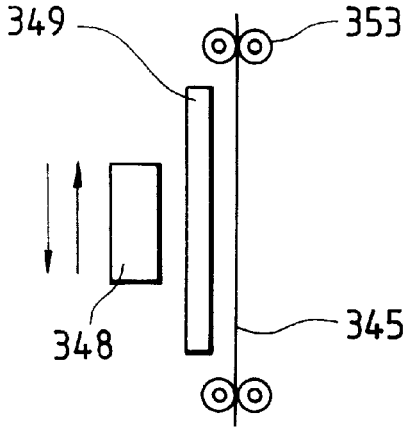

The relative movement of the light emission source 348 and the recording member 345 in synchronization with one-line image formation timing may be effected by driving transport rollers 353 while supporting the recording member 345 with a supporting member 352. Alternatively, the light emission source 348 may be moved as shown in FIG. 42. In either case, by this synchronized driving, a photopolymerized pattern in accordance with the information signal is formed on the recording member 345. This photopolymerized pattern is developed by methyl ethyl ketone to form an optical recording pattern in accordance with the information signal on the polyethylene terephthalate film.

By the optical printer in accordance with this embodiment, a uniform, high-contrast and clear optical recording pattern can be formed at a high speed.

Embodiment 22

Figure 43:
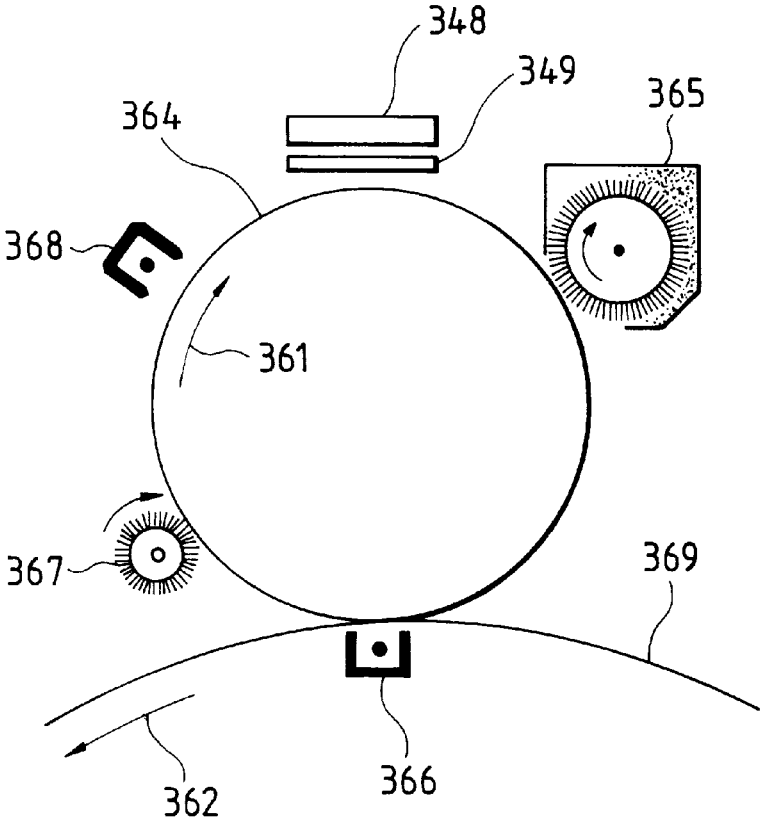

FIG. 43 is a schematic diagram of an optical printer in accordance with a twenty-second embodiment of the present invention. The apparatus has a light emission source 348 and a lens array 349 arranged in the same manner to have the same function as that of Embodiment 20, a drum-like electrophotographic sensitive member 364 provided as a recording member, a charging device 368, a development device 365, a charge removing device 366, and a cleaner. An image is finally formed on a paper sheet 369. A yellowish green luminescent member formed of Zn$_2$SiO$_4$:Mn (P1 luminescent material) is used as the luminescent member of the image forming apparatus, and an amorphous silicon sensitive material is used as the material of the electrophotographic sensitive member 369.

In this arrangement, the recording member 364 is rotated in the direction of arrow 361 relative to the light emission source 348 as in the above, and the paper sheet 369 is also moved in the direction of arrow 362 in synchronization with the rotation of the recording member. During this movement, the recording member 364 is charged to a plus voltage by the charging device 368 and is irradiated with a pattern of light emitted from the light emission source 348 through the lens array 349 so that charge is removed from the irradiated portion, thereby forming an electrostatic latent image. The charging voltage is preferably set to 100 to 500 V, but is not limited to this range. The development device 365 develops the latent image with toner particles. With the movement of recording member 364, the toner attracted and attached moves and a charge thereon is removed by the charge removing device 366, so that the attached toner falls onto the paper sheet 369 positioned between the recording member 364 and the charge removing device 366. The paper sheet 369 which has received the toner moves to a fixation unit (not shown) to fix the toner, thereby reproducing on the paper sheet 369 the recorded image formed by the light emission source 348. The residual toner on the recording member 364 is brushed off by the cleaner 367 and the corresponding recording portion is charged again by the charging device 368.

In this manner, a high-contrast clear image having a high resolution and free from exposure unevenness can be formed at a high speed by virtue of the above-described advantages of the light emission source 348.

Embodiment 23

Figure 46:
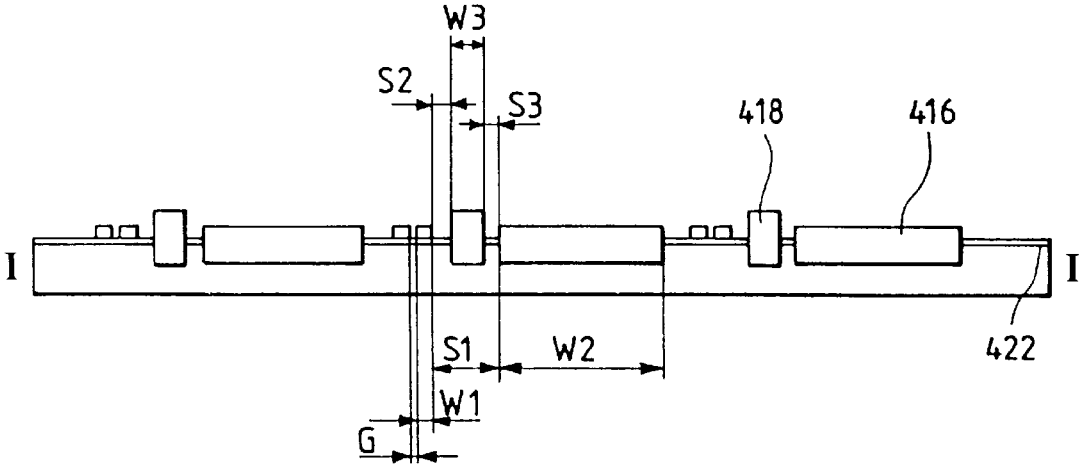

FIG. 44 is a perspective view of an image forming apparatus in accordance with a twenty-third embodiment of the present invention, FIG. 45 is an enlarged sectional view of a portion of the apparatus shown in FIG. 44, and FIG. 46 is a cross-sectional view taken along the line A–A' of FIG. 45. As shown in these figures, this apparatus includes electron emitting devices 410 which have pairs of plus and minus electrodes 414*a* and 414*b* and each of which emits electrons when a voltage is applied between the corresponding pair of electrodes, image forming members 416 which forms an image when irradiated with beams of electrons emitted from the electron emitting devices 410, and correction electrodes 418 provided between each electron emitting device 410 and the corresponding image forming member 416 to control the direction of flying of a beam of electrons emitted from each electron emitting device 410. These devices, members and electrodes are provided on an insulating substrate 412.

The plus and minus electrodes 414*a* and 414*b* of each electron emitting device 410 are connected to device wiring electrodes 413*a* and 413*b*, respectively. A group of electron emitting elements 410 connected to one pair of device wiring electrodes 413*a* and 413*b* forms a row of electron emitting devices which are driven simultaneously. Each row of image forming members 416 and the correction electrodes 418 perpendicular to this row of the electron emitting devices are connected by image forming member wiring electrodes 420 and correction electrode wiring conductors 421, respectively. A plurality of device wiring electrodes 413*a* and 413*b*, a plurality of image forming member wiring electrodes 420 and a plurality of correction electrode wiring conductors 421 are respectively arranged in rows so as to intersect each other and to form a matrix-like pattern. A face plate 419 is supported by a support frame 417 on the insulating substrate 412.

Each electron emitting device 410 has an electron emitting section 415 between the electrodes 414*a* and 414*b*, and is constructed as a cold cathode type such that when a voltage is applied between these electrodes, electrons are emitted from the electron emitting section 415.

Each correction electrode 418 may be formed of any of electroconductive materials including metals and a mixture of an insulating material and an electroconductive material dispersed in the insulating material. The width of the correction electrode is preferably 10 to 300 $\mu$m, more preferably 30 to 150 $\mu$m. The thickness is not specifically limited; it may be selected as desired in relation to other members. Ordinarily, it is preferably set to 1,000 Å to 10 $\mu$m.

The voltage applied to the correction electrodes 418 is selected as desired in relation to the voltage applied to electron emitting devices 410, the voltage applied to image forming members 416, the distance between electron emitting devices 410 and correction electrodes 418, the distance between correction electrodes 418 and image forming members 416 and other factors. Ordinarily, it is within the range of −50 to +50 V but, of course, is not limited to this range. The distance between correction electrodes 418 and device electrodes 414*a* and the distance between correction electrodes 418 and image forming members 416 is preferably 10 to 150 μm and 10 to 100 μm, respectively, but is not limited to these values.

An example of a method of manufacturing this image forming apparatus will be described below. First, insulating substrate 412 is sufficiently washed, and device electrodes 414*a* and 414*b*, image forming member wiring electrodes 420 and correction electrode wirings 421 are formed of a Ni material by a vapor deposition technique and a photolithography technique ordinarily used. The image forming member wiring electrodes 420 may be formed of any material other than Ni so long as its resulting electrical resistance is adequately small.

Next, insulating layers 422 having a thickness of 3 μm are formed of $SiO_2$ by a vapor deposition technique. The insulating layers 422 may be formed of a material selected from glass and other ceramic materials.

Thereafter, device wiring electrodes 413*a* and 413*b* are formed of a Ni material by a vapor deposition technique and an etching technique. At this time, device electrodes 414*a* and 414*b* are connected by device wiring electrodes 413*a* and 413*b* and have electron emitting sections 415 interposed between device electrodes 414*a* and 414*b* facing each other. The electrode gap G between device electrodes 414*a* and 414*b*, which is preferably 0.1 to 10 μm, is set to 2 μm in this embodiment. The length L (FIG. 45) corresponding to each electron emitting section 415 is set to 300 μm. It is preferable to reduce the width W1 of the device electrodes 414*a* and 414*b*. In practice, however, this width is preferably 1 to 100 μm, more preferably 1 to 10 μm. Each electron emitting section 415 is formed at or in the vicinity of the center of adjacent image forming member wiring electrodes 420. The pairs of device wiring electrodes 413*a* and 413*b* are arranged with a 2 mm pitch, and electron emitting sections 415 are also arranged with a 2 mm pitch.

Next, correction electrodes 418 are formed by a vapor deposition technique and an etching technique. The width W3 of each correction electrode 418 is set to 150 μm, and the spacing S2 between each correction electrode 418 and the plus device electrode 414*a* is set to 50 μm.

Next, ultrafine particle films are formed between the opposed electrodes by a gas deposition method to provide electron emitting sections 415. Pd is used as the material of the ultrafine particles. The particle material may be selected from any other materials. Among possible materials, metallic materials, such as Ag and Au, and oxide materials, such as $SnO_2$ and $In_2O_3$, are preferred. In this embodiment, the diameter of Pd particles is set to about 100 Å, but this is not exclusive. Ultrafine particle films can also be formed between the electrodes by methods other than the gas deposition method, e.g., a method of applying an organic metal and thereafter heat-treating this metal, which also ensures the desired device characteristics.

Next, image forming members 416 made of a luminescent material are formed by a printing method to have a thickness of about 10 μm with leaving a space distance S3 of 50 μm. Image forming members 416 may be formed by a different method, e.g., a slurry method or precipitation method.

Face plate 419 is provided on insulating substrate 412 on which the electron emitting devices and other components are formed as described above, with support frame 417 interposed therebetween, so that face plate 419 is spaced apart from insulating substrate 412 by 5 mm, thereby completing the image forming apparatus.

Next, a method of driving this apparatus will be described below. A pulse voltage of 14 V is applied between one of the pairs of device wiring electrodes 413*a* and 413*b* to emit electrons from electron emitting sections 415 of the row of electron emitting devices connected to these electrodes. A beam of electrons emitted from each electron emitting section 415 flies in the direction of the plus device electrode 414*a* and is converged to a certain extent by the correction electrode 418 without directly colliding against the image forming member 416. The converged electron beam is thereafter changed in an on-off control manner by a voltage of 10 to 1,000 V applied to the image forming member wiring electrode 420 in accordance with an information signal. That is, an electron beam on-controlled is accelerated to collide against image forming member 416 adjacent to the plus device electrode 414*a* to make this image forming member emit light, while an electron beam off-controlled does not make the image forming member 416 emit light. This applied voltage is determined according to the kind of luminescent material used and the necessary luminance and is not specifically limited to the above range. When one-line display on the corresponding row of image forming members 416 in accordance with the information signal is thereby completed, the next adjacent pair of device wiring electrodes 413*a* and 413*b* is selected, and a pulse voltage of 14 V is applied to this pair of device wiring electrodes to effect display of the next line in the same manner. This operation is repeated to form a one-frame image. That is, the device wiring electrodes 413*a* and 413*b* are used as scanning electrodes, and these scanning electrodes and the image forming member wiring electrodes 420 form an X-Y matrix to display the image.

It has been confirmed that the emission of electrons is not changed even if the voltage applied to the correction electrodes 418 is changed from 0 to −5 V, but the uniformity of electron beams is improved if this voltage is changed from −5 to −30 V. Further, if the voltage applied to each image forming member wiring electrode 420 is changed from 50 to 1.5 kV while the voltage applied to the correction electrode 418 is fixed to −20 V, the degree of convergence is increased with the potential change therebetween so that the luminance is increased.

In accordance with this embodiment, each electron emitting device 410 is of a surface conduction type and is capable of being driven in response to a voltage pulse of 100 picoseconds or shorter, and therefore enables formation of 10,000 or more scanning lines for one image display in 1/30 second. Since electron emitting devices 410 and image forming members 416 are formed on the same substrate 412, an electron beam can be converged to each image forming member 416 by the voltage applied to the correction electrode 418 without being concentrated to an end surface thereof. There is therefore no risk of the electron emitting devices 410 being damaged by ion bombardment so that luminance unevenness is caused. It is therefore possible for the image forming apparatus to display images with a highly uniform luminance during long-time use. That is, if a surface conduction type electron emitting device is used, electrons having an initial velocity of several electron volts are emitted therefrom into a vacuum. The present invention is effective in modulating such an electron beam.

Also, a large-screen high-definition display can be obtained at a low cost because electron emitting devices 410 and image forming members 416 can be aligned easily and because they can be formed by the thin film manufacture techniques. Further, the distance between electron emitting sections 415 and image forming members 416 can be determined with high accuracy, so that an image display apparatus capable of displaying a very uniform image free from luminance unevenness can be obtained. If device electrodes 414 are formed together with image forming members 416 by a printing method, the device alignment can be effected more easily.

Embodiment 24

Figure 47:
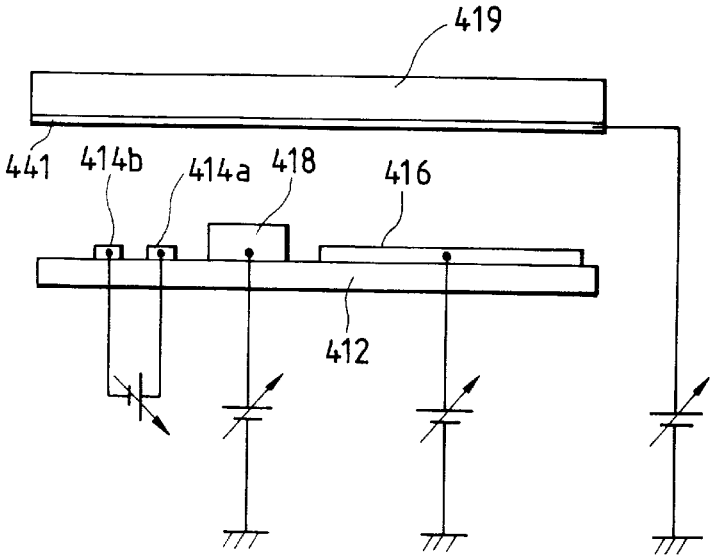

FIG. 47 is a cross-sectional view of a portion of an image forming apparatus in accordance with a twenty-fourth embodiment of the present invention which corresponds to one electron emitting. The construction of this apparatus is the same as that of Embodiment 23 except that ITO 441 is vapor-deposited on an inner surface of a plate 419 and is grounded.

In this apparatus, even if the voltage applied to image forming members 416 is increased to 1.5 kV or higher, occurrence of a disturbance of the formed image observed in the case of Embodiment 23 can be prevented. The reason for this effect is thought to be because no charge-up occurs at the inner surface of the plate and no electron beam disturbance therefore occurs.

On the other hand, even if the distance between insulating substrate 412 and the plate 419 is reduced to 3 mm, no considerable image disturbance occurs. It is therefore possible to reduce the overall thickness of the apparatus.

Embodiment 25

Figure 48:
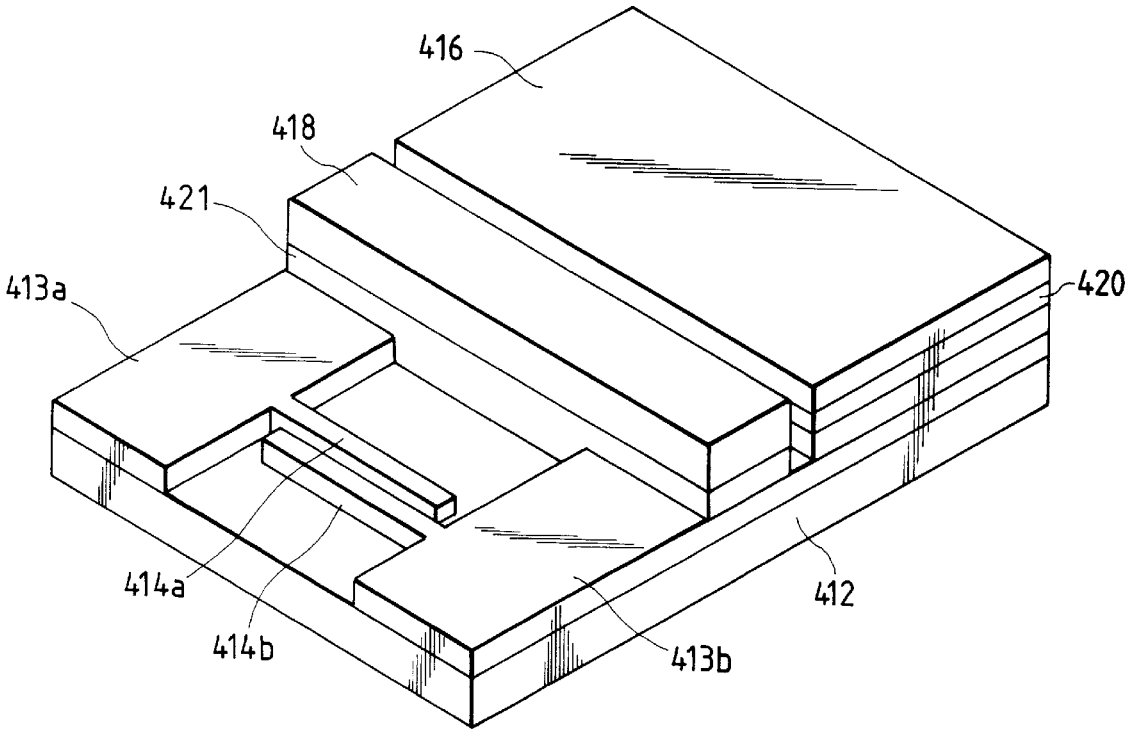

FIG. 48 is a perspective view of a portion of an image forming apparatus in accordance with a twenty-fifth embodiment of the present invention which corresponds to one electron emitting device. In this apparatus, correction electrodes 418 and image forming member wiring electrodes 420 in the form of strips are provided on device wiring electrodes 413*a* and 413*b*. This embodiment has the same effect as Embodiment 23 and further enables an increase in the area of the luminescent material of the image forming members in comparison with Embodiment 23 and, hence, an increase in luminance and an improvement in image quality.

Embodiment 26

This embodiment has the same construction as Embodiment 24, but the voltage of correction electrodes 418 and ITO 441 are equalized to enable an improvement in the effect of correction electrodes 418. It is thought that this improvement effect is based on the principle of a beam guide formed by ITO 441 and correction electrodes 418.

Embodiment 27

This embodiment is constructed based on Embodiment 23 in such a manner that ITO electrodes in the form of strips are provided on a surface of a face plate 419 in positions such as to face image forming members 416 and image forming member wiring electrodes 420. While a constant voltage is applied to image forming member wiring electrodes 420, voltages in accordance with an information signal are applied to the ITO electrodes to control the operation of turning on/off the emission of electron beams.

Embodiment 28

An optical printer of the type shown in FIG. 41 was manufactured in the same manner as Embodiment 21 while using as a light emission source 348 one of the image forming apparatuses in accordance with Embodiments 23 to 27, and image recording was thereby performed.

A uniform, high-contrast and clear recording pattern can thereby be formed at a high speed.

Embodiment 29

An optical printer of the type shown in FIG. 43 was manufactured in the same manner as Embodiment 22 except that a light emission source 348 capable of operating in the same manner as Embodiment 28 was used, and image recording was thereby performed.

A high-contrast, clear and high-resolution image free from exposure unevenness can thereby be formed at a high speed by virtue of the above-mentioned advantages of the light emission source 348.

Embodiment 30

FIG. 50 is a perspective view of an image forming apparatus in accordance with a thirtieth embodiment of the present invention, and FIG. 51 is a cross-sectional view of a portion of the apparatus shown in FIG. 50. This apparatus has the same construction as Embodiment 23 except that correction electrodes are not formed between plus device electrodes 414*a* and image forming members 416 but formed below image forming members 416 with an insulating layer 423 interposed therebetween. In the process of manufacturing this apparatus, the correction electrodes are not formed after the formation of device electrodes 414*a* and 414*b* but are formed in such a manner that image forming member wiring electrodes 420 and correction electrodes 4118 are formed on an insulating substrate 412, insulating layer 423 is thereafter formed, and image forming members 416 are formed on insulating layer 423. Except for this, the apparatus can be manufactured in the same manner as Example 23. The width W2 of image forming members 416 is set to 1.5 mm, both the distances S2 and S3 between corresponding ends of correction electrodes 4118 and image forming members 416 is set to 100 $\mu$m, and the distance S1 between electron emitting devices 410 and image forming members 416 is set to 200 $\mu$m. The material of correction electrodes 418 of Embodiment 23 can also be used as the material of correction electrodes 4118. The size of correction electrodes 4118 is not specifically limited but correction electrodes 4118 are preferably wider than image forming members 416. Thickness thereof is selected only to ensure a sufficient degree of electrode conduction, but is preferably within the range of 100 to 5,000 Å.

The voltage applied to the correction electrodes 4118 is selected as desired in relation to the voltage applied to electron emitting devices 410, the voltage applied to image forming members 416, the thickness of insulating layer 423, the distance between electron emitting devices 410 and image forming members 416, and other factors. Ordinarily, it is within in the range of −5 to −30 V but, of course, is not limited to this range.

This apparatus is driven in the same manner as Embodiment 23. However, if the voltage applied to correction electrodes 4118 is changed from −5 to −15 V and further to −30 V, the uniformity of electron beams is improved. Further, if the voltage applied to each image forming member 416 is changed from 50 to 1 kV while the voltage applied to correction electrode 4118 is fixed to −20 V, the degree of convergence is increased with the potential change therebetween so that the luminance is increased. It is thought that this effect is due to a phenomenon in which the locus of electrons reaching the image forming member 416, specifically the locus of electrons reaching opposite end portions of the image forming member 416 (the end closest to the electron emitting device 410 and the end furthest from the same) is bent more inwardly.

Embodiment 31

Figure 53:
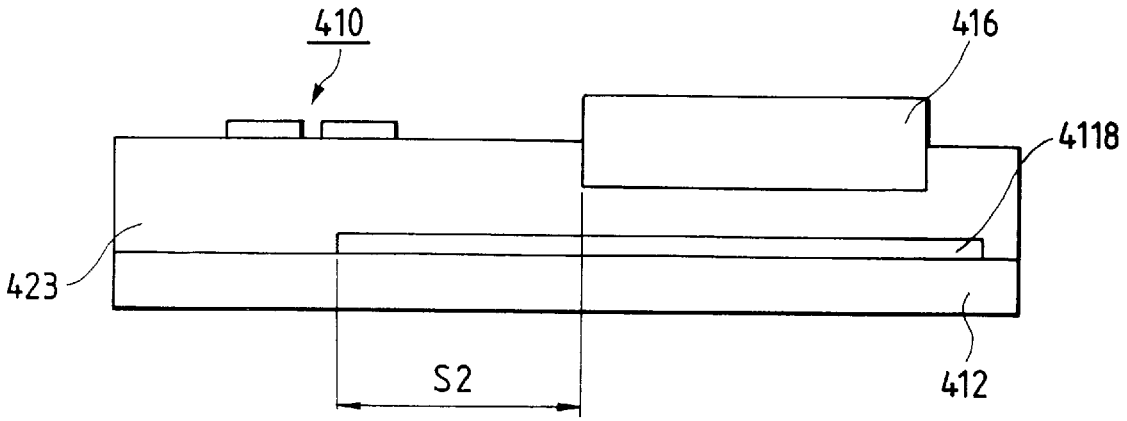

FIG. 53 is a cross-sectional view of a portion of an image forming apparatus in accordance with a thirty-first embodiment of the present invention. The construction of this embodiment is the same as that of Embodiment 30 except that the distance S2 between the ends of each correction electrode 4118 and the corresponding image forming member 416 on the electron emitting device 410 side is set to 220 μm.

By this arrangement, an electric field is applied to a space between image formation member 416 and electron emitting device 410 from a position below this space, so that the degree of electron beam convergence is further improved and the uniformity of the resulting image is thereby improved. It is also possible to increase the voltage applied to image forming members 416.

Embodiment 32

Figure 54:
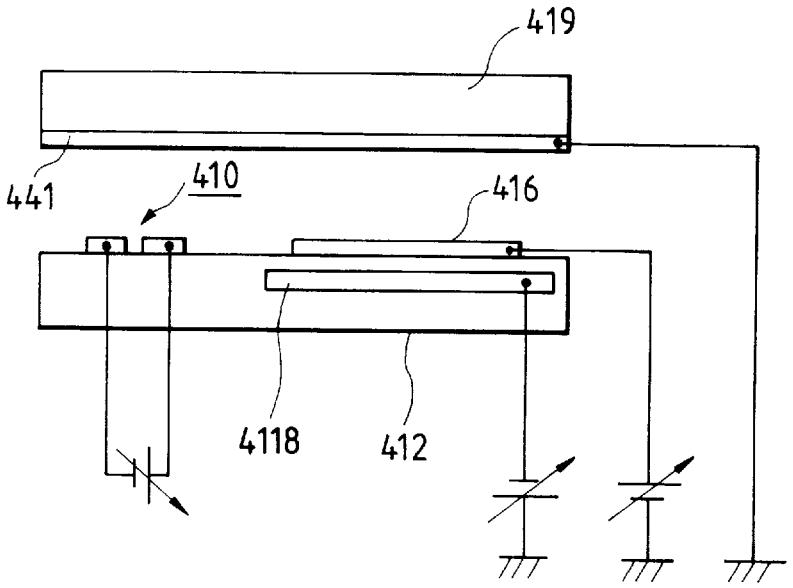

FIG. 54 is a cross-sectional view of a portion of an image forming apparatus in accordance with a thirty-second embodiment of the present invention which corresponds to one electron emitting device. The construction of this apparatus is the same as that of Embodiment 30 except that ITO 441 is vapor-deposited on an inner surface of a plate 419 and is grounded.

In this apparatus, even if the voltage applied to image forming members 416 is increased to 1.5 kV or higher, occurrence of a disturbance of the formed image observed in the case of Embodiment 30 can be prevented. The reason for this effect is thought to be because no charge-up occurs at the inner surface of the plate and no electron beam disturbance therefore occurs.

On the other hand, even if the distance between the insulating substrate 412 and the plate 419 is reduced to 3 mm, no considerable image disturbance occurs. It is therefore possible to reduce the overall thickness of the apparatus.

Embodiment 33

This embodiment has the same construction as Embodiment 32, but the voltage of correction electrodes 4118 and ITO 441 are equalized to enable an improvement in the effect of correction electrodes 4118. It is thought that this improvement effect is based on the principle of a beam guide formed by ITO 441 and correction electrodes 4118.

Embodiment 34

The apparatus in accordance with this embodiment is constructed based on Example 28 or 29 and a light emission source in accordance with one of Embodiments 30 to 33 is used as light emission source 348. This embodiment also has the same effect as Embodiments 28 or 29.

Embodiment 35

Figure 55:
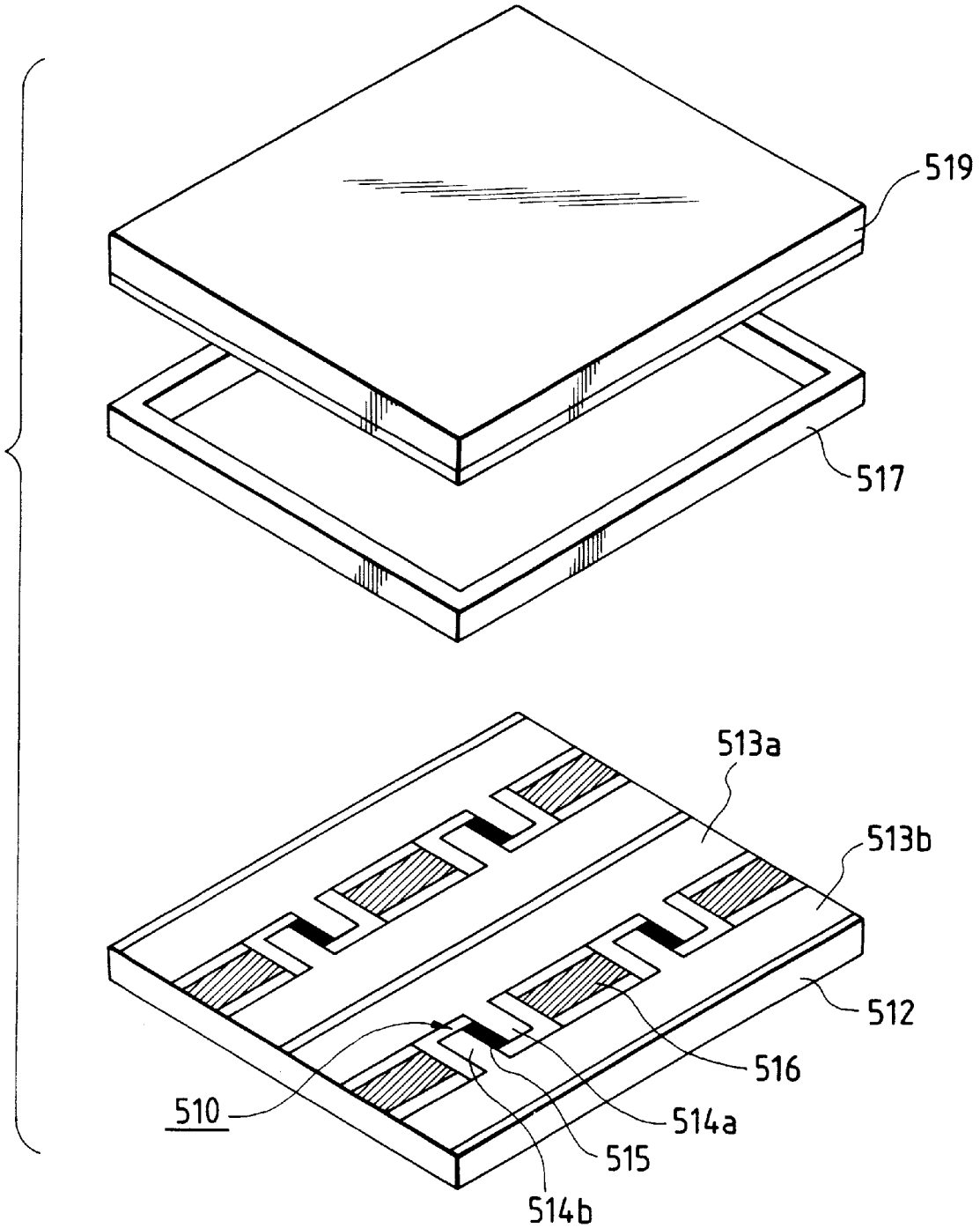
Figure 57:
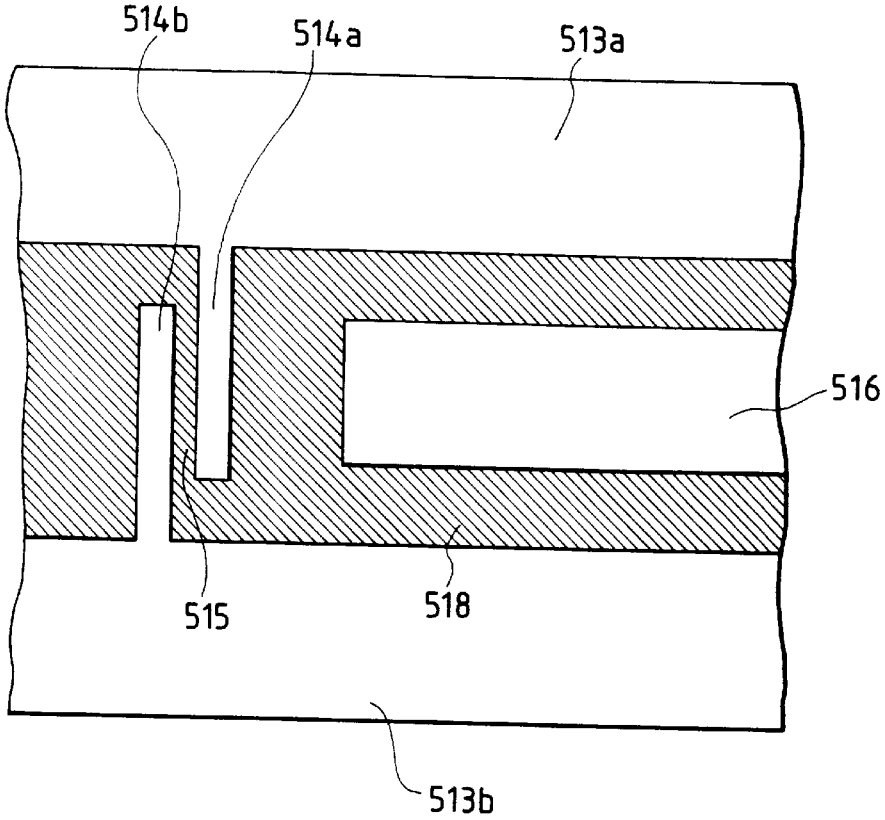

FIG. 55 is a perspective view of an image forming apparatus in accordance with a thirty-fifth embodiment of the present invention, FIG. 56 is an enlarged sectional view of a portion of the apparatus shown in FIG. 55, and FIG. 57 is a plan view of the portion shown in FIG. 56, and FIG. 58 is a cross-sectional view taken along the line A–A' of FIG. 56. As shown in these figures, this apparatus includes electron emitting devices 510 which have pairs of plus and minus electrodes 514*a* and 514*b* and each of which emits electrons when a voltage is applied between the corresponding pair of electrodes, and image forming members 516 which form an image when irradiated with beams of electrons emitted from the electron emitting devices 510. These devices and members are provided on an insulating substrate 512. The creeping distance from each image forming member 516 to the electron emitting device 510 located on the substrate 512 closest to the the image forming member 516, or to device wiring electrodes 513*a* and 513*b* is at least twice as long as the distance in a straight line therebetween. A portion of the insulating substrate 512 around each image forming member 516 is grooved 518 so as to have a longitudinal sectional configuration having a plurality of projections or recesses, thereby increasing the creeping distance.

Plus and minus electrodes 514*a* and 514*b* of each electron emitting device 510 are connected to device wiring electrodes 513*a* and 513*b*, respectively. A group of electron emitting elements 510 connected to one pair of device wiring electrodes 513*a* and 513*b* forms a row of electron emitting devices which are driven simultaneously. Each row of image forming members 516 perpendicular to this row of the electron emitting devices are connected by unillustrated image forming member wiring electrodes. Therefore a plurality of device wiring electrodes 513*a* and 513*b* and the plurality of image forming member wiring electrodes are respectively arranged in rows so as to intersect each other and to form a matrix-like pattern. A face plate 519 is supported by a support frame 517 on the insulating substrate 512.

Each electron emitting device 510 has an electron emitting section 515 between electrodes 514*a* and 514*b*, and is constructed as a cold cathode type such that when a voltage is applied between these electrodes, electrons are emitted from the electron emitting section 515.

An example of a method of manufacturing this image forming apparatus will be described below. First, insulating substrate 512 is processed with fluoric acid to form grooved portion 518 thereon, and is sufficiently washed. Device electrodes 514*a* and 514*b* and image forming member wiring electrodes are thereafter formed of a Ni material by a vapor deposition technique and a photolithography technique ordinarily used. The image forming member wiring electrodes may be formed of any material other than Ni so long as its resulting electrical resistance is adequately small.

Next, insulating layers having a thickness of 3 μm are formed of $SiO_2$ by a vapor deposition technique. The insulating layers may be formed of a material selected from glass and other ceramic materials.

Thereafter, device wiring electrodes 513*a* and 513*b* are formed of a Ni material by a vapor deposition technique and an etching technique. At this time, device electrodes 514*a* and 514*b* are connected by device wiring electrodes 513*a* and 513*b* and have electron emitting sections 515 interposed between device electrodes 514*a* and 514*b* facing each other. The electrode gap G between device electrodes 514*a* and 514*b* (FIG. 58), which is preferably 0.1 to 10 μm, is set to 2 μm in this embodiment. The length L (FIG. 56) corresponding to each electron emitting section 515 is set to 300

μm. It is preferable to reduce the width W (FIG. 58) of the device electrodes 514*a* and 514*b*. In practice, however, this width is preferably 1 to 100 μm, more preferably 1 to 10 μm. Each electron emitting section 515 is formed at or in the vicinity of the center of adjacent image forming member wiring electrodes. The pairs of device wiring electrodes 513*a* and 513*b* are arranged with a 2 mm pitch, and electron emitting sections 515 are arranged with a 2 mm pitch in the direction along the device wiring electrodes.

Next, ultrafine particle films are formed between the opposed electrodes by a gas deposition method to provide electron emitting sections 515. Pd is used as the material of the ultrafine particles. The particle material may be selected from any other materials. Among possible materials, metallic materials, such as Ag and Au, and oxide materials, such as $SnO_2$ and $In_2O_3$, are preferred. In this embodiment, the diameter of Pd particles is set to about 100 Å, but this is not exclusive. Ultrafine particle films can also be formed between the electrodes by methods other than the gas deposition method, e.g., a method of applying an organic metal and thereafter heat-treating this metal, which also ensures the desired device characteristics.

Next, image forming members 516 made of a luminescent material are formed by a printing method to have a thickness of about 10 μm. Image forming members 516 may be formed by a different method, e.g., a slurry method or precipitation method.

Face plate 519 is provided on insulating substrate 512 on which the electron emitting devices and other components are formed as described above, with support frame 517 interposed therebetween, so that face plate 519 is spaced apart from insulating substrate 512 by 5 mm, thereby completing the image forming apparatus.

Next, a method of driving this apparatus will be described below. A pulse voltage of 14 V is applied between one of the pairs of device wiring electrodes 513*a* and 513*b* to emit electrons from electron emitting sections 515 of the row of electron emitting devices connected to these electrodes. A beam of electrons emitted from each electron emitting section 515 flies in the direction of the plus device electrode 514*a* and is thereafter changed in an on-off control manner by a voltage of 10 to 1,000 V applied to image forming member wiring electrode 520 in accordance with an information signal. That is, an electron beam on-controlled is accelerated to collide against image forming member 516 adjacent to the plus device electrode 514*a* to make this image forming member emit light, while an electron beam off-controlled does not make the image forming member 516 emit light. This applied voltage is determined according to the kind of luminescent material used and the necessary luminance and is not specifically limited to the above range. When one-line display on the corresponding row of image forming members 516 in accordance with the information signal is thereby completed, the next adjacent pair of device wiring electrodes 513*a* and 513*b* is selected, and a pulse voltage of 14 V is applied between this pair of device wiring electrodes to effect display of the next line in the same manner. This operation is repeated to form a one-frame image. That is, device wiring electrodes 513*a* and 513*b* are used as scanning electrodes, and these scanning electrodes and image forming member wiring electrodes 520 form an X-Y matrix to display the image.

In accordance with this embodiment, each electron emitting device 510 is of a surface conduction type and is capable of being driven in response to a voltage pulse of 100 picoseconds or shorter, and therefore enables formation of 10,000 or more scanning lines in 1/30 second. There is no risk of electron emitting devices 510 being damaged by ion bombardment so that luminance unevenness is caused, because electron emitting devices 510 and image forming members 516 are formed on the same substrate 512, grooved sections 518 are formed between electron emitting devices 510, wiring electrodes and other members for the same and image forming members 516, and an electron beam is converged to each image forming member 516 by the voltage applied to the image formation member 516. It is therefore possible for the image forming apparatus to uniformly display images with desired stability during long-time use. That is, if a surface conduction type electron emitting device is used, electrons having an initial velocity of several bolts are emitted therefrom into a vacuum. The present invention is effective in modulating such an electron beam.

Also, a large-screen high-definition display can be obtained at a low cost because electron emitting devices 510 and image forming members 516 can be aligned easily and because they can be formed by the thin film manufacture techniques. Further, the distance between electron emitting sections 515 and image forming members 516 can be determined with high accuracy, so that an image display apparatus capable of displaying a very uniform image free from luminance unevenness can be obtained. If device electrodes 514 are formed together with image forming members 516 by a printing method, the device alignment can be effected more easily.

Embodiment 36

An apparatus in accordance with this embodiment has the same construction as Embodiment 35 and is manufactured in the same manner except that both the pitch of the arrangement of each pair of device wiring electrodes 513*a* and 513*b* and the pitch of the arrangement of electron emitting sections 515 along the device wiring electrodes are set to 1 mm. However, the voltage applied to image forming members 516 during driving is 20 to 800 V.

This embodiment achieves the same effect as Embodiment 35 while reducing the pixel pitch, that is, an image forming apparatus further improved in resolution can be obtained.

Embodiment 37

This embodiment is constructed based on Embodiment 35 in such a manner that ITO electrodes in the form of strips are provided on a surface of a face plate 519 in positions such as to face image forming members 516 and image forming member wiring electrodes 520. While a constant voltage is applied to the image forming member wiring electrodes 520, voltages in accordance with an information signal are applied to the ITO electrodes to control the operation of turning on/off the emission of electron beams. A voltage of 2 kV is applied to the image forming members 516. In this case, a modulation through the ITO electrode is more preferable than a modulation with a voltage applied to the image forming member 516. This embodiment achieves a further improvement in the luminance of the displayed image.

Embodiment 38

Luminescent members having three colors, red, green and blue are used as image forming members 516, are repeatedly arranged and are connected by image forming member wiring electrodes with respect to the colors to enable a full-color display in which three color elements constitute one pixel. Except for this, the apparatus has the same construction as Embodiment 35 and is manufactured in the same manner.

This embodiment has the same effect as Embodiment 35 and enables stable image formation free from color unevenness and color misalignment.

Embodiment 39

An optical printer of the type shown in FIG. 41 was constructed by using as a light emission source 348 one of the image forming apparatuses in accordance with Embodiments 35 to 38 to perform image recording in the same manner as Embodiment 21.

A uniform, high-contrast and clear recording pattern can thereby be formed at a high speed.

Embodiment 40

An optical printer of the type shown in FIG. 43 was constructed by using the same light emission source 348 as Embodiment 39 to perform image recording.

A high-contrast, a clear and high-resolution image free from exposure unevenness can thereby be formed at a high speed by virtue of the above-mentioned advantages of the light emission source 348.

Embodiment 41

Figure 59:
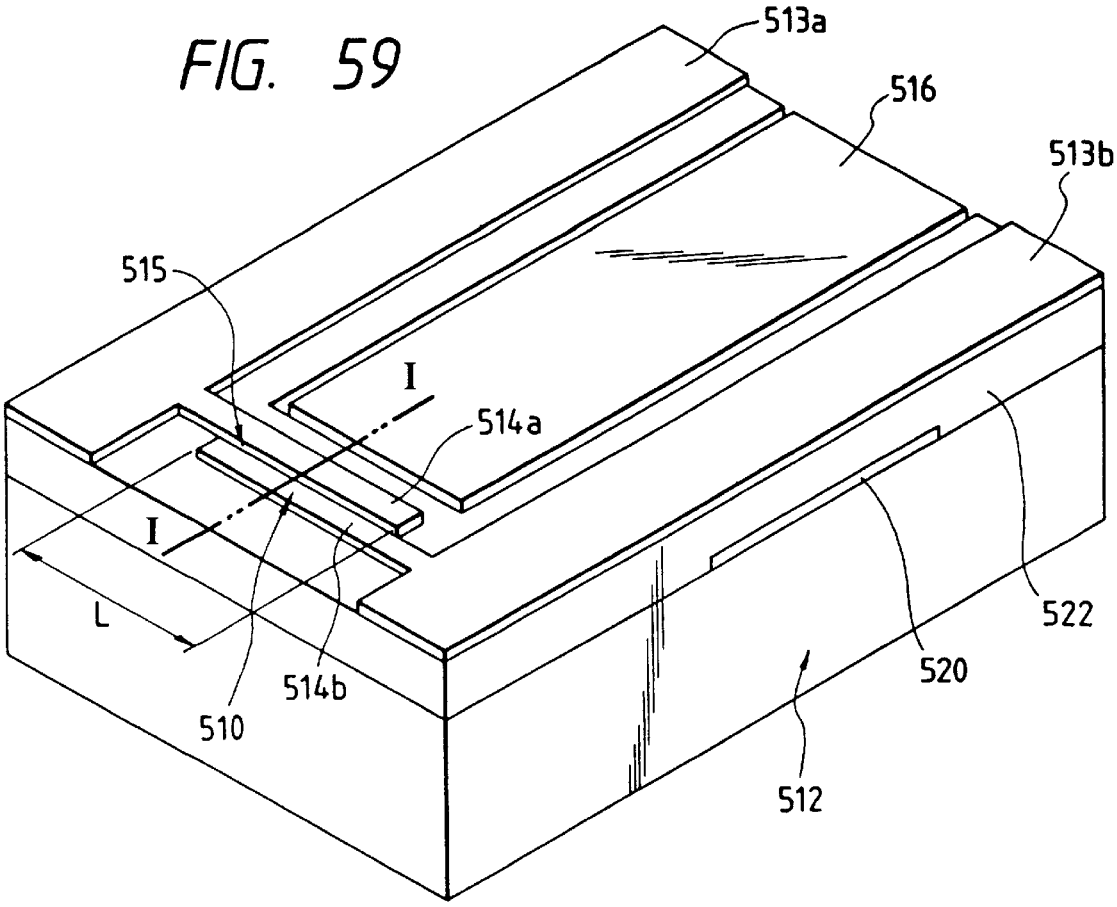
Figure 60:
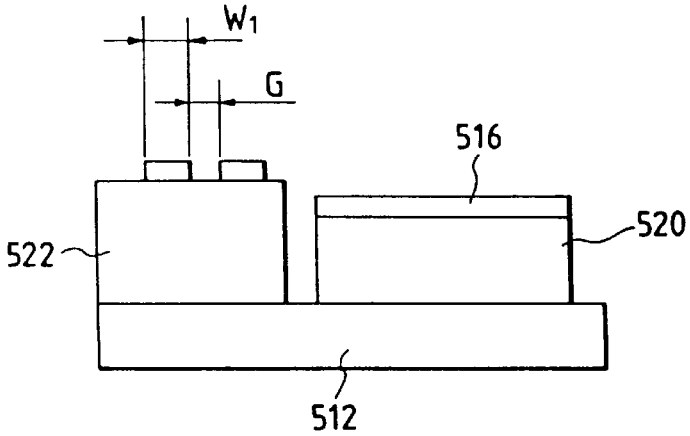

FIGS. 59 and 60 show an image forming apparatus in accordance with a forty-first embodiment of the present invention which has generally the same appearance as that shown in FIG. 55. FIG. 59 is an enlarged sectional view of a portion of this, and FIG. 60 is a cross-sectional view taken along the line A–A' of FIG. 59. As shown in these figures, this apparatus includes electron emitting devices 510 which have pairs of plus and minus electrodes 514*a* and 514*b* and each of which emits electrons when a voltage is applied between the corresponding pair of electrodes, and image forming members 416 which are formed of a luminescent material and which form an image when irradiated with beams of electrons emitted from the electron emitting devices 510. These devices and members are provided on an insulating substrate 512. The surface of each image forming member 516 is positioned at a level lower than the electron emitting surface of the electron emitting devices 510.

Plus and minus electrodes 514*a* and 514*b* of each electron emitting device 510 are connected to device wiring electrodes 513*a* and 513*b*, respectively. A group of electron emitting elements 510 connected to one pair of device wiring electrodes 513*a* and 513*b* forms a row of electron emitting devices which are driven simultaneously. Each row of image forming members 516 perpendicular to this row of the electron emitting devices are connected by image forming member wiring electrodes 520. Therefore a plurality of device wiring electrodes 513*a* and 513*b* and a plurality of image forming member wiring electrodes 520 are respectively arranged in rows so as to intersect each other and to form a matrix-like pattern. A face plate 519 is supported by a support frame 517 on the insulating substrate 512.

Each electron emitting device 510 has an electron emitting section 515 between electrodes 514*a* and 514*b*, and is constructed as a cold cathode type such that when a voltage is applied between these electrodes, electrons are emitted from the electron emitting section 515.

An example of a method of manufacturing this image forming apparatus will be described below. First, insulating substrate 512 is sufficiently washed. Image forming member wiring electrodes 520 are thereafter formed of a Ni material by a vapor deposition technique and a photo-lithography technique ordinarily used. Image forming member wiring electrodes 520 may be formed of any material other than Ni so long as its resulting electrical resistance is adequately small.

Next, insulating layers 522 having a thickness of 3 $\mu$m are formed of $SiO_2$ except an image forming member portion by a vapor deposition technique and an etching technique. The insulating layers 522 may be formed of a material selected from glass and other ceramic materials.

Thereafter, device wiring electrodes 513*a* and 513*b* and device electrodes 514*a* and 514*b* are formed of a Ni material on the insulating layers 522 by a vapor deposition technique and an etching technique. At this time, device electrodes 514*a* and 514*b* are connected by device wiring electrodes 513*a* and 513*b* and have electron emitting sections 515 interposed between device electrodes 514*a* and 514*b* facing each other. The electrode gap G between device electrodes 514*a* and 514*b*, which is preferably 0.1 to 10 $\mu$m, is set to 2 $\mu$m in this embodiment. The length L (FIG. 59) corresponding to each electron emitting section 515 is set to 300 $\mu$m. It is preferable to reduce the width W1 (FIG. 60) of the device electrodes 514*a* and 514*b*. In practice, however, this width is preferably 1 to 100 $\mu$m, more preferably 1 to 10 $\mu$m. Each electron emitting section 515 is formed at or in the vicinity of the center of adjacent image forming member wiring electrodes 520. The pairs of device wiring electrodes 513*a* and 513*b* are arranged with a 2 mm pitch, and electron emitting sections 515 are also arranged with a 2 mm pitch.

Next, ultrafine particle films are formed between the opposed electrodes by a gas deposition method to provide electron emitting sections 515. Pd is used as the material of the ultrafine particles. The particle material may be selected from any other materials. Among possible materials, metallic materials, such as Ag and Au, and oxide materials, such as $SnO_2$ and $In_2O_3$, are preferred. In this embodiment, the diameter of Pd particles is set to about 100 Å, but this is not exclusive. Ultrafine particle films can also be formed between the electrodes by methods other than the gas deposition method, e.g., a method of applying an organic metal and thereafter heat-treating this metal, which also ensures the desired device characteristics.

Figure 61:
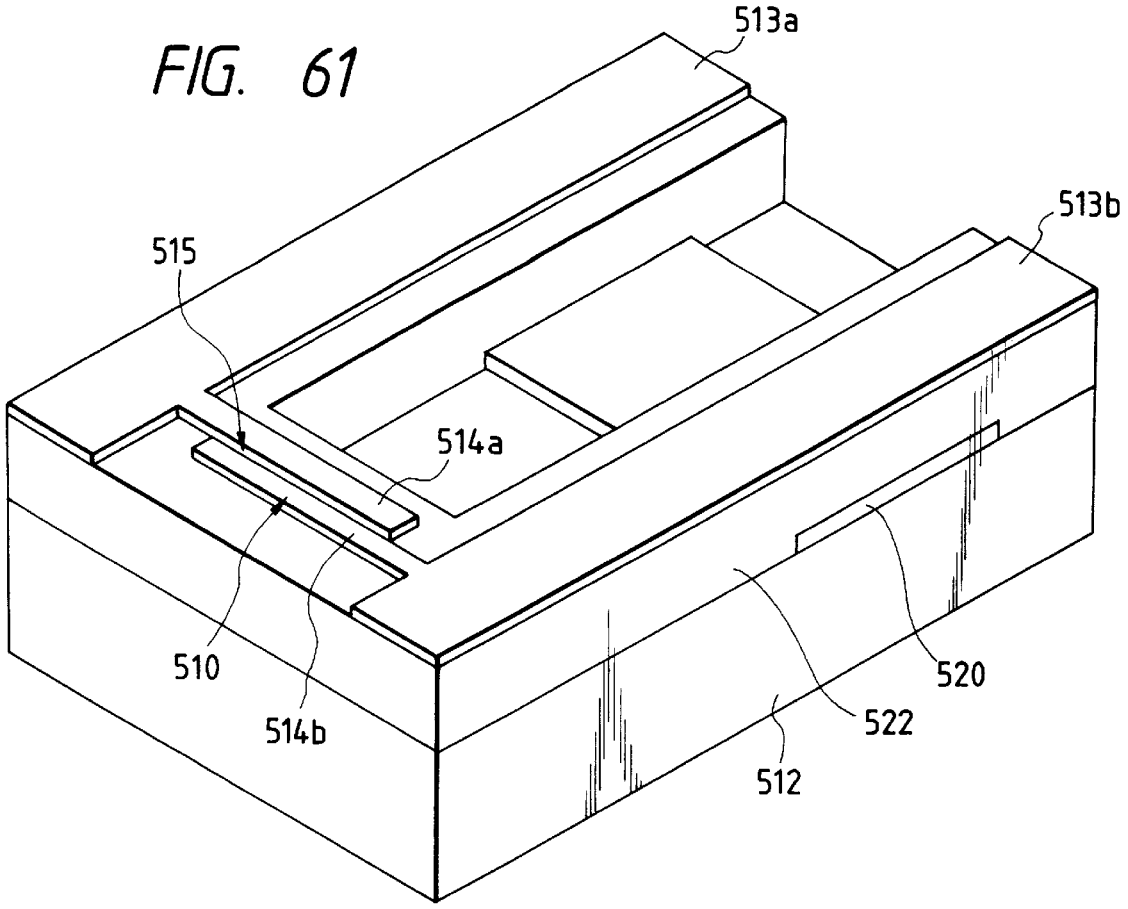

Next, image forming members 516 made of a luminescent material are formed by a printing method to have a thickness of about 10 $\mu$m. Image forming members 516 may be formed by a different method, e.g., a slurry method or precipitation method. Image forming members, 516 are thereby formed so that their surfaces are lower than the surfaces of electrodes 514*a* and 514*b*. FIG. 61 shows a state before image forming members 516 are formed.

Face plate 519 is provided on insulating substrate 512 on which the electron emitting devices and other components are formed as described above, with support frame 517 interposed therebetween, so that face plate 519 is spaced apart from insulating substrate 512 by 5 mm, thereby completing the image forming apparatus.

Next, a method of driving this apparatus will be described below. A pulse voltage of 14 V is applied between one of the pairs of device wiring electrodes 513*a* and 513*b* to emit electrons from electron emitting sections 515 of the row of electron emitting devices connected to these electrodes. A beam of electrons emitted from each electron emitting section 515 flies in the direction of the plus device electrode 514*a* and is thereafter changed in an on-off control manner by a voltage of 10 to 1,000 V applied to image forming member wiring electrode 520 in accordance with an information signal. That is, an electron beam on-controlled is accelerated to collide against image forming member 516 adjacent to the plus device electrode 514*a* to make this image forming member emit light, while an electron beam off-controlled does not make the image forming member 516 emit light. This applied voltage is determined according to the kind of luminescent material used and the necessary luminance and is not specifically limited to the above range. When one-line display on the corresponding row of image forming members 516 in accordance with the information signal is thereby completed, the next adjacent pair of device wiring electrodes 513*a* and 513*b* is selected, and a pulse voltage of 14 V is applied between this pair of device wiring electrodes to effect display of the next line in the same manner. This operation is repeated to form a one-frame image. That is, the device wiring electrodes 513*a* and 513*b* are used as scanning electrodes, and these scanning electrodes and image forming members wiring electrodes 520 form an X-Y matrix to display the image.

Figure 64:
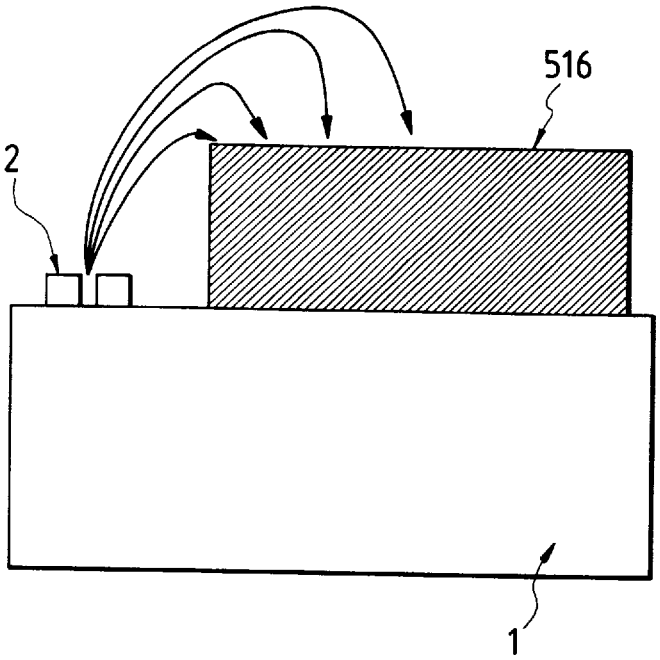
FIGS. 64 and 65 are diagrams showing changes in electron beam loci with respect to a case where the image forming member surface is higher than the electron emitting element surface and another case where the former is lower than the latter.
Figure 65:
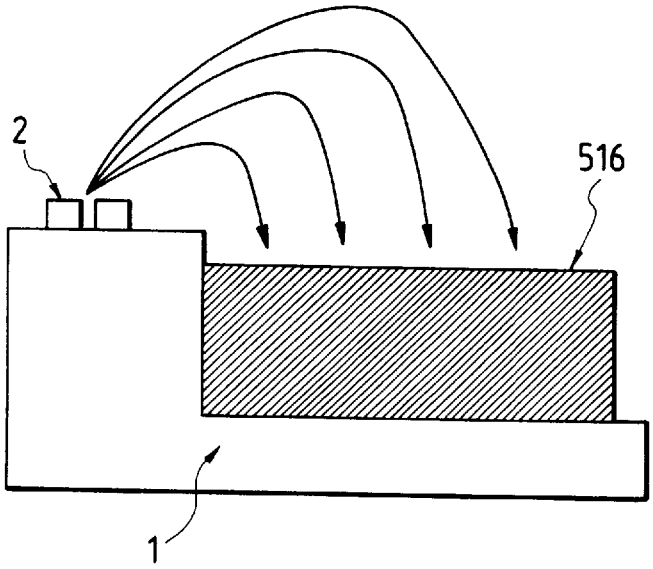

In accordance with this embodiment, each electron emitting device 510 is of a surface conduction type and is capable of being driven in response to a voltage pulse of 100 picoseconds or shorter, and therefore enables formation of 10,000 or more scanning lines in 1/30 second. Since electron emitting devices 510 and image forming members 516 are formed on the same substrate 512, there is no risk of the electron emitting devices 510 being damaged by ion bombardment so that luminance unevenness is caused. Moreover, since the surface of each image forming member 516 is lower than the electron emitting surface of the electron emitting devices 510, electron beams can be uniformly converged to image forming members 516 as shown in FIG. 65, without being concentrated in the vicinity of end surfaces thereof as in the case of the arrangement shown in FIG. 64 in which the surface of image forming member 516 is high. It is therefore possible to uniformly display images with desired stability during long-time use. That is, if a surface conduction type electron emitting device is used, electrons having an initial velocity of several bolts are emitted therefrom into a vacuum. The present invention is effective in modulating such an electron beam.

Also, a large-screen high-definition display can be obtained at a low cost because electron emitting devices 510 and image forming members 516 can be aligned easily and because they can be formed by the thin film manufacture techniques. Further, the distance between the electron emitting sections 515 and the image forming members 516 can be determined with high accuracy, so that an image display apparatus capable of displaying a very uniform image free from luminance unevenness can be obtained. If device electrodes 514 are formed together with image forming members 516 by a printing method, the device alignment can be effected more easily.

Embodiment 42

Figure 63:
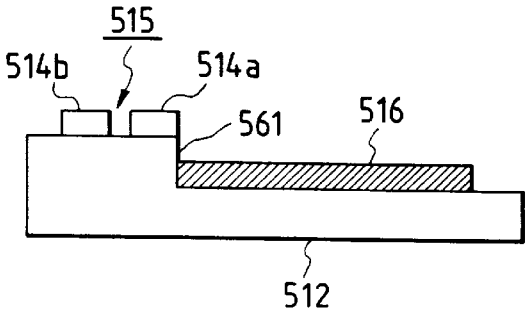

FIG. 63 is an enlarged cross-sectional view of a portion of an image forming apparatus in accordance with a forty-second embodiment of the present invention. In this apparatus, the surface of each image forming member 516 is lower than a bottom of device electrodes 514*a* and 514*b* of electron emitting devices 510, the distance between each device electrodes 514*a* and the mating image forming member 516 in the horizontal direction is zero, and both the pitches of arrangement of device wiring electrodes 513*a* and 513*b* and electron emitting sections 515 are 1 mm. Except for these points, the apparatus has the same construction as Embodiment 41 and is manufactured in the same manner.

Figure 62:
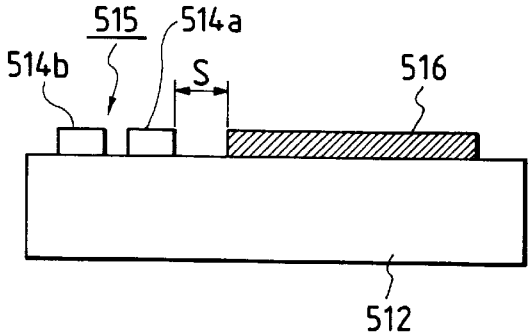

In this embodiment, device electrode 514*a* of each electron emitting device 510 and adjacent image forming member are insulated by a step surface 561 alone, Accordingly, the distance S therebetween can be reduced, in comparison with the arrangement shown in FIG. 62 in which the distance S between electron emitting device 515 and image forming member 516 in the horizontal direction is set to a certain value, and can be reduced to zero. The same effect as that in Embodiment 41 can thereby be obtained. It is therefore possible to effect high-resolution image formation with pixels arranged at a smaller pitch.

Embodiment 43

This embodiment is constructed based on Embodiment 41 in such a manner that ITO electrodes in the form of strips are provided on a surface of a face plate 519 in positions such as to face image forming members 516 and image forming member wiring electrodes 520. While a constant voltage is applied to image forming member wiring electrodes 520, voltages in accordance with an information signal are applied to the ITO electrodes to control the operation of turning on/off the emission of electron beams. A voltage of 2 kV is applied to image forming members 516. In this case, a modulation through the ITO electrode is more preferable than a modulation with a voltage applied to image forming member 516. This embodiment achieves a further improvement in the luminance of the displayed image.

Embodiment 44

Luminescent members having three colors, red, green and blue are used as image forming members 516, are repeatedly arranged and are connected by image forming member wiring electrodes 520 with respect to the colors to enable a full-color display in which three color elements constitute one pixel. Except for this, the apparatus has the same construction as Embodiment 41 and is manufactured in the same manner.

This embodiment has the same effect as Embodiment 41 and thereby enables image formation free from color unevenness and color misalignment.

Embodiment 45

An optical printer of the type shown in FIG. 41 was constructed by using as a light emission source 348 one of the image forming apparatuses in accordance with Embodiments 41 to 44 to perform image recording in the same manner as Embodiment 21.

A uniform, high-contrast and clear recording pattern can thereby be formed at a high speed.

Embodiment 46

An optical printer of the type shown in FIG. 43 was constructed by using the same light emission source 348 as Embodiment 45 to perform image recording.

A high-contrast, a clear and high-resolution image free from exposure unevenness can thereby be formed at a high speed by virtue of the above-mentioned advantages of the light emission source 348.

Embodiment 47

Figure 67:
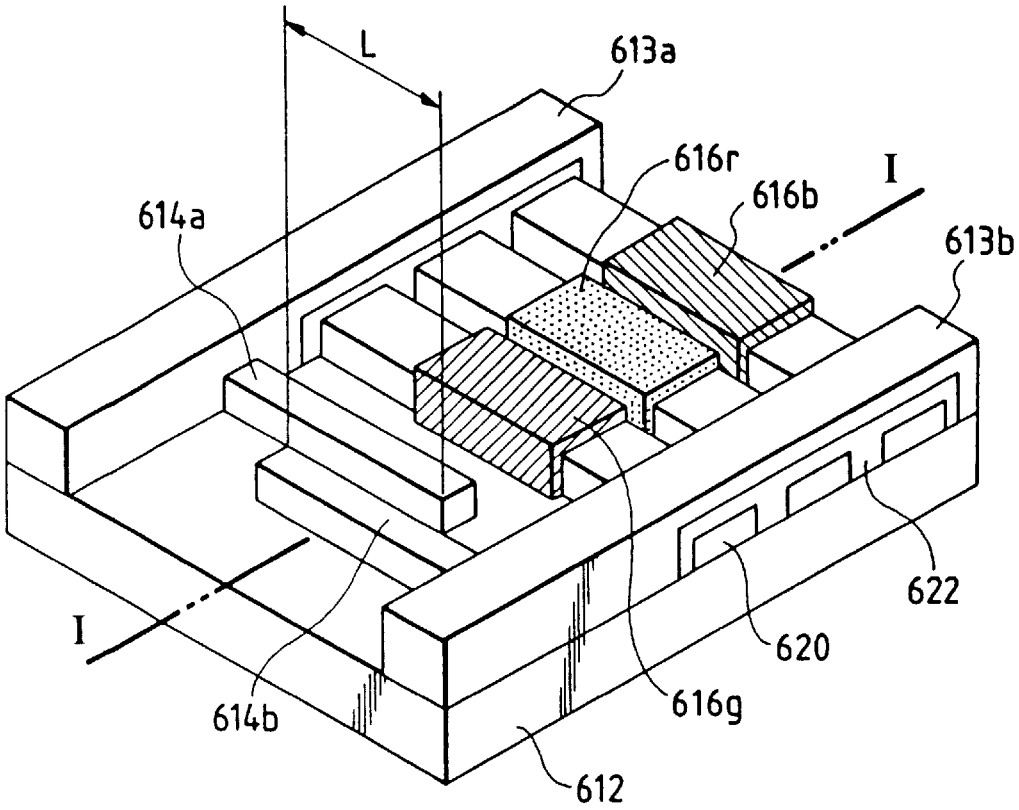
Figure 68:
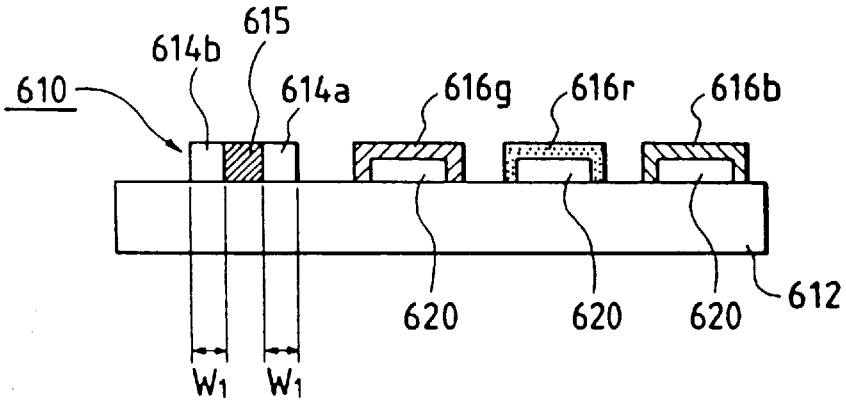

FIG. 66 is a perspective view of an image forming apparatus in accordance with a forty-seventh embodiment of the present invention, FIG. 67 is an enlarged perspective view of a portion of the apparatus shown in FIG. 66, and FIG. 68 is a cross-sectional view taken along the line A–A' of FIG. 67. As shown in these figures, this apparatus has electron emitting devices 610, luminescent members 616 (616*r*, 616*g*, 616*b*), and unillustrated voltage application means for applying predetermined voltages to luminescent members 616. Each electron emitting device 610 emits electron beams so that the corresponding group of luminescent members 616*r*, 616*g*, and 616*b* emit light by these electron beams in accordance with the voltages applied thereto. Luminescent members 616 thereby form an image light emission pattern in accordance with the applied voltages. Electron emitting devices 610 and luminescent members 616 are juxtaposed on a surface of an insulating substrate 612. Voltages are applied to the luminescent members 616 in each group separately and independently by voltage application means.

Each electron emitting device 610 has plus and minus device electrodes 614*a* and 614*b* facing each other, and emits electrons when a voltage is applied between these electrodes.

Plus and minus electrodes 614*a* and 614*b* of each electron emitting device 610 are connected to device wiring electrodes 613*a* and 613*b*, respectively. A group of electron emitting elements 610 connected to one pair of device wiring electrodes 613*a* and 613*b* forms a row of electron emitting devices which are driven simultaneously. Each row of luminescent members 616 perpendicular to this row of the electron emitting devices are connected by luminescent member wiring electrodes 620. Therefore a plurality of device wiring electrodes 613*a* and 613*b* and a plurality of luminescent member wiring electrodes 620 are respectively arranged in rows so as to intersect each other and to form a matrix-like pattern. Device wiring electrodes 613*a* and 613*b* and luminescent member wiring electrodes 620 are electrically insulated from each other by an insulating material 622. A face plate 619 is supported by a support frame 617 on the insulating substrate 612.

Each electron emitting device 610 has an electron emitting section 615 between electrodes 614*a* and 614*b*, and is constructed as a cold cathode type such that when a voltage is applied between these electrodes, electrons are emitted from the electron emitting section 615.

An example of a method of manufacturing this image forming apparatus will be described below. First, insulating substrate 612 is sufficiently washed. Device electrodes 614*a* and 614*b* and three luminescent member wiring electrodes 620 with respect to each pair of device electrodes 614*a* and 614*b* are thereafter formed of a Ni material by a vapor deposition technique and a photolithography technique ordinarily used. The luminescent member wiring electrodes 620 may be formed of any material other than Ni so long as its resulting electrical resistance is adequately small.

Next, insulating layers 622 having a thickness of 3 $\mu$m are formed of $SiO_2$ by a vapor deposition technique. The insulating layers 622 may be formed of a material selected from glass and other ceramic materials.

Thereafter, device wiring electrodes 613*a* and 613*b* are formed of a Ni material by a vapor deposition technique and an etching technique. At this time, device electrodes 614*a* and 614*b* are connected by device wiring electrodes 613*a* and 613*b* and have electron emitting sections 615 interposed between device electrodes 614*a* and 614*b* facing each other. The electrode gap G between device electrodes 614*a* and 614*b*, which is preferably 0.1 to 10 $\mu$m, is set to 2 $\mu$m in this embodiment. The length L (FIG. 67) corresponding to each electron emitting section 615 is set to 300 $\mu$m. It is preferable to reduce the width W1 (FIG. 68) of the device electrodes 614*a* and 614*b*. In practice, however, this width is preferably 1 to 100 $\mu$m, more preferably 1 to 10 $\mu$m. Each electron emitting section 615 is formed at or in the vicinity of the center of adjacent luminescent member wiring electrodes 620. The pairs of device wiring electrodes 613*a* and 613*b* are arranged with a 1 mm pitch, and electron emitting sections 615 are arranged with a 1.5 mm pitch in the direction parallel to the device wiring electrodes.

Next, ultrafine particle films are formed between opposed device electrodes 614*a* and 614*b* by a gas deposition method to provide electron emitting sections 615. Pd is used as the material of the ultrafine particles. The particle material may be selected from any other materials. Among possible materials, metallic materials, such as Ag and Au, and oxide materials, such as $SnO_2$ and $In_2O_3$, are preferred. In this embodiment, the diameter of Pd particles is set to about 100 Å, but this is not exclusive. Ultrafine particle films can also be formed between the electrodes by methods other than the gas deposition method, e.g., a method of applying an organic metal and thereafter heat-treating this metal, which also ensures the desired device characteristics.

Next, green, red and blue luminescent members 616*g*, 616*r*, and 616*b* are formed by a printing method to have a thickness of about 10 $\mu$m. These luminescent members are arranged in this order from a position closer to the corresponding electron emitting device 610. Luminescent members 616 may be formed by a different method, e.g., a slurry method or precipitation method.

Face plate 619 is disposed on insulating substrate 612 on which the electron emitting devices and other components are formed as described above, with support frame 617 having a thickness of 5 mm interposed therebetween. Frit glass is applied between face plate 619 and support frame 617 and between insulating substrate 612 and support frame 617 and is fired at 430° C. for 10 minutes or longer to bond these members.

The interior of the glass container thus completed is evacuated with a vacuum pump. After a sufficient degree of vacuum has been reached, an operation for causing a current between each pair of device electrodes is performed and the glass container is finally sealed. The degree of vacuum is set to $10^{-6}$ to $10^{-7}$ to enable the apparatus to operate with improved stability.

Figure 69:
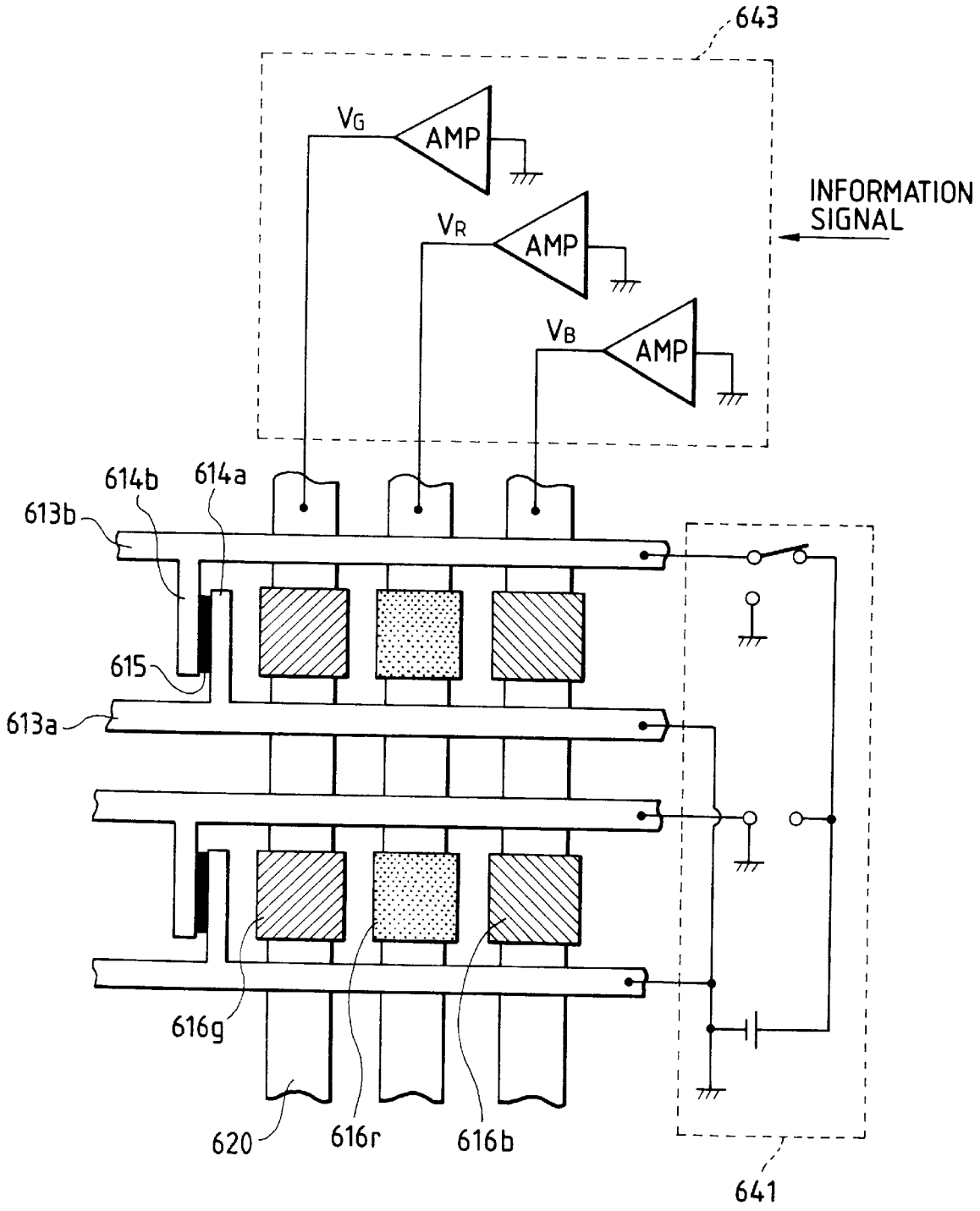

Next, a method of driving this apparatus will be described below. FIG. 69 is a diagram showing this driving method. When a pulse voltage of 14 V is applied between one of the pairs of device wiring electrodes 613*a* and 613*b* by a device driving circuit 641, electrons are emitted from electron emitting sections 615 of the row of electron emitting devices connected to these electrodes. Beams of electrons emitted from each electron emitting section 615 fly in the direction of the plus device electrode 614*a* and are thereafter changed in an on-off control manner by a ground potential or plus potential independently applied to luminescent members 616*g*, 616*r*, and 616*b* on the device electrode 614 side through luminescent member wiring electrodes 620 in accordance with an information signal. That is, the beam-on voltage is 100 V with respect to green luminescent member 616*g*, 300 V with respect to red luminescent member 616*r* and 500 V with respect to blue luminescent member 616*b*. These voltages are generated in a luminescent member driving circuit 643 based on the information signal to be applied to the luminescent wiring electrodes. The electron beam from the electron emitting device corresponding to each luminescent member to which the beam-on voltage is applied is accelerated to collide against this luminescent member to make the same emit light, thereby displaying one-line image. This applied voltage is determined by the kind of luminescent material used and the necessary luminance and is not limited to the above values.

When one-line display on the luminescent members corresponding to one pair of device wiring electrodes 613*a* and 613*b* in accordance with the information signal is thereby completed, the next adjacent pair of device wiring electrodes 613*a* and 613*b* is selected, and a pulse voltage of 14 V is applied between this pair of device wiring electrodes to effect display of the next line in the same manner. This operation is repeated to form a one-frame image. That is, device wiring electrodes 613*a* and 613*b* are used as scanning electrodes, and these scanning electrodes and luminescent member wiring electrodes 620 for the groups (trios) of red, green, and blue luminescent members 616*g*, 616*r*, and 616*b* form an X-Y matrix to display the image.

In accordance with this embodiment, each electron emitting device 610 is of a surface conduction type and is capable of being driven in response to a voltage pulse of 100 picoseconds or shorter, and therefore enables formation of 10,000 or more scanning lines in 1/30 second. Because electron beams are converged by the voltage applied to luminescent members 616 arranged on one substrate together with electron emitting devices in a horizontal direction, there is therefore no risk of electron emitting devices 610 being damaged by ion bombardment so that luminance unevenness is caused, and it is possible to uniformly form an image. That is, if a surface conduction type electron emitting device is used, electrons having an initial velocity of several bolts are emitted therefrom into a vacuum. The present invention is effective in modulating such an electron beam.

Also, a large-screen high-definition display can be obtained at a low cost because electron emitting devices 610 and luminescent members 616 can be aligned easily and because they can be formed by the thin film manufacture techniques. Further, the distance between electron emitting sections 615 and luminescent members 616 can be determined with high accuracy, so that an image display apparatus capable of displaying a very uniform image free from luminance unevenness can be obtained. If device electrodes 614*a* and 614*b* are formed together with luminescent members 616 by a printing method, the device alignment can be effected more easily.

Specifically, the apparatus is designed to irradiate a plurality of luminescent members with electron beams emitted from one electron emitting device. It is thereby possible to form pixels at a high density.

Embodiment 48

Figure 70:
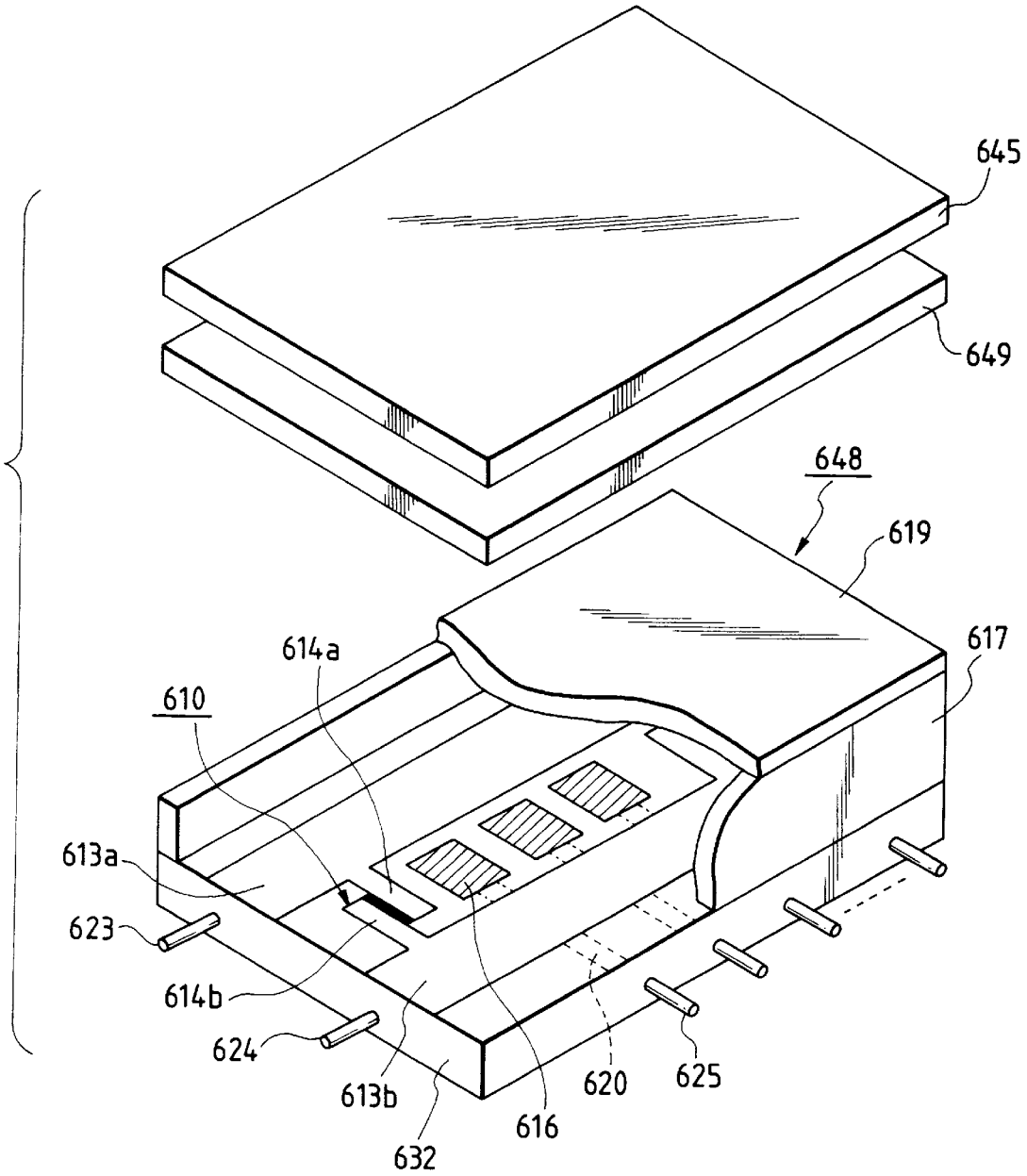
Figure 71:
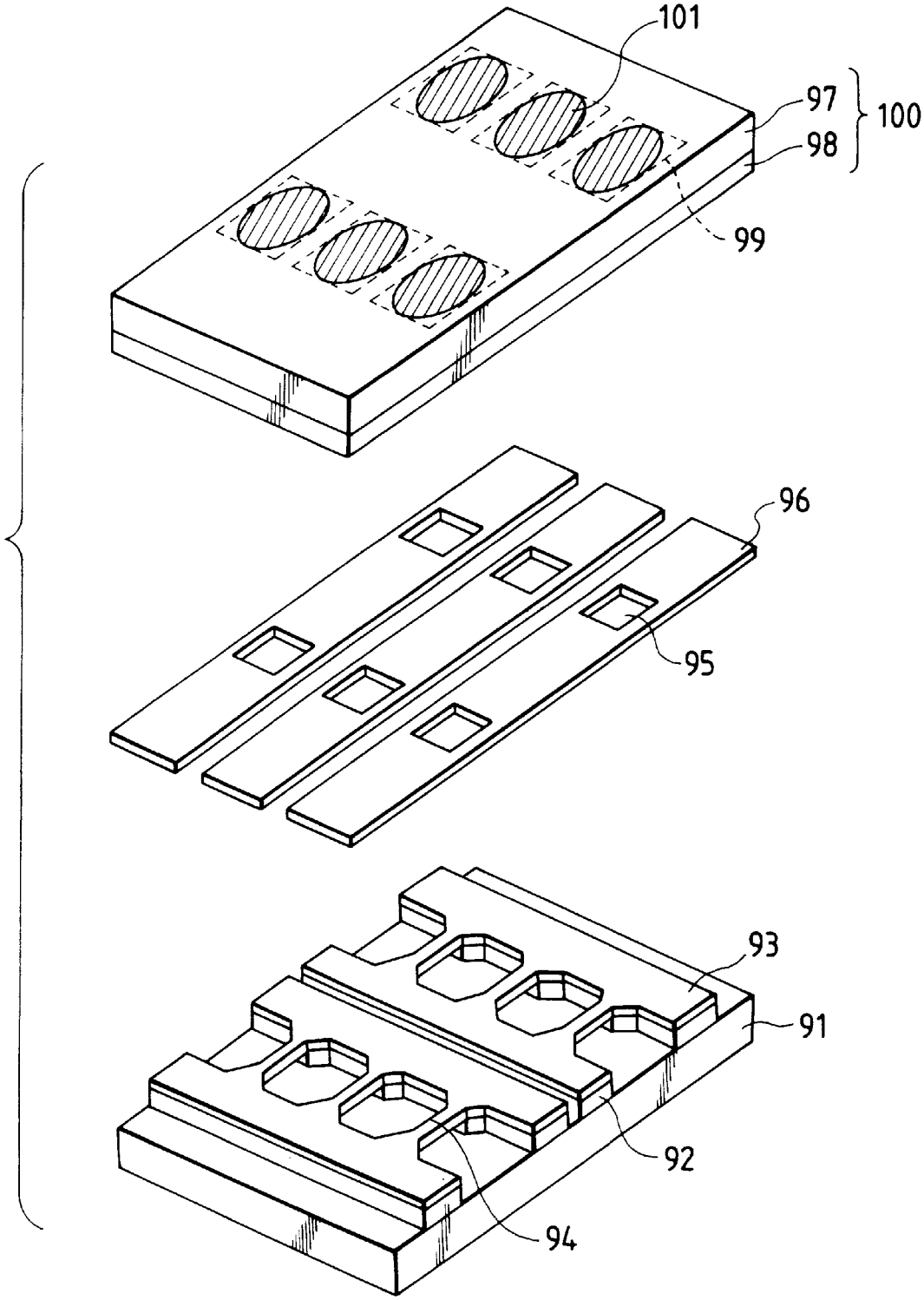
FIG. 71 is a schematic diagram of the construction of the conventional image forming apparatus.

FIG. 70 is a schematic diagram of an optical printer in accordance with a forty-eighth embodiment of the present invention. This apparatus has a light emission source 648, a lens array 649, and a recording member 645. The lens array 649 is ordinarily constituted of a SELFOC lens and is disposed between the light emission source 648 and the recording member 645 to image a luminescent point formed on each luminescent member 616 on the recording member 645.

The light emission source 648 is formed as an image forming apparatus in accordance with Embodiment 47 and has only one pair of device wiring electrodes 613*a* and 613*b*. It therefore has the same construction as the one-dimensional apparatus having only one row of electron emitting devices and is manufactured in the same manner. A vacuum container is formed by a face plate 619, a rear plate (insulating substrate) 632 and a support frame 617. One electron emitting device corresponds to three luminescent members. Therefore the method of driving the luminescent members of this apparatus and the driving voltage for this driving are the same as those in Embodiment 47 except that the luminescent members are disposed one-dimensionally. In this case, however, the luminescent members are prepared for monochromatic display.

A component 623 is a container exterior electrode for applying a voltage to the device wiring electrode 613*a* of a plus device electrode 614*a*, a component 624 is a container exterior electrode for applying a voltage to the device wiring electrode 613*b* of a minus device electrode 614*b*, and a component 625 is a container exterior electrode for applying a voltage to one luminescent member wiring electrode 620.

Recording member 645 is manufactured by uniformly applying a sensitive compound having a composition shown below to a polyethylene terephthalate film to have a thickness of 2 μm. This sensitive compound is prepared by dissolving, in 70 parts by weight of methyl ethyl ketone used as a solvent, a mixture of (a) 10 parts by weight of a binder: polyethylene methacrylate (commercial name: DIANAL BR, made by Mitsubishi Rayon), (b) 10 parts by weight of a monomer: trimethylol propane triacrylate (commercial name: TMPTA, made by Shin Nakamura Kagaku) and (c) 2.2 parts by weight of a polymerization initiator: 2-methyl-2-morpholino (4-thiomethyl phenyl) propane-1-xy (commercial name: IRGACURE 907, made by CIBA-GEYGY). A silicate luminescent material (Ba, Mg, Zn)$_3$Si$_2$O$_7$:Pb$^{2+}$ is used as a luminescent material constituting the luminescent members.

To form a desired light emission pattern in the optical printer thus constructed, a voltage pulse of 14 V is first applied between each device electrodes 614*a* and 614*b* through container exterior electrodes 623 and 624 to make each electron emitting device 610 emit electrons. Then, voltages are applied to luminescent members 616 through container exterior electrodes 625. The values of these voltages are controlled in accordance with an information signal with respect to application time and on/off states. The emission time and the emission pattern are thereby controlled. The emission pattern for one image line is thereby formed on the luminescent members. Recording member 645 is irradiated with beams of light having this emission pattern through lens array 649. Recording member 645 is photopolymerized and set in accordance with the emission pattern, thereby forming a one-line image.

Next, light emission source 648 and recording member 645 are relatively moved to an extent corresponding to one line to effect image formation for the next one line in the same manner. This operation is repeated to form the desired image on recording member 645.

The relative movement of light emission source 648 and recording member 645 in synchronization with the one-line image formation timing is effected by driving transport rollers 353 while supporting recording member 345 with support member 352 as shown in FIG. 41.

A photopolymerized pattern thereby formed on recording member 645 is developed by methyl ethyl ketone to form an optical recording pattern in accordance with the information signal on the polyethylene terephthalate film.

A uniform, high-contrast and clear optical recording pattern can thereby be formed at a high speed. In this embodiment, since electrons are emitted from one electron emitting device to a plurality of luminescent members, a high-resolution image can be obtained as described above.

What is claimed is:

1. An image forming apparatus comprising:

a plurality of electron emitting devices emitting electron beams, with each said electron emitting device having a pair of electrodes;

a plurality of image forming members which form an image when irradiated with the electron beams emitted from said electron emitting devices, with each said electron emitting device corresponding to one or more of said image forming members;

a substrate for supporting said electron emitting devices and said image forming members, wherein said pair of electrodes of said electron emitting devices and said image forming members are juxtaposed on a surface of said substrate;

a correction electrode for controlling a flying direction of flying of the electron beams emitted by said electron emitting devices, wherein said correction electrode is insulated between said image forming members and said electron emitting devices; and a voltage applying electrode for applying a desired voltage to said image-forming members, with said image forming members located on said voltage applying electrode.

2. An image forming apparatus according to claim 1, wherein said correction electrode is disposed below each said image forming member with an insulating layer interposed therebetween.

3. An image forming apparatus according to claim 2, further comprising voltage prescription means for prescribing a potential above said substrate.

4. An image forming apparatus according to claim 1, wherein said image forming members are is provided with modulation means for modulating the electron beams emitted from said electron emitting devices in accordance with an information signal.

5. An image forming apparatus according to claim 4, further comprising voltage prescription means for prescribing a potential above said substrate.

6. An image forming apparatus according to claim 1, wherein said electron emitting devices are provided with modulation means for modulating the electron beams emitted from said electron emitting devices in accordance with an information signal.

7. An image forming apparatus according to claim 6, further comprising voltage prescription means for prescribing a potential above said substrate.

8. An image forming apparatus according to claim 1, wherein said electron emitting devices are a cold cathode electron emitting devices.

9. An image forming apparatus according to claim 8, further comprising voltage prescription means for prescribing a potential above said substrate.

10. An image forming apparatus according to claim 1, wherein each said electron emitting devices have electrodes disposed on said substrate surface and an electron emitting section formed between said electrodes, and electrons are emitted from said electron emitting section when a voltage is applied between said electrodes.

11. An image forming apparatus according to claim 10, further comprising voltage prescription means for prescribing a potential above said substrate.

12. An image forming apparatus according to claim 1, wherein each said image forming member comprises a luminescent material which emits light when irradiated with electrons.

13. An image forming apparatus according to claim 12, further comprising voltage prescription means for prescribing a potential above said substrate.

14. An image forming apparatus according to claim 1, wherein said plurality of electron emitting devices and said plurality of image forming members are disposed on said substrate surface so as to form an X-Y matrix.

15. An image forming apparatus according to claim 14, further comprising voltage prescription means for prescribing a potential above said substrate.

16. An image forming apparatus according to claim 1, further comprising voltage prescription means for prescribing a potential above said substrate.

17. An image forming apparatus according to claim 16, wherein said voltage prescription means comprises an electroconductive member disposed so as to face said substrate surface.

18. An image forming apparatus according to claim 16, wherein said voltage prescription means comprises an electroconductive member which is disposed so as to face said substrate surface, and which is grounded.

19. An image forming apparatus according to claim 16, wherein said voltage prescription means comprises an electroconductive member which is disposed so as to face said substrate surface, and further comprising voltage application means for applying voltage, said voltage application means connected to said electroconductive member.

20. An image forming apparatus according to claim 1, wherein said electron emitting devices are surface conduction type electron emitting devices.

21. An image forming apparatus according to claim 1, further comprising a voltage prescription electrode for prescribing a potential on said substrate, with said voltage prescription electrode disposed opposite to said substrate surface.

22. An image forming apparatus comprising:

a plurality of electron emitting devices emitting electron beams;

a plurality of image forming members which form an image when irradiated with the electron beams emitted from said electron emitting devices, with each said electron emitting device corresponding to one or more of said image forming members;

a substrate for supporting said electron emitting devices and said image forming members, wherein said electron emitting devices and said image forming members are juxtaposed on a surface of said substrate, and auxiliary means for reinforcing an effect of irradiation of said image forming members with the electron beams, said auxiliary means having an electrode insulated between said image forming members and said electron emitting devices, with said electrode receiving a voltage for converging the electron beams emitted by said electron emitting devices, wherein each said image forming member comprises luminescent materials which emit light in three primary colors, read, green and blue, when irradiated with electrons.

23. An image forming apparatus according to claim 22, further comprising voltage prescription means for prescribing a potential above said substrate.

24. An image forming apparatus according to claim 22, wherein said auxiliary means is disposed below each said image forming member with an insulating layer interposed therebetween.

25. An image forming apparatus according to claim 24, further comprising voltage prescription means for prescribing a potential above said substrate.

26. An image forming apparatus according to claim 22, wherein said image forming members are provided with modulation means for modulating the electron beam emitted from said electron emitting devices in accordance with an information signal.

27. An image forming apparatus according to claim 26, further comprising voltage prescription means for prescribing a potential above said substrate.

28. An image forming apparatus according to claim 22, wherein said electron emitting devices are provided with modulation means for modulating the electron beams emitted from said electron emitting devices in accordance with an information signal.

29. An image forming apparatus according to claim 28, further comprising voltage prescription means for prescribing a potential above said substrate.

30. An image forming apparatus according to claim 22, wherein said electron emitting devices are cold cathode electron emitting devices.

31. An image forming apparatus according to claim 30, further comprising voltage prescription means for prescribing a potential above said substrate.

32. An image forming apparatus according to claim 22, wherein each said electron emitting devices have electrodes disposed on said substrate surface and an electron emitting section formed between said electrodes, and electrons are emitted from said electron emitting section when a voltage is applied between said electrodes.

33. An image forming apparatus according to claim 32, further comprising voltage prescription means for prescribing a potential above said substrate.

34. An image forming apparatus according to claim 22, wherein said plurality of electron emitting devices and said plurality of image forming members are disposed on said substrate surface so as to form an X-Y matrix.

35. An image forming apparatus according to claim 34, further comprising voltage prescription means for prescribing a potential above said substrate.

36. An image forming apparatus according to claim 22, further comprising voltage prescription means for prescribing a potential above said substrate.

37. An image forming apparatus according to claim 36, wherein said voltage prescription means comprises an electroconductive member disposed so as to face said substrate surface.

38. An image forming apparatus according to claim 36, wherein said voltage prescription means comprises an electroconductive member which is disposed so as to face said substrate surface and which is grounded.

39. An image forming apparatus according to claim 36, wherein said voltage prescription mans comprises an electroconductive member which is disposed so as to face said substrate surface, and further comprising voltage application means for applying voltage, with said voltage application means connected to said electroconductive member.

40. An image forming apparatus according to claim 22, wherein said electron emitting devices are surface conduction type electron emitting devices.

41. An image forming apparatus according to claim 22, further comprising a voltage prescription electrode for prescribing a potential on said substrate, with said voltage prescription electrode disposed opposite to said substrate surface.

42. An image forming apparatus comprising:

a plurality of electron emitting devices for emitting electrons;

a plurality of groups of luminescent members, with each luminescent member in each said group capable of emitting light when irradiated with an electron beam from said electron emitting device, said electron emitting devices and said luminescent members forming a matrix, with each said electron emitting device corresponding to one of said groups of luminescent members;

voltage application means for applying a predetermined voltage to each of said luminescent members; and a substrate supporting said electron emitting devices and said luminescent members, wherein each luminescent member emits light according to the voltage applied by said voltage application means when irradiated with the electron beam to form an image light emission pattern in accordance with said applied voltage, said electron emitting devices and said luminescent members are juxtaposed on a surface of said substrate, and the voltages are applied to said luminescent members in each said group separately and independently by said voltage application means.

43. An image forming apparatus according to claim 42, wherein said voltage application means comprises modulation means for providing the applied voltages by modulating an information signal having image information.

44. An image forming apparatus according to claim 42, wherein said electron emitting cold cathode devices are type devices.

45. An image forming apparatus according to claim 42, wherein said electron emitting devices have plus and minus electrodes and an electron emitting section formed between said electrodes, and electrons are emitted from said electron emitting section when a voltage is applied between said electrodes.

46. An image forming apparatus according to claim 45, wherein said group of luminescent members is provided on a side of said plus electrode of said electron emitting devices but not on said minus electrode side.

47. An image forming apparatus according to claim 42, wherein one group of said luminescent members comprises three luminescent materials respectively having three primary colors, red, green, and blue.

48. An image forming apparatus according to claim 42, wherein each voltage to be applied to each luminescent member in said group is selected in accordance with a luminous efficiency of said luminescent member.

49. An image forming apparatus according to claim 42, wherein said electron emitting devices are surface conduction type electron emitting devices.

50. An image forming apparatus according to claim 42, further comprising a voltage prescription electrode for prescribing a potential on said substrate, with said voltage prescription electrode disposed opposite to said substrate surface.

51. An image forming apparatus comprising:

an electron emitting device for emitting electrons;

a group of luminescent members, with each luminescent member in said group capable of emitting light when irradiated with an electron beam from said electron emitting device;

voltage application means for applying a predetermined voltage to each of said luminescent members; and a substrate supporting said electron emitting device and said luminescent members, wherein each luminescent member emits light according to the voltage applied by said voltage application means when irradiated with the electron beam to form an image light emission pattern in accordance with said applied voltage, said electron emitting device and said luminescent members are juxtaposed on a surface of said substrate, and the voltages are applied to said luminescent members in said group separately and independently by said voltage application means, and wherein each of the voltages applied to one group of said luminescent members is higher if a distance between an electron emitting section of said electron emitting device and corresponding one of said group of luminescent members is greater.

52. An image forming apparatus according to claim 51, wherein a plurality of said electron emitting devices and a plurality of groups of said luminescent members are provided to form a matrix, with each group of luminescent members mating with one of said plurality of electron emitting devices.

53. An image forming apparatus according to claim 51, wherein said voltage application means comprises modulation means for providing the applied voltages by modulating an information signal having image information.

54. An image forming apparatus according to claim 51, wherein said electron emitting device is a cold cathode.

55. An image forming apparatus according to claim 51, wherein said electron emitting device has plus and minus electrodes and an electron emitting section formed between said electrodes, and electrons are emitted from said electron emitting section when a voltage is applied between said electrodes.

56. An image forming apparatus according to claim 55, wherein said group of luminescent members is provided on a side of said plus electrode of said electron emitting device but not on said minus electrode side.

57. An image forming apparatus according to claim 51, wherein one group of said luminescent members comprises three luminescent materials respectively having three primary colors, red, green, and blue.

58. An image forming apparatus according to claim 51, wherein said electron emitting device is a surface conduction type electron emitting device.

59. An image forming apparatus according to claim 51, further comprising a voltage prescription electrode for prescribing a potential on said substrate, with said voltage prescription electrode disposed opposite to said substrate surface.

60. An image forming apparatus comprising:

an electron emitting device for emitting electrons;

a group of luminescent members, with each luminescent member in said group capable of emitting light when irradiated with an electron beam from said electron emitting device;

voltage application means for applying a predetermined voltage to each of said luminescent members; and a substrate supporting said electron emitting device and said luminescent members, wherein each luminescent member emits light according to the voltage applied by said voltage application means when irradiated with the electron beam to form an image light emission pattern in accordance with said applied voltage, said electron emitting device and said luminescent members are juxtaposed on a surface of said substrate, and the voltages are applied to said luminescent members in said group separately and independently by said voltage application means, and wherein a plurality of said electron emitting devices and a plurality of groups of said luminescent members each mating with a corresponding one of said plurality of electron emitting devices are disposed and combined into a matrix, said electron emitting devices each having electrodes disposed on said substrate surface and an electron emitting section formed between said electrodes are connected in rows so that one row of said electron emitting devices can be simultaneously driven at a time, and said luminescent members are connected with respect to each column.

61. An image forming apparatus according to claim 60, wherein each of the voltages applied to one group of said luminescent members is higher if a distance between an electron emitting section of said electron emitting device and corresponding one of said group of luminescent members is greater.

62. An image forming apparatus according to claim 60, wherein said voltage application means comprises modulation means for providing the applied voltages by modulating an information signal having image information.

63. An image forming apparatus according to claim 60, wherein said electron emitting device is a cold cathode.

64. An image forming apparatus according to claim 60, wherein said electron emitting device has plus and minus electrodes and an electron emitting section formed between said electrodes, and electrons are emitted from said electron emitting section when a voltage is applied between said electrodes.

65. An image forming apparatus according to claim 64, wherein said group of luminescent members is provided on a side of said plus electrode of said electron emitting device but not on said minus electrode side.

66. An image forming apparatus according to claim 60, wherein one group of said luminescent members comprises three luminescent materials respectively having three primary colors, red, green, and blue.

67. An image forming apparatus according to claim 60, wherein each voltage to be applied to each luminescent member in said group is selected in accordance with a luminous efficiency of said luminescent member.

68. An image forming apparatus according to claim 60, wherein said electron emitting device is a surface conduction type electron emitting device.

69. An image forming apparatus according to claim 60, further comprising a voltage prescription electrode for prescribing a potential on said substrate, with said voltage prescription electrode disposed opposite to said substrate surface.

70. An image forming apparatus comprising:

an electron emitting device for emitting electrons;

a group of luminescent members, with each luminescent member in said group capable of emitting light when irradiated with an electron beam from said electron emitting device;

voltage application means for applying a predetermined voltage to each of said luminescent members; and a substrate supporting said electron emitting device and said luminescent members, wherein each luminescent member emits light according to the voltage applied by said voltage application means when irradiated with the electron beam to form an image light emission pattern in accordance with said applied voltage, said electron emitting device and said luminescent members are juxtaposed on a surface of said substrate, and the voltages are applied to said luminescent members in said group separately and independently by said voltage application means, with said electron emitting device having a positive electrode and a negative electrode located in a plane parallel to said substrate surface.

71. An image forming apparatus according to claim 70, wherein each of the voltages applied to one group of said luminescent members is higher if a distance between an electron emitting section of said electron emitting device and corresponding one of said group of luminescent members is greater.

72. An image forming apparatus according to claim 70, wherein said voltage application means comprises modulation means for providing the applied voltages by modulating an information signal having image information.

73. An image forming apparatus according to claim 70, wherein said electron emitting device is a cold cathode.

74. An image forming apparatus according to claim 70, wherein said electron emitting device has plus and minus electrodes and an electron emitting section formed between said electrodes, and electrons are emitted from said electron emitting section when a voltage is applied between said electrodes.

75. An image forming apparatus according to claim 74, wherein said group of luminescent members is provided on a side of said plus electrode of said electron emitting devices but not on said minus electrode side.

76. An image forming apparatus according to claim 70, wherein one group of said luminescent members comprises three luminescent materials respectively having three primary colors, red, green and blue.

77. An image forming apparatus according to claim 70, wherein a plurality of said electron emitting devices and a plurality of groups of said luminescent members each mating with a corresponding one of said plurality of electron emitting devices are disposed and combined into a matrix, said electron emitting devices each having electrodes disposed on said substrate surface and an electron emitting section formed between said electrodes are connected in rows so that one row of said electron emitting devices can be simultaneously driven at a time, and said luminescent members are connected with respect to each column.

78. An image forming apparatus according to claim 70, further comprising a plurality of said electron emitting devices and a plurality of groups of said luminescent members forming a matrix, with each group of luminescent members mating with a corresponding one of said plurality of electron emitting devices.

79. An image forming apparatus according to claim 70, wherein each voltage to be applied to each luminescent member in said group is selected in accordance with a luminous efficiency of said luminescent member.

80. An image forming apparatus according to claim 70, wherein said electron emitting device is a surface conduction type electron emitting device.

81. An image forming apparatus according to claim 70, further comprising a voltage prescription electrode for prescribing a potential on said substrate, with said voltage prescription electrode disposed opposite to said substrate surface.

82. An image forming apparatus comprising:

an electron emitting device emitting an electron beam;

an image forming member which forms an image when irradiated with the electron beam emitted from said electron emitting device;

a voltage applying electrode for applying a voltage to said image forming member;

a correction electrode for controlling a flying direction of flying of the electron beam emitted by said electron emitting device; and a substrate with a surface supporting said correction electrode and said voltage applying electrode, with said correction electrode having a portion which does not overlap with said voltage applying electrode in a direction perpendicular to said surface of said substrate.

83. An image forming apparatus according to claim 82, further comprising a voltage prescription electrode for prescribing a potential on said substrate, with said voltage prescription electrode disposed opposite to said substrate surface.

* * * * *

UNITED STATES PATENT AND TRADEMARK OFFICE

CERTIFICATE OF CORRECTION

PATENT NO. : 6,011,567
DATED : January 4, 2000
INVENTOR(S) : Naoto Nakamura, et al.

It is certified that error appears in the above-identified patent and that said Letters Patent is hereby corrected as shown below:

Column 4:
Line 35, "(Padio)" should read --(Radio)--.

Column 5:
Line 5, "electrode," should read --electrode 6, --.
Line 13, "changed" should read --changes--.

Column 7:
Line 36, "va" should read --Va--.

Column 10:
Line 5, "electrcconductive" should read --electroconductive--.

Column 11:
Line 60, "o" should be deleted.

Column 13:
Line 36, "insulting" should read --insulating--.

Column 14:
Line 31, "is suffers" should read --it suffers--.

Column 21:
Line 66, "member 49" should read --member 44--.

Column 24:
Line 29, 1 1mm," should read --1 mm, --.

Column 28:
Line 64, "substrate," should read --substrate 312, --.

Column 30:
Line 62, "10 1parts" should read --10 parts--.

Column 31:
Line 1, "GEYGY)," should read --GEIGY),--.

UNITED STATES PATENT AND TRADEMARK OFFICE

CERTIFICATE OF CORRECTION

PATENT NO. : 6,011,567
DATED : January 4, 2000
INVENTOR(S) : Naoto Nakamura, et al It is certified that error appears in the above-identified patent and that said Letters Patent is hereby corrected as shown below:

Column 48:
Line 32, "GEYGY) ." should read --GEIGY).--.

Column 49:
Line 34, "are is" should read --are--.
Line 50, "are a" should read --are--.

Column 50:
Line 56, "read" should read --red--.

Column 51:
Line 49, "mans" should read --means--.

Column 52:
Line 26, "emitting" should read --emitting devices are-- and "are" should be deleted Signed and Sealed this Twelfth Day of June, 2001

Nicholas P. Godici

*Attest:*

*Attesting Officer*

NICHOLAS P. GODICI
*Acting Director of the United States Patent and Trademark Office*